US007202455B2

(12) United States Patent
Choi

(10) Patent No.: US 7,202,455 B2
(45) Date of Patent: Apr. 10, 2007

(54) MICROWAVE OVEN

(75) Inventor: Seong Soo Choi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 32 days.

(21) Appl. No.: 10/895,976

(22) Filed: Jul. 22, 2004

(65) Prior Publication Data

US 2005/0016998 A1 Jan. 27, 2005

(30) Foreign Application Priority Data

| | | | |
|---|---|---|---|
| Jul. 23, 2003 | (KR) | ..... | P10-2003-0050537 |
| Jul. 25, 2003 | (KR) | ..... | P10-2003-0051362 |
| Jul. 28, 2003 | (KR) | ..... | P10-2003-0051961 |
| Jul. 29, 2003 | (KR) | ..... | P10-2003-0052227 |
| Aug. 1, 2003 | (KR) | ..... | P10-2003-0053465 |
| Aug. 9, 2003 | (KR) | ..... | P10-2003-0055178 |

(51) Int. Cl.
*A05B 6/78* (2006.01)

(52) U.S. Cl. ..... 219/754; 219/752

(58) Field of Classification Search ..... 219/754, 219/752, 388, 700, 762, 678, 745, 755
See application file for complete search history.

(56) References Cited

U.S. PATENT DOCUMENTS

| | | | | |
|---|---|---|---|---|
| 4,424,431 | A * | 1/1984 | Gurubatham | 219/754 |
| 5,147,068 | A * | 9/1992 | Wright | 221/9 |
| 5,245,150 | A * | 9/1993 | Grandi | 219/753 |
| 5,285,041 | A * | 2/1994 | Wright | 219/717 |
| 5,736,716 | A * | 4/1998 | Kim et al. | 219/708 |
| 5,831,253 | A * | 11/1998 | Han et al. | 219/708 |
| 5,859,413 | A * | 1/1999 | Kim et al. | 219/708 |
| 6,452,143 | B1 | 9/2002 | Choi | |
| 6,683,288 | B1 * | 1/2004 | Dunford | 219/679 |
| 6,930,295 | B2 * | 8/2005 | Kim | 219/685 |

FOREIGN PATENT DOCUMENTS

| | | |
|---|---|---|
| JP | 20-0248864 | 9/2001 |
| JP | 2001319770 | 11/2001 |
| JP | 2005-0012410 | 2/2005 |
| KR | 2003000202 | 1/2003 |

* cited by examiner

*Primary Examiner*—Daniel Robinson
(74) *Attorney, Agent, or Firm*—McKenna Long & Aldridge LLP

(57) ABSTRACT

Microwave oven including a case with a door, a cooking chamber in the case openable/closable with the door, and having a microwave applicable thereto, a first tray mounted in the cooking chamber to reciprocate therein, a second tray rotatably mounted on the first tray, and a link engaged with the motor and the first tray such that the first tray reciprocates within the cooking chamber, and further engaged with the motor and the second tray such that the second tray rotates with respect to the first tray.

51 Claims, 50 Drawing Sheets

MICROWAVE OVEN

This application claims the benefit of the Korean Application Nos. P2003-0050537 filed on Jul. 23, 2003, P2003-0051362 filed on Jul. 25, 2003, P2003-0051961 filed on Jul. 28, 2003, P2003-0052227 filed on Jul. 29, 2003, and P2003-0053465 filed on Aug. 1, 2003, and P2003-0055178 filed on Aug. 9, 2003, which are hereby incorporated by reference.

BACKGROUND OF THE INVENTION

1. Field of the Invention

The present invention relates to microwave ovens, and more particularly, to a tray assembly in the microwave oven, which moves a container containing food within a cooking chamber for uniform irradiation of a microwave to the food.

2. Background of the Related Art

The microwave oven defrosts or heats food by using heat from friction of molecules of food caused by vibration of the molecules coming from direction of the microwave thereto. FIG. 1 illustrates a typical microwave oven, referring to which the microwave oven will be described, in more detail.

Referring to FIG. 1, there is a cooking chamber 20 provided in a case 10 that forms an outer shape of the microwave oven, and the case 10 has a door 15 on front of the case 10 for opening/closing the cooking chamber 20. The case 10 has an outfit chamber (not shown) therein, provided with electric components, such as a magnetron (not shown) for directing the microwave to the cooking chamber 20, and a high voltage transformer (not shown) for applying a high voltage to the magnetron. Of course, the outfit chamber may also be provided with a fan (not shown) and the like for circulating air in the cooking chamber 20 or cooling the electric components therein.

In the meantime, there is a circular tray 25 on a floor of the cooking chamber 20, rotated by a motor (not shown) under the floor of the cooking chamber 20. Therefore, if a user places the container containing food on the tray 25 and puts the microwave oven into operation, the tray 25 rotates. According to this, the microwave from the magnetron is irradiated uniformly to the food, and heats the food uniformly.

However, the microwave oven with the circular tray 25 has difficulty in cooking food in a long container. Because, if the long container containing long food, such as fish, is placed on the tray 25, and the microwave oven is put into operation, the long food or the container hits a rear wall or the door 15 of the cooking chamber 20.

Moreover, in a case of a hood and microwave oven which is long in a left and right direction, only a central portion of the cooking chamber can be used as a cooking area, actually. Therefore, an inside space of the microwave oven can not be used, efficiently.

SUMMARY OF THE INVENTION

Accordingly, the present invention is directed to a tray assembly that substantially obviates one or more of the problems due to limitations and disadvantages of the related art.

An object of the present invention is to provide a tray assembly of an improved structure which enables easy cooking of long food.

Another object of the present invention is to provide a tray assembly of an improved structure which enables uniform cooking of, not only long food, but also general food, on the whole.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the microwave oven includes a case with a door, a cooking chamber in the case openable/closable with the door, and having a microwave applicable thereto, a first tray mounted in the cooking chamber to reciprocate therein, a second tray rotatably mounted on the first tray, and a link engaged with the motor and the first tray such that the first tray reciprocates within the cooking chamber, and further engaged with the motor and the second tray such that the second tray rotates with respect to the first tray.

In other aspect of the present invention, there is provided a microwave oven including a case with a door, a cooking chamber in the case openable/closable with the door, and having a microwave applicable thereto, a first tray mounted in the cooking chamber to reciprocate therein, a rotating supporter on the first tray, a link engaged with the motor and the first tray such that the first tray reciprocates within the cooking chamber, and further engaged with the motor and the rotating supporter such that the rotating supporter rotates with respect to the first tray, and a second tray on the rotating supporter for rotating with the rotating supporter.

The link includes a boss fixed to a shaft of the motor, a first bushing eccentric to an axis of the boss, and engaged with the first tray, and a second bushing eccentric to the axis of the boss, and engaged with the second tray.

The first tray preferably includes a receiving portion having a depth in an upper surface thereof for receiving the second tray. The depth of the receiving portion is greater than a thickness of the second tray.

The first tray includes a first receiving member on an underside surface of the first tray such that a part of the link is slidably engaged with the first receiving member.

The first receiving member is, for an example, a guide groove, or a first ridge, having a surface to be engaged with the link in a form of an ellipse when seen from above.

As another example, the surface of the first receiving member having the link engaged therewith includes two liner portions parallel to each other, and curved portions each connected between ends of the two linear portions.

As another example, the surface of the first receiving member having the link engaged therewith includes one pair of first two curved portions opposite to each other, and second curved portions each having a curvature different from the first curved portion connected between ends of the first curved portions.

As another example, the surface of the first receiving portion having the link engaged therewith has a diamond form when seen from above. In this case, the diamond form has a longer diagonal line arranged in a width direction of the first tray or a front/rear direction of the cooking chamber.

In the meantime, in any one of above examples, a distance from a rotation axis of the link to a part of the link is the same with, or greater than a distance from the rotation axis of the link to the surface of the first receiving portion having a part of the link engaged therewith.

In the meantime, the second tray includes at least one second receiving member provided to an underside surface of the second tray for slidable engagement of a part of the link.

Preferably, the second receiving member is one of a slot or a second ridge provided along a radial direction from a rotation axis of the second tray, and the second receiving member has a length the same with, or greater than one half of a linear reciprocating distance of the first tray.

The first tray further includes roller parts in an inside wall of the receiving portion for supporting an underside and a circumferential surface of the second tray, and guiding smooth rotation of the second tray with respect to the first tray. The roller part includes an upper roller in contact with a circumferential surface of the second tray, and a lower roller under the upper roller for supporting the underside surface of the second tray.

The microwave oven may further include a rotating supporter between the first, and second trays rotatable with the second tray for guiding smooth rotation of the second tray with respect to the first tray. The rotating supporter includes an annular frame, and a plurality of roller rotatably provided to the frame.

In the microwave oven in accordance with other aspect of the present invention, the rotating supporter includes an annular frame, a plurality of roller rotatably provided to the frame, and a crossbar inside of the frame, slidably engaged with the link. In this case, a hole is provided to one of the second tray, the rotating supporter, and especially the crossbar, a projection is provided to other one for inserting in the hole.

As above, in a case the rotating supporter is provided between the first and second trays, the microwave oven further includes a track provided to at least one of the first tray and the second tray for guiding a rolling path of the rollers for stable rotation of the rotating supporter. The track includes a circular slot, or ridge.

In the meantime, the microwave oven may further include a member for preventing the link from drooping. The member may be a roller provided to the arm so as to be in contact with the floor of the cooking chamber. Preferably, the member is provided to an end side of the arm or an underside of the arm.

In another aspect of the present invention, there is provided a microwave oven including a case with a door, a cooking chamber in the case openable/closable with the door, and having a microwave applicable thereto, a first tray mounted in the cooking chamber having a slot in an underside surface thereof, a link including a boss fixed to a shaft of the motor, an arm extended from the boss in a horizontal direction, a first bushing at one point of the arm eccentric to an axis of the boss and engaged with the first tray, for reciprocating the first tray within the cooking chamber when the motor is in operation, and a member provided to the arm to be in contact with a floor of the cooking chamber for preventing the arm from drooping.

In this case, the slot is preferably provided along a width direction of the first tray or a front/rear direction of the cooking chamber.

The member is a roller in contact with, and rolls on the floor of the cooking chamber, and preferably provided to an end side or an underside surface of the arm.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

Figure 1:
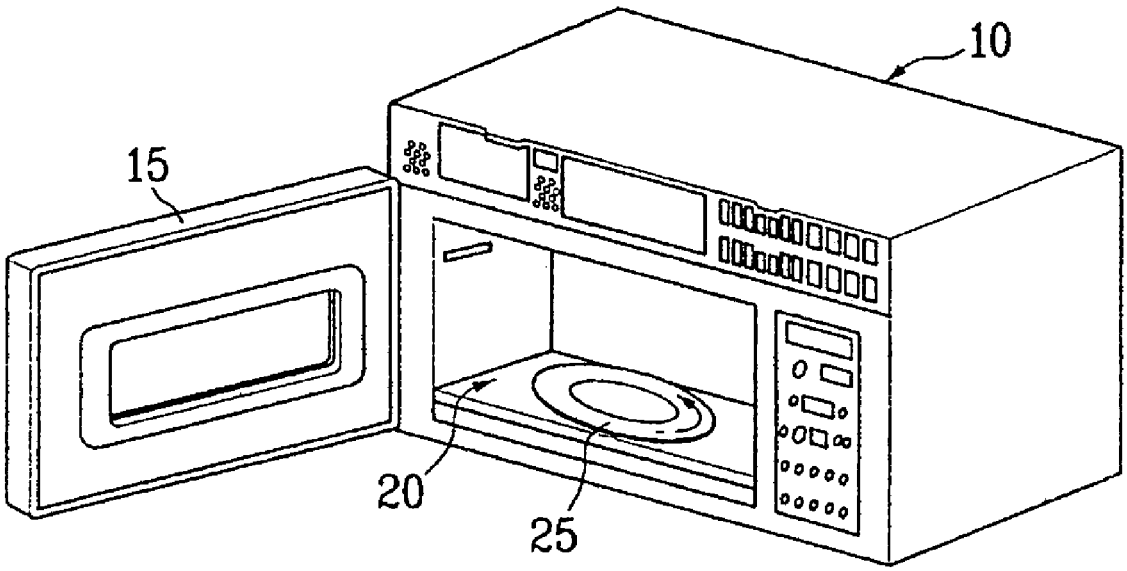
FIG. 1 Related Art
FIG. 1 illustrates a perspective view of a typical microwave oven having a rotatable tray.
Figure 2:
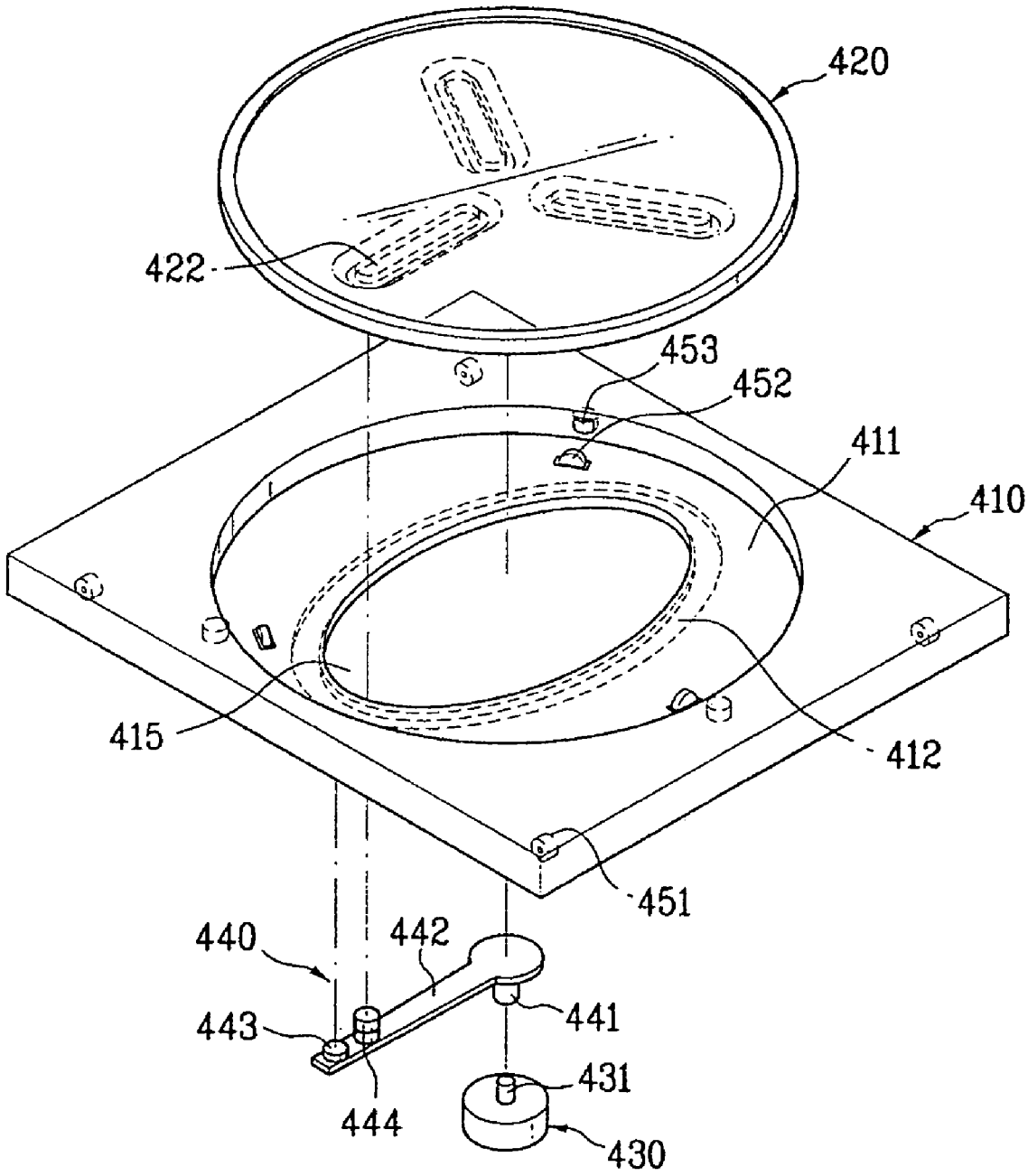
FIG. 2 illustrates a disassembled perspective view of a tray assembly in accordance with a first preferred embodiment of the present invention.
Figure 7:
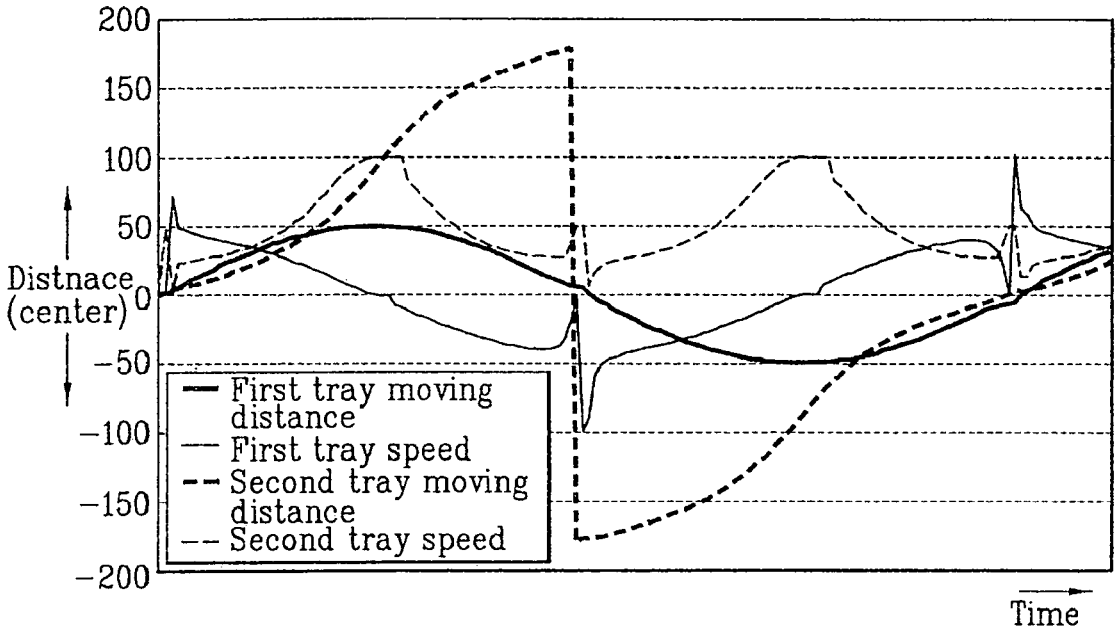
Figure 8:
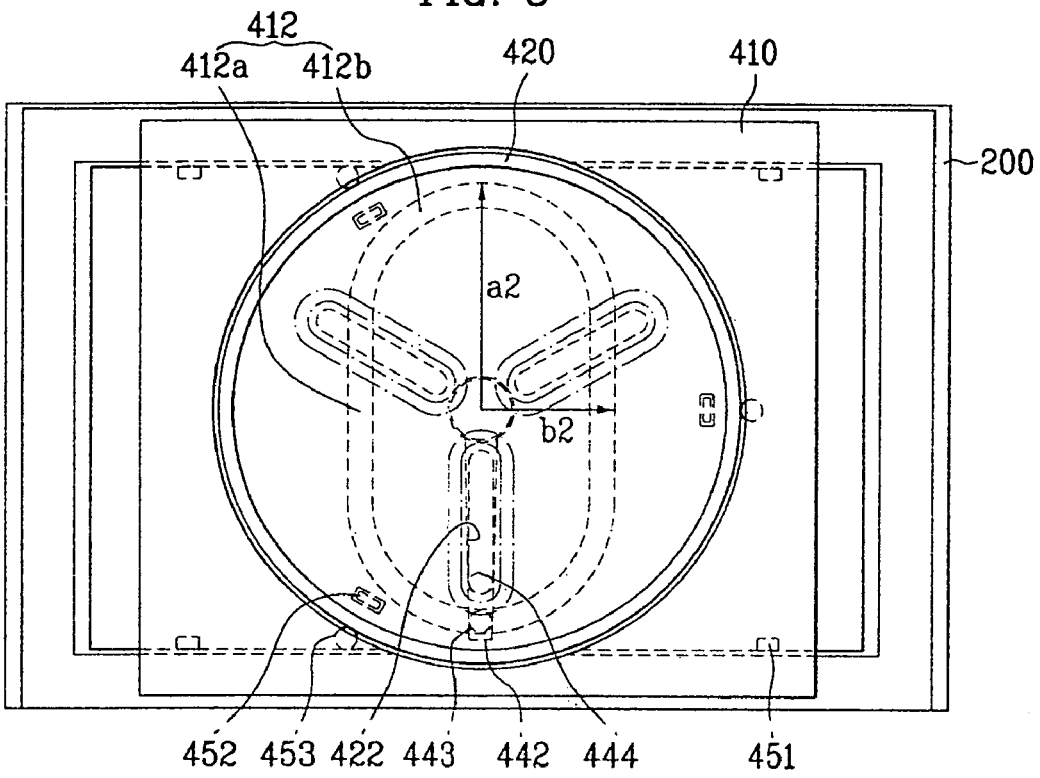
Figure 9:
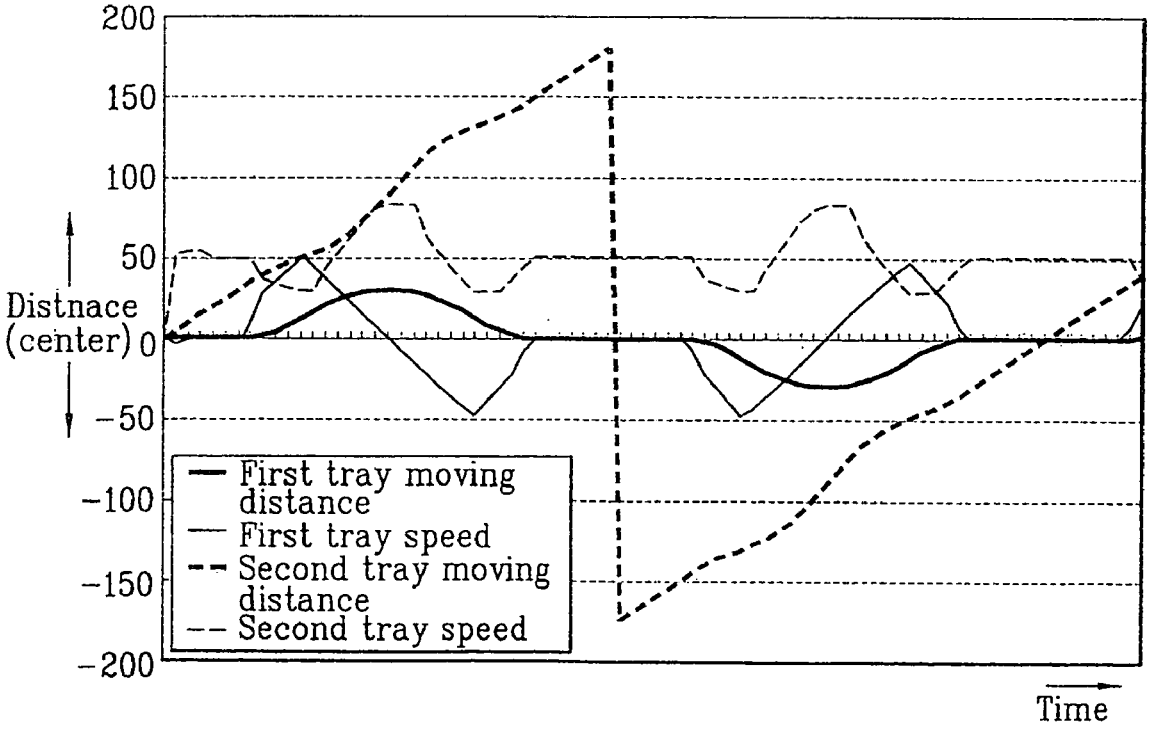
Figure 10:
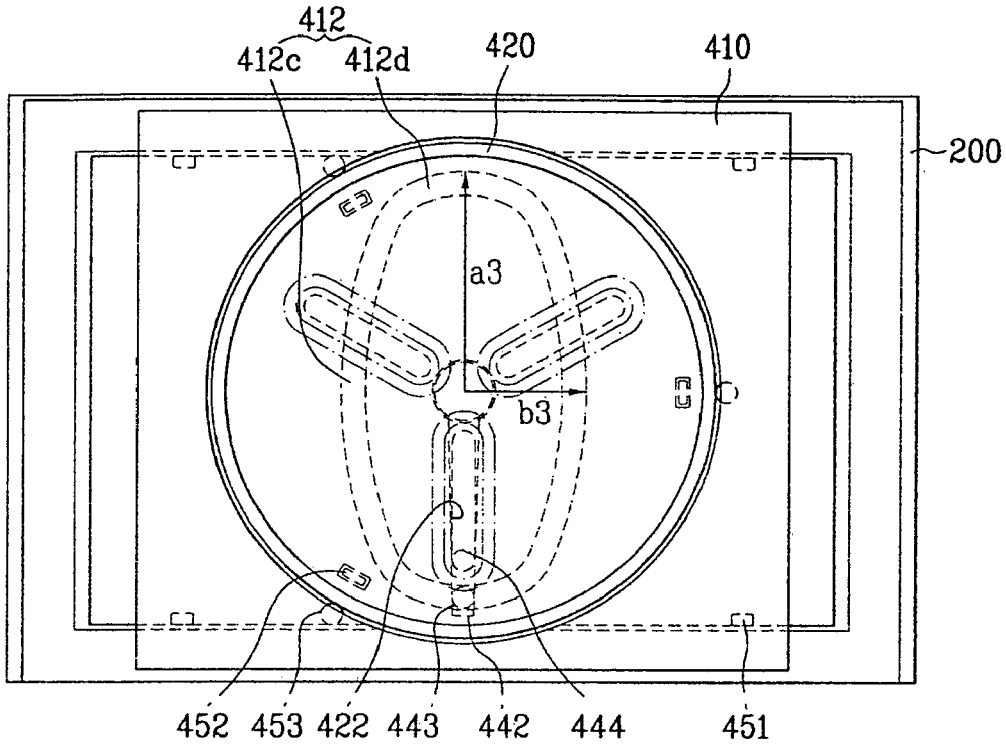
Figure 11:
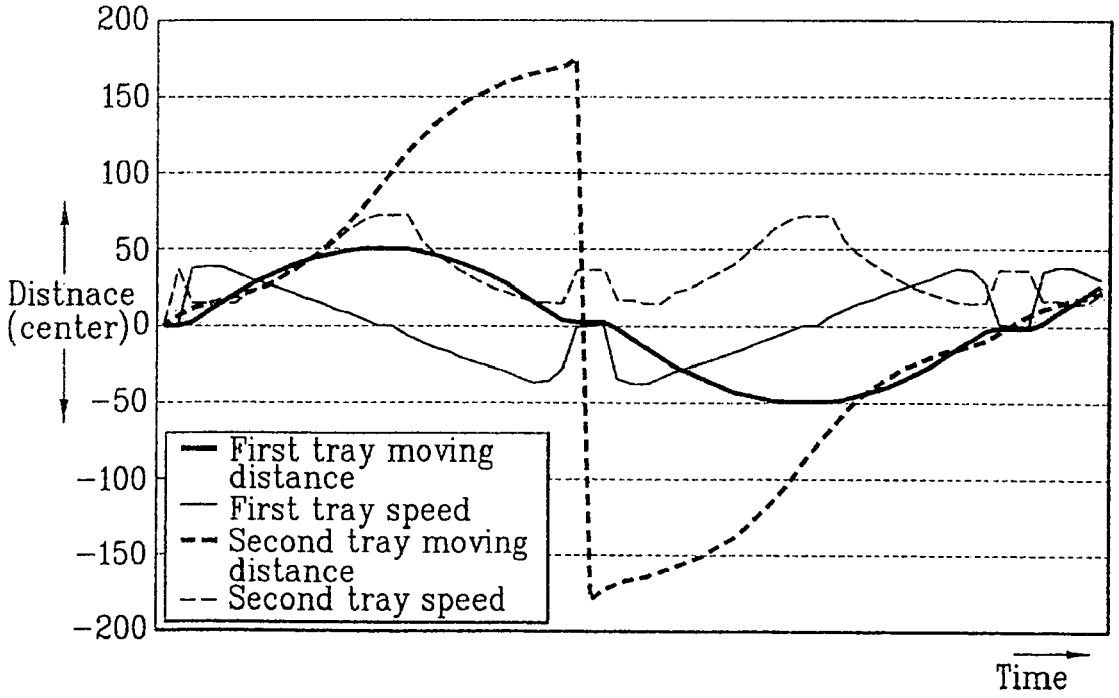
Figure 12:
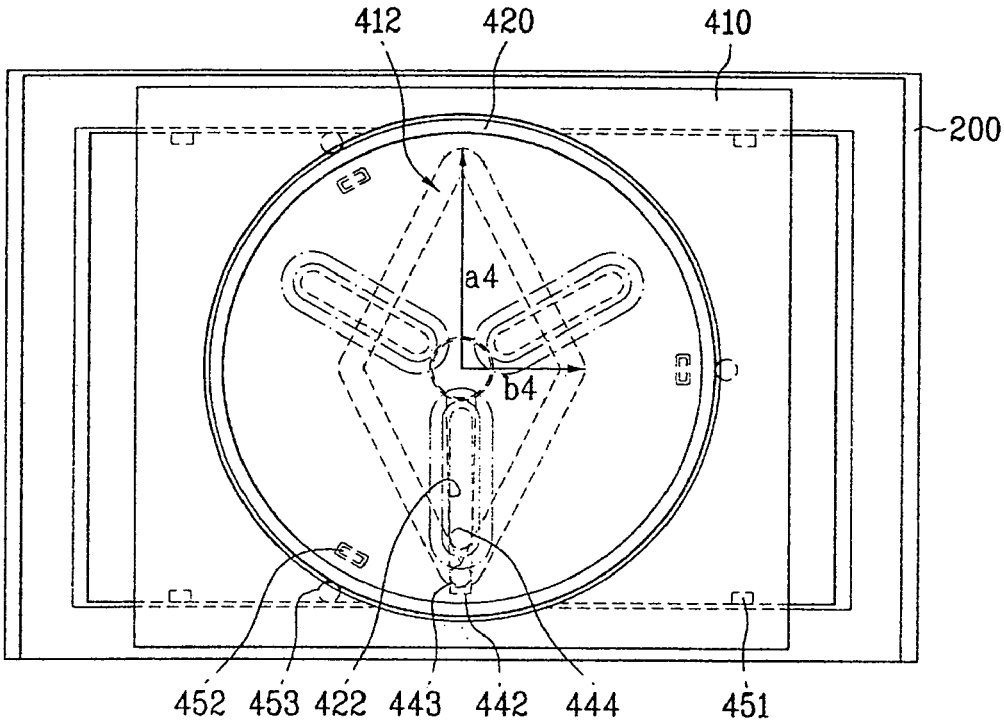
Figure 13:
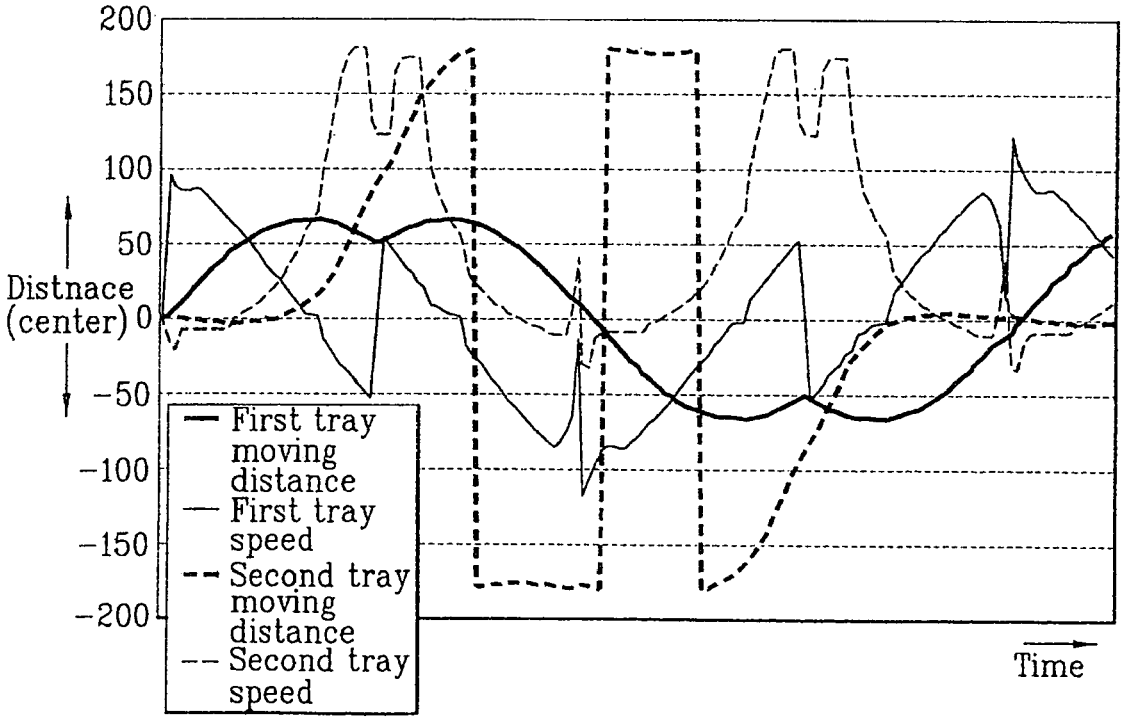
Figure 14:
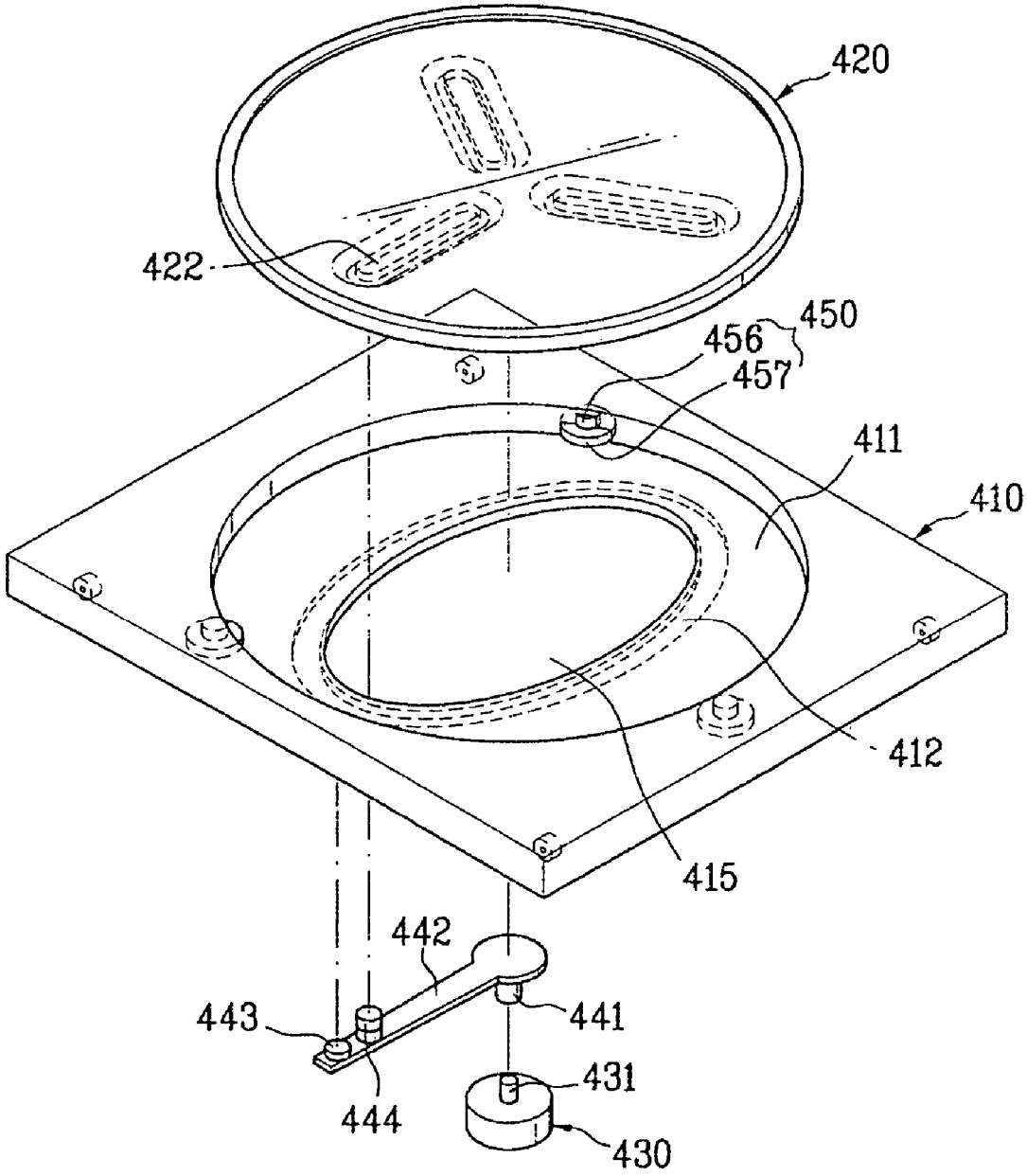
Figure 15A:
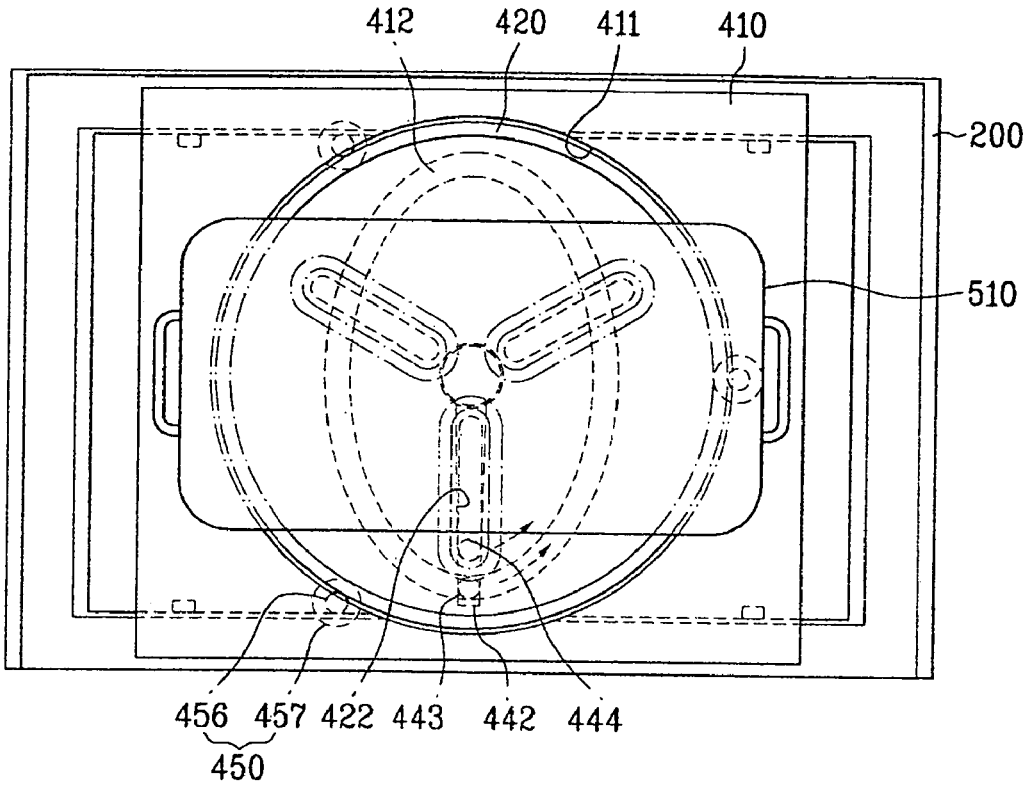
Figure 15B:
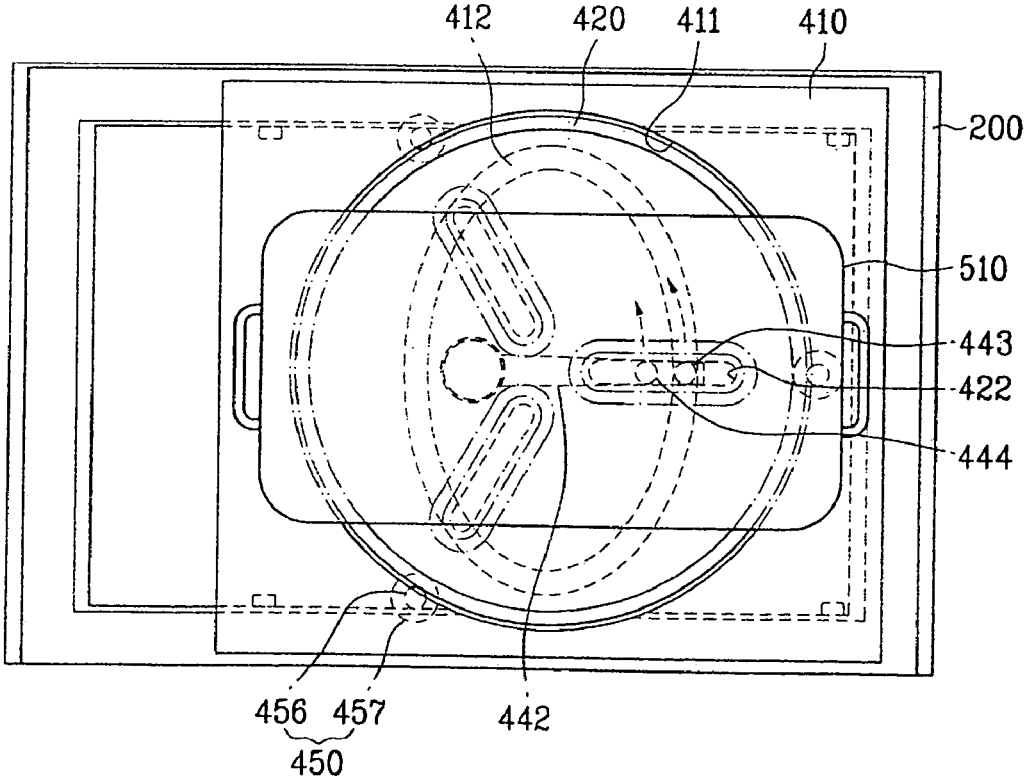
Figure 15C:
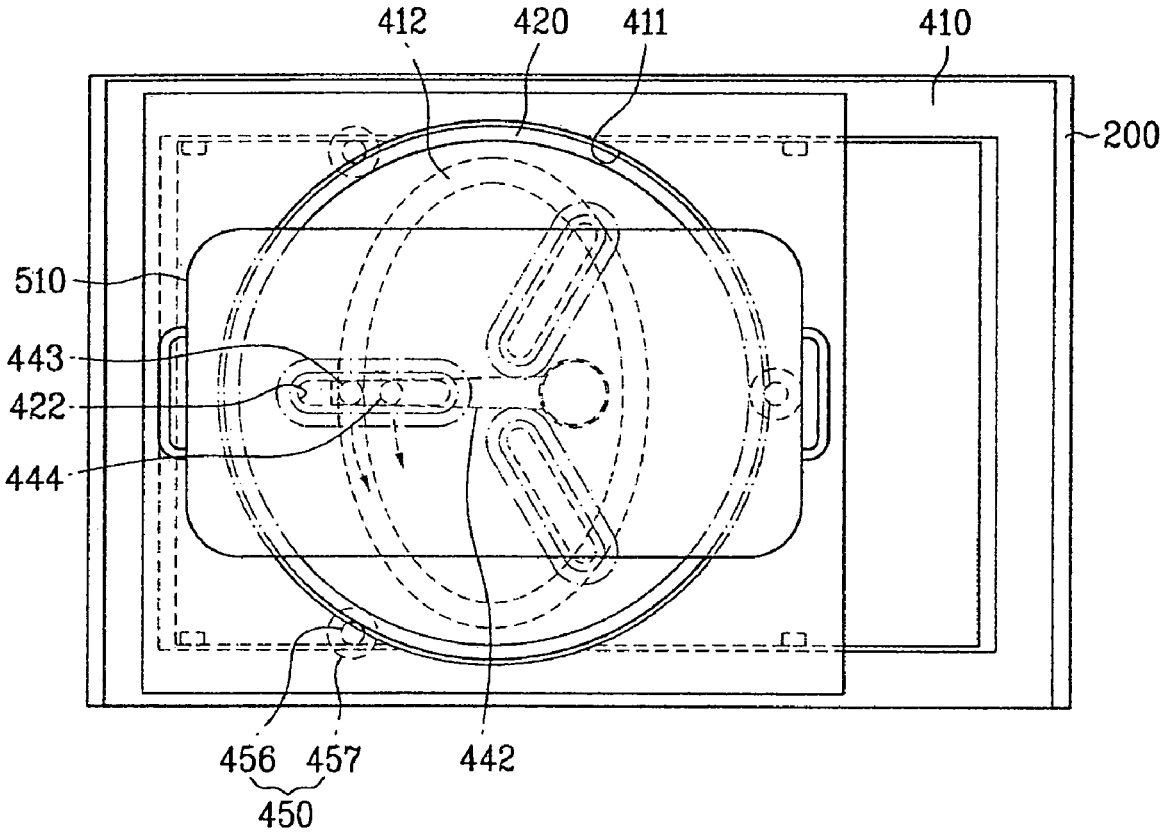
Figure 16A:
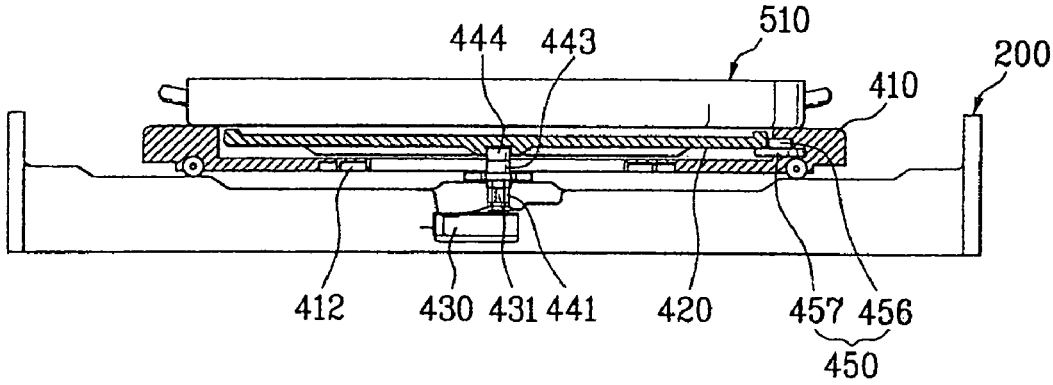
Figure 16B:
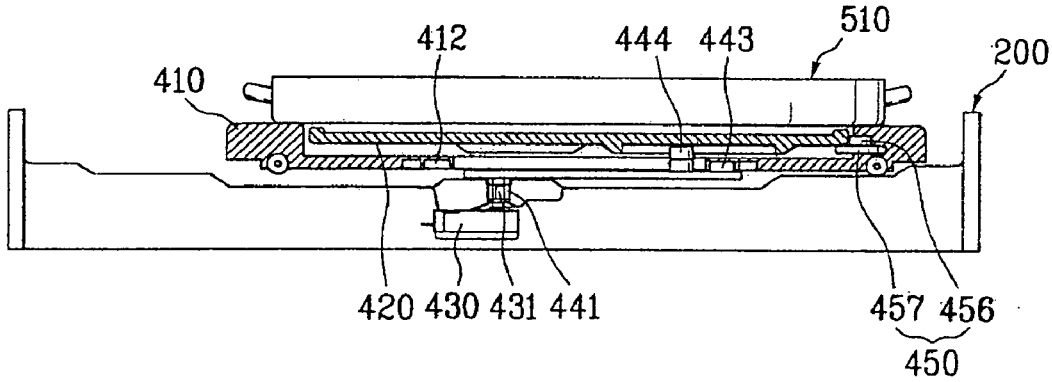
Figure 16C:
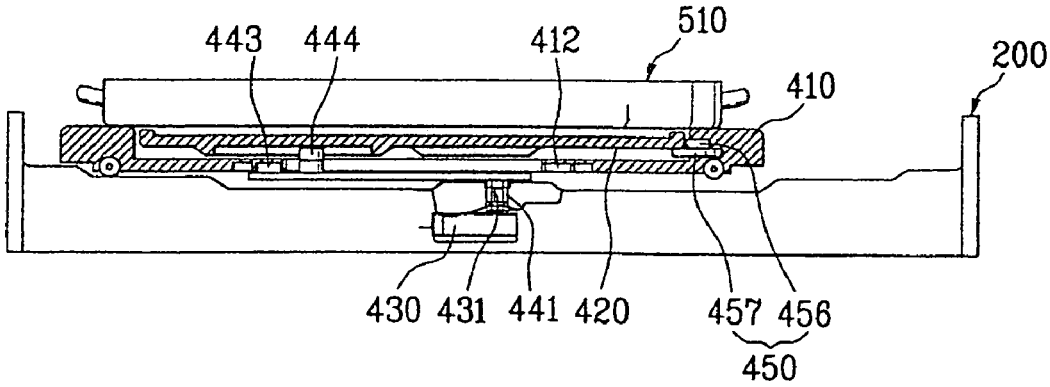
Figure 17A:
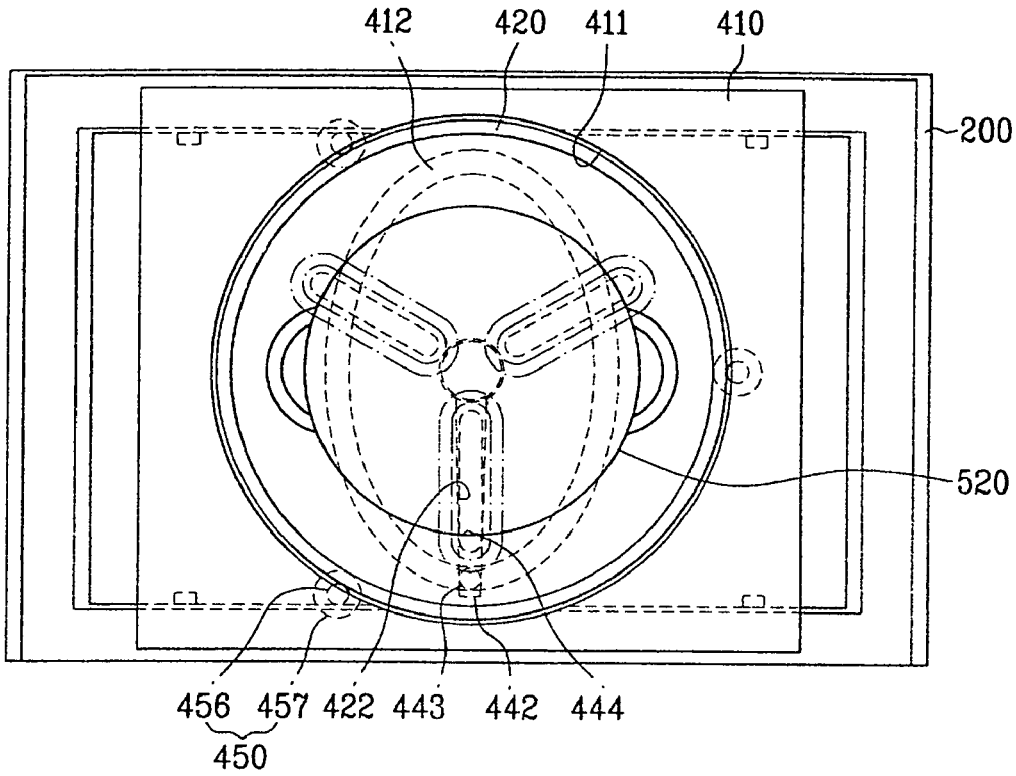
Figure 17B:
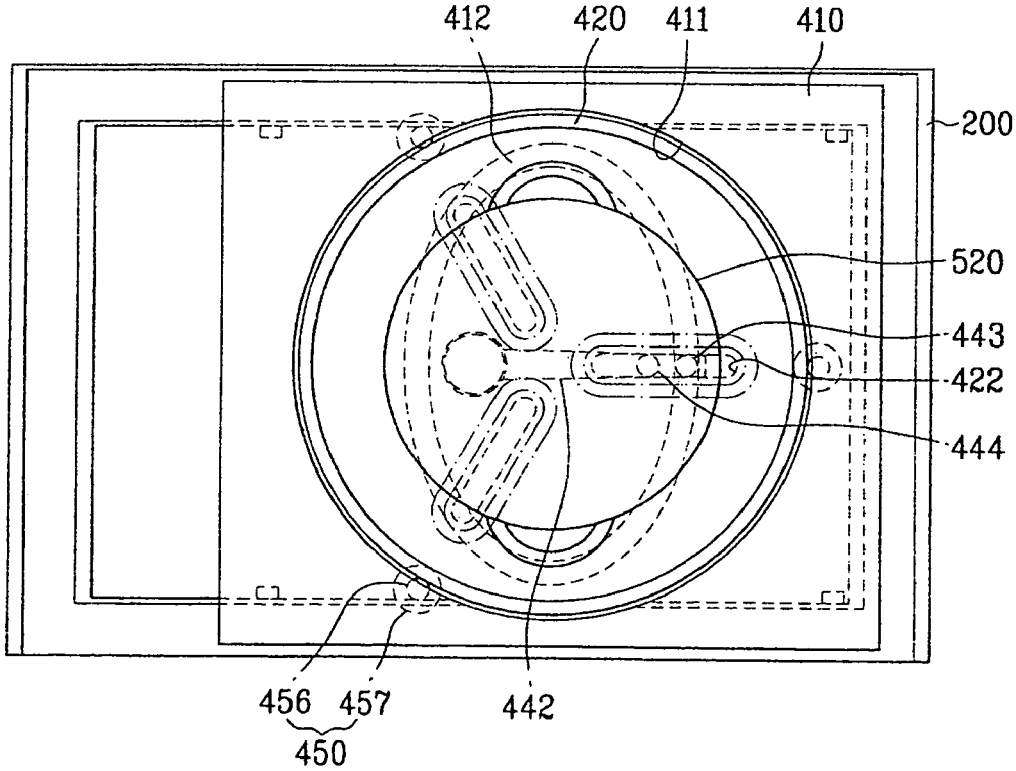
Figure 17C:
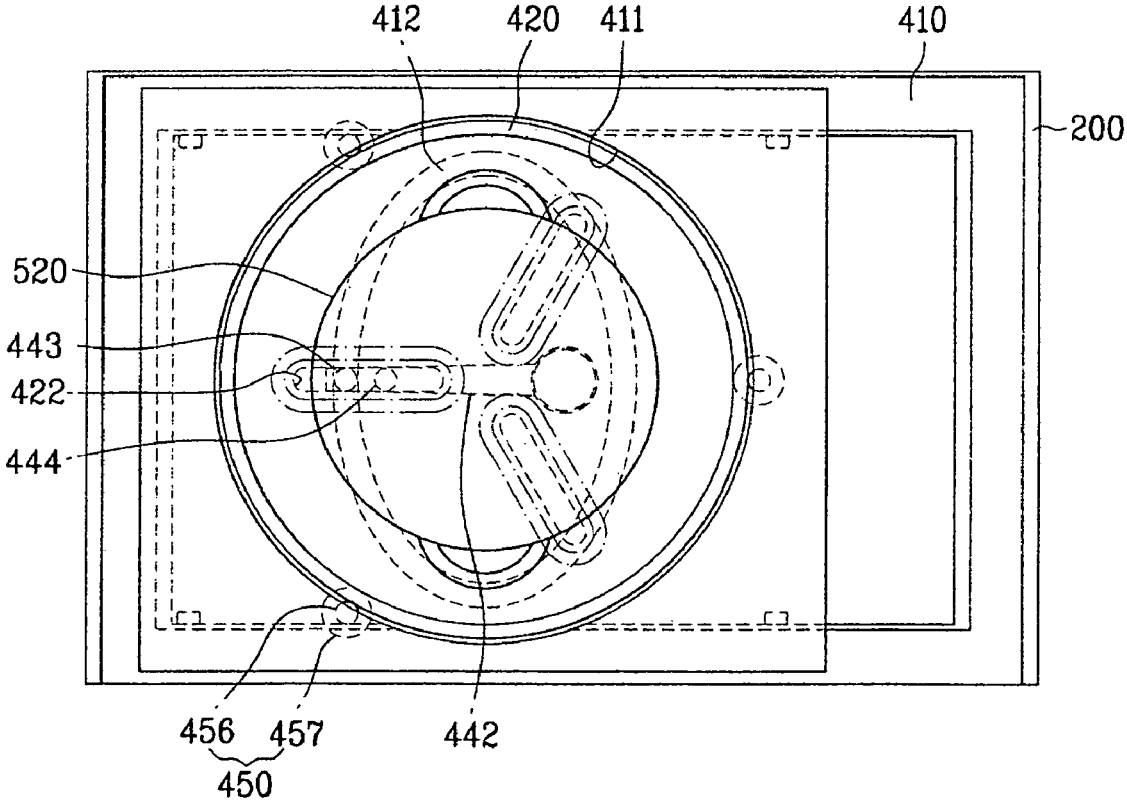
Figure 18A:
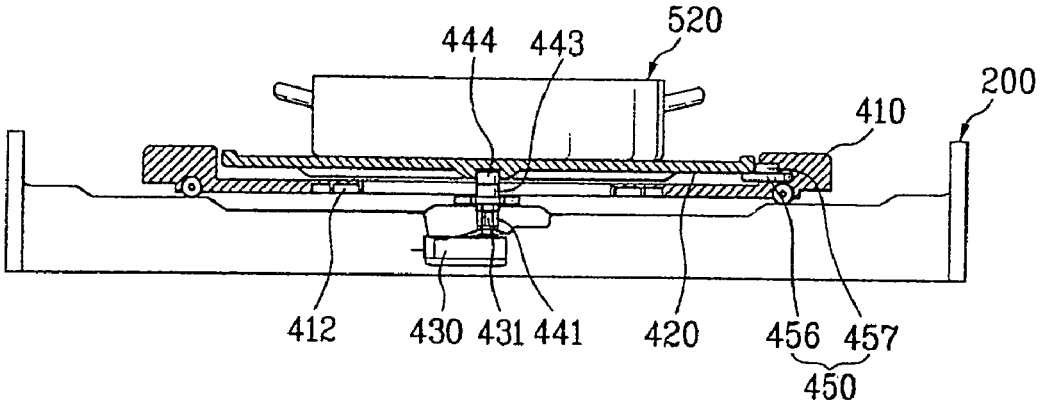
Figure 18B:
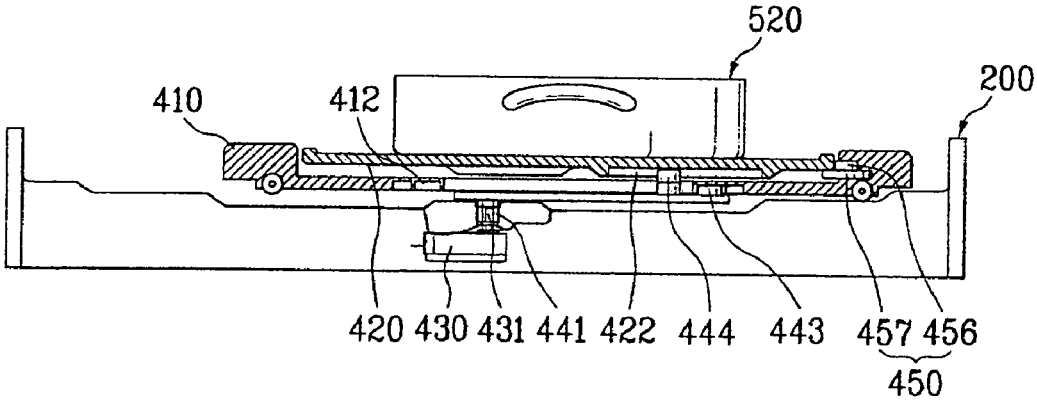
Figure 18C:
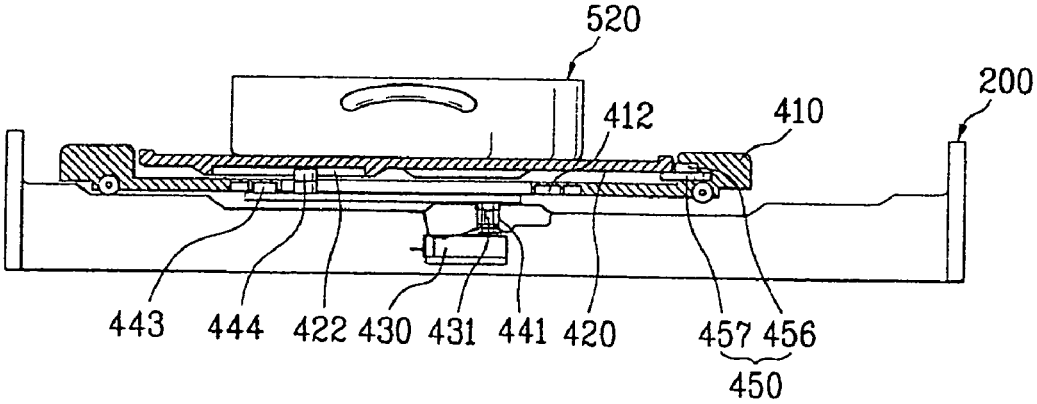
Figure 19:
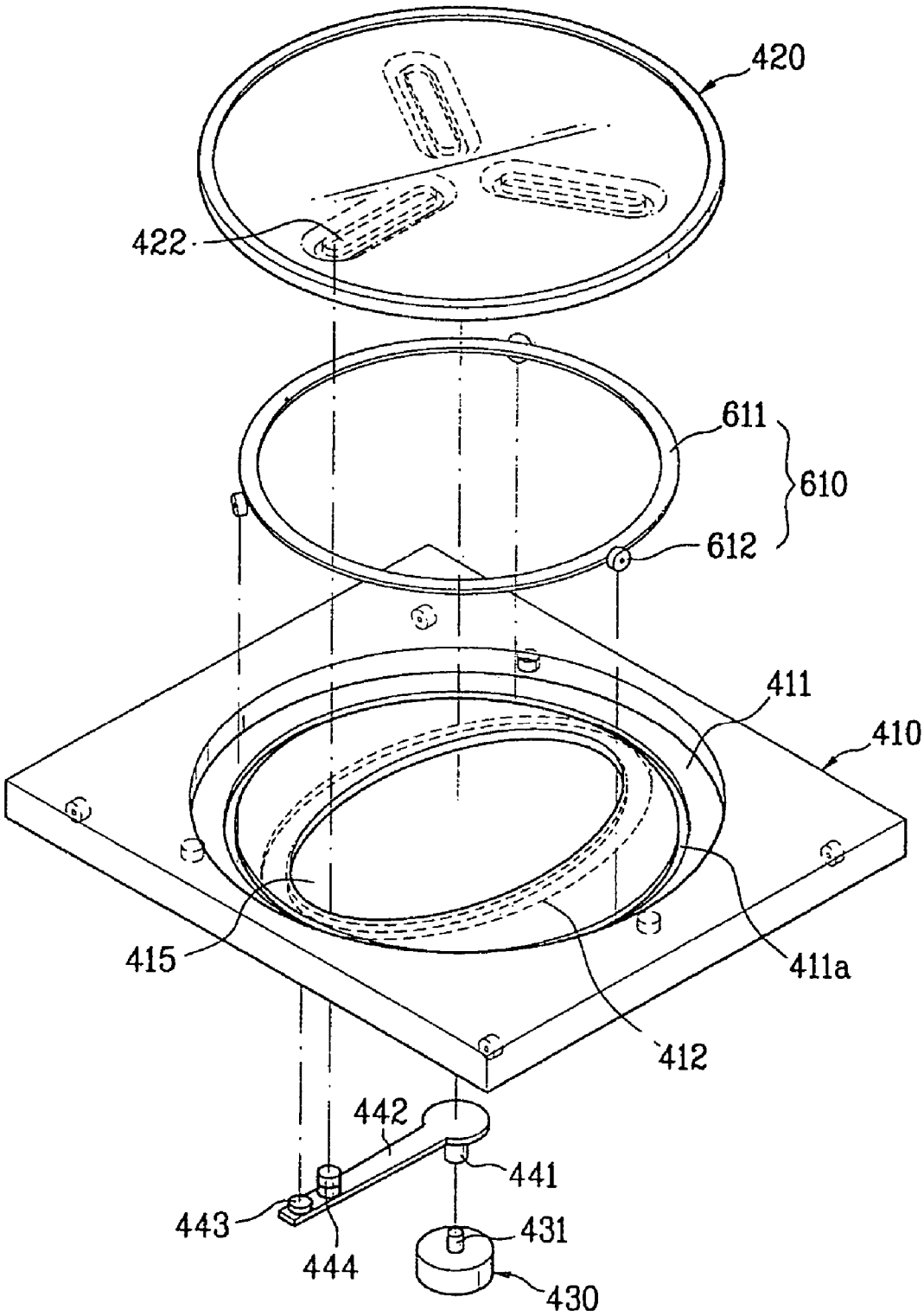
Figure 20A:
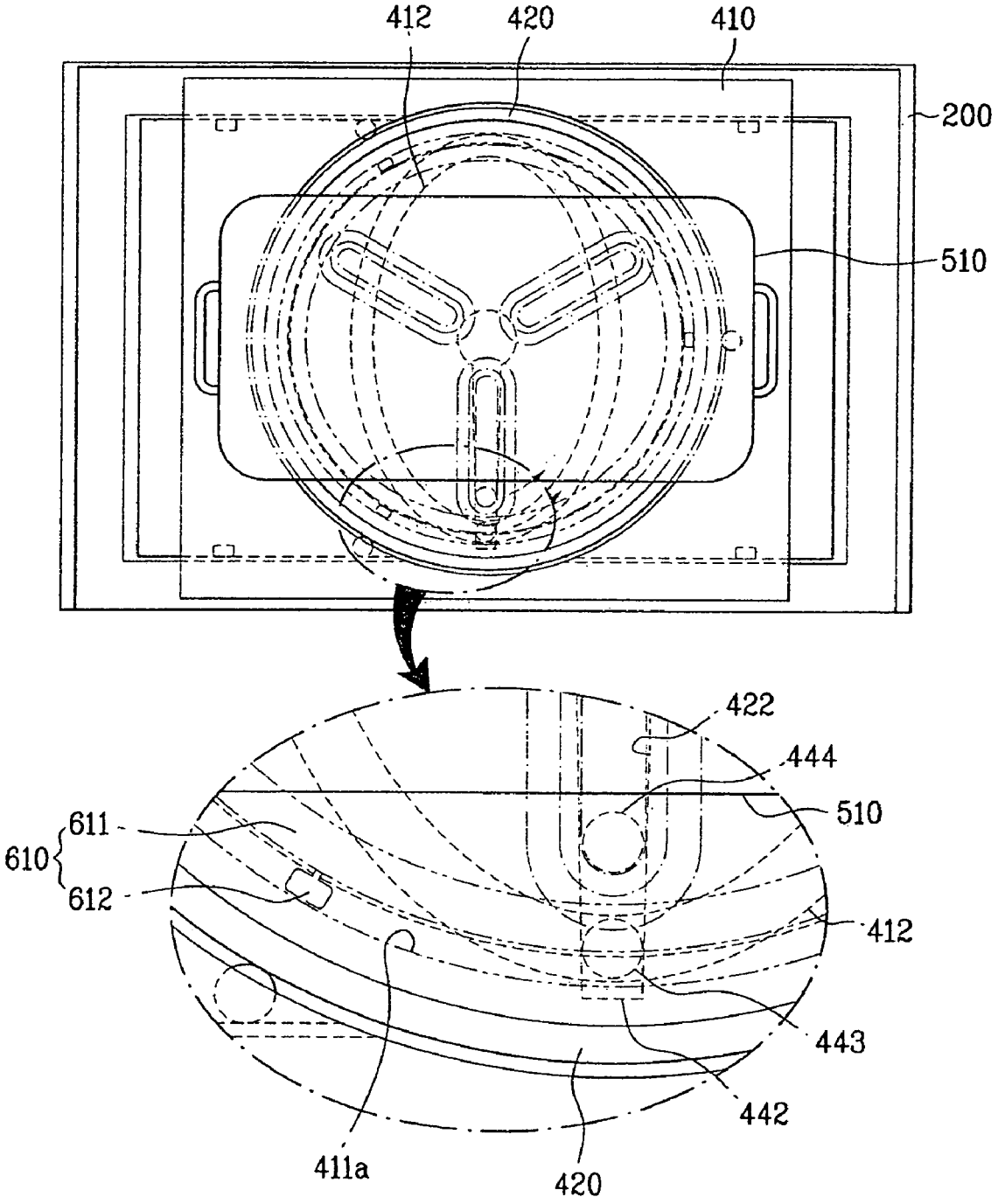
Figure 20B:
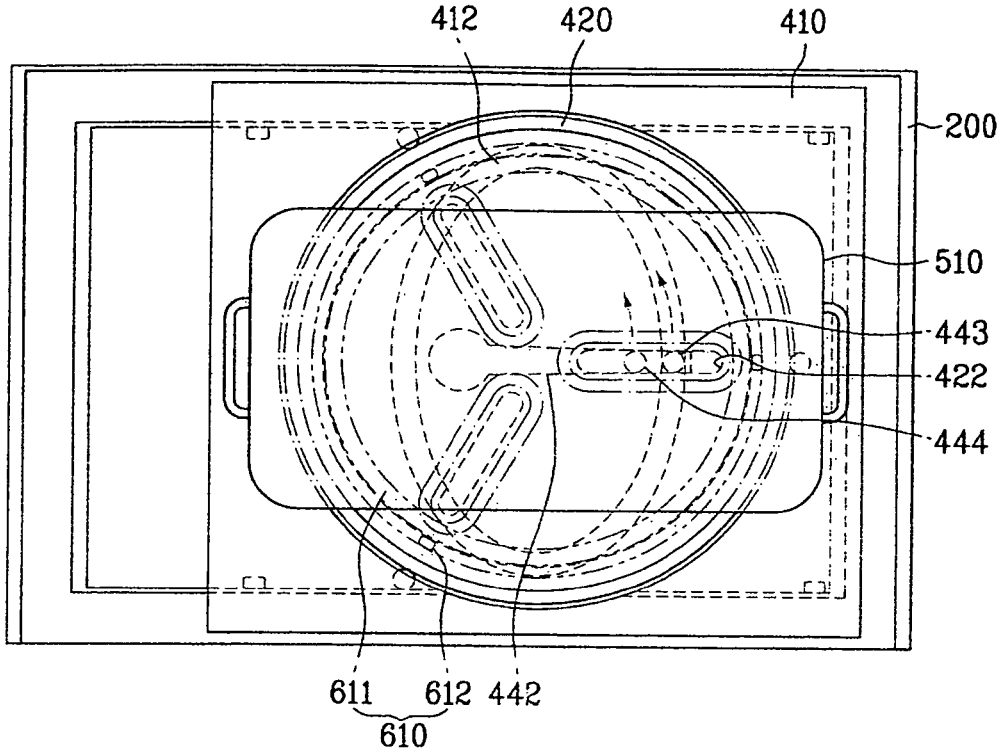
Figure 20C:
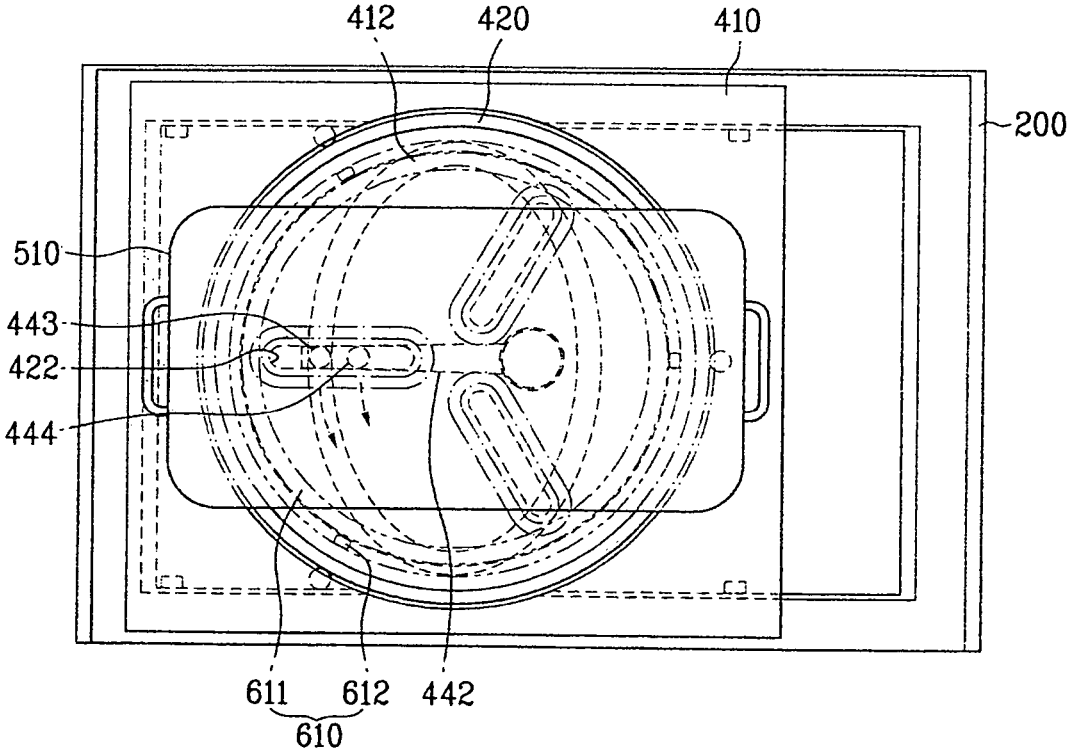
Figure 21A:
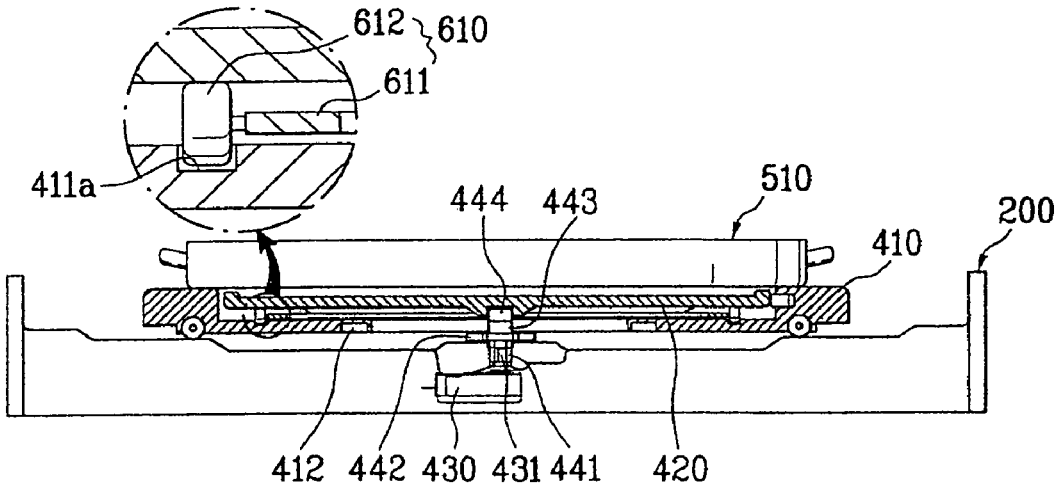
Figure 21B:
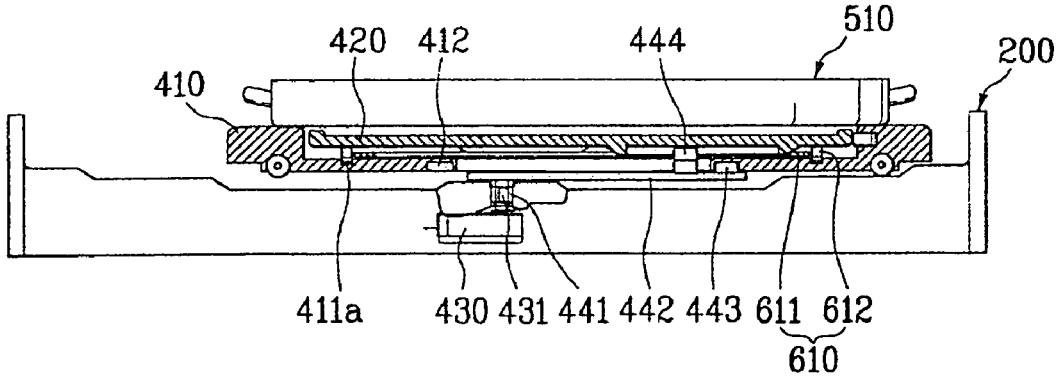
Figure 21C:
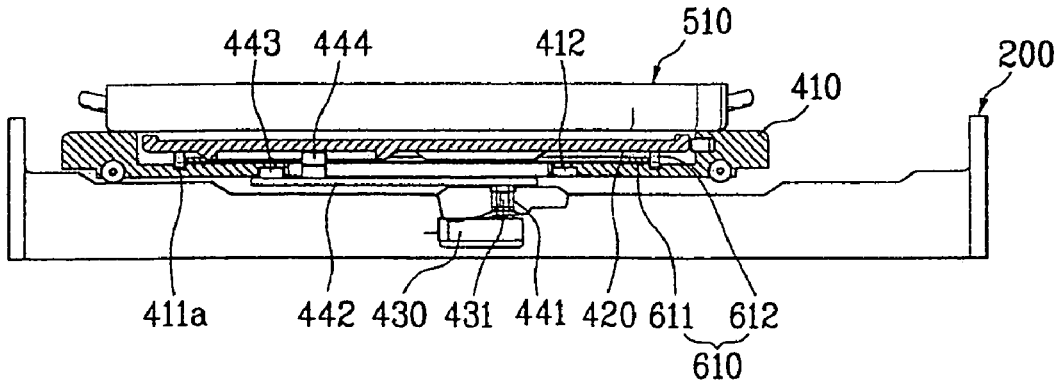
Figure 22A:
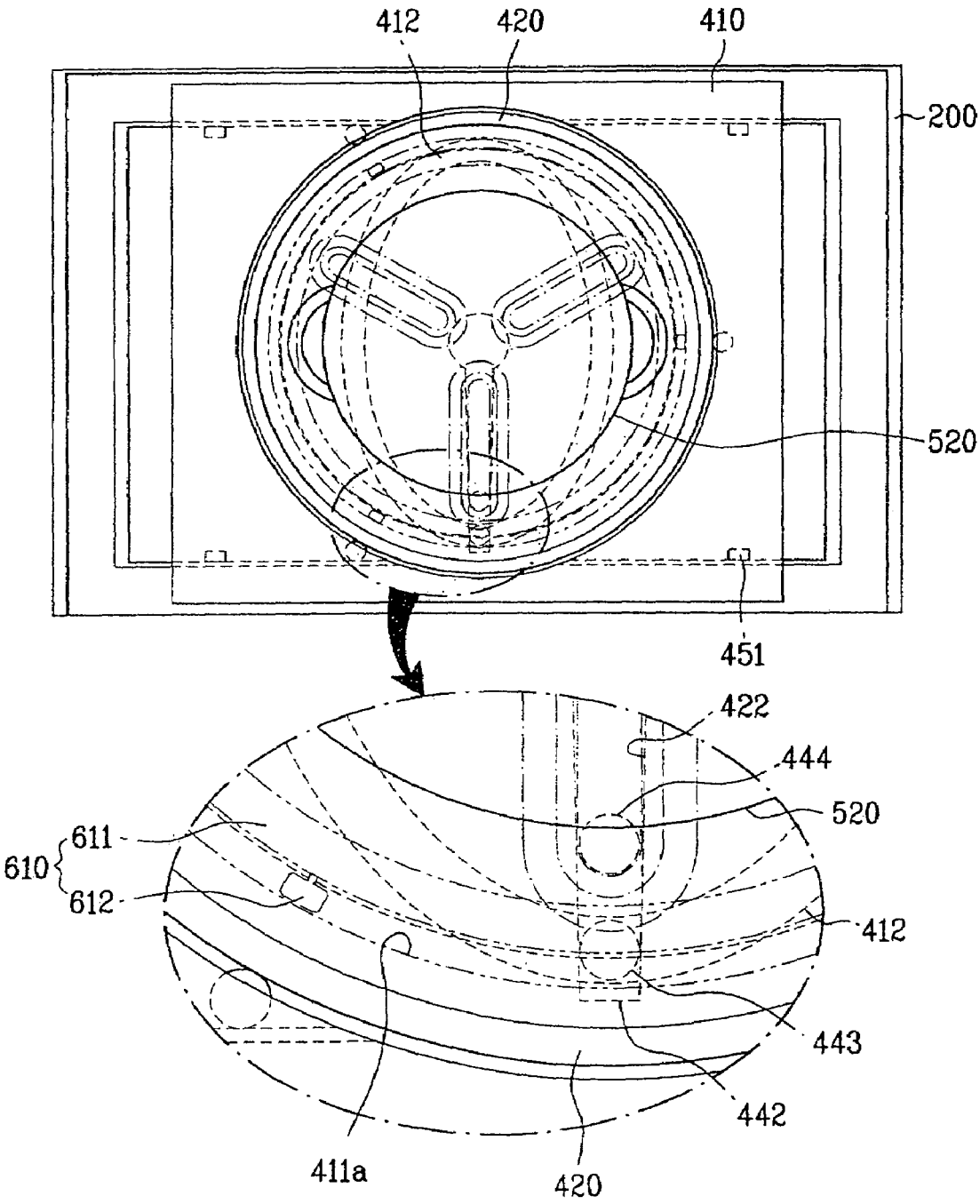
Figure 22B:
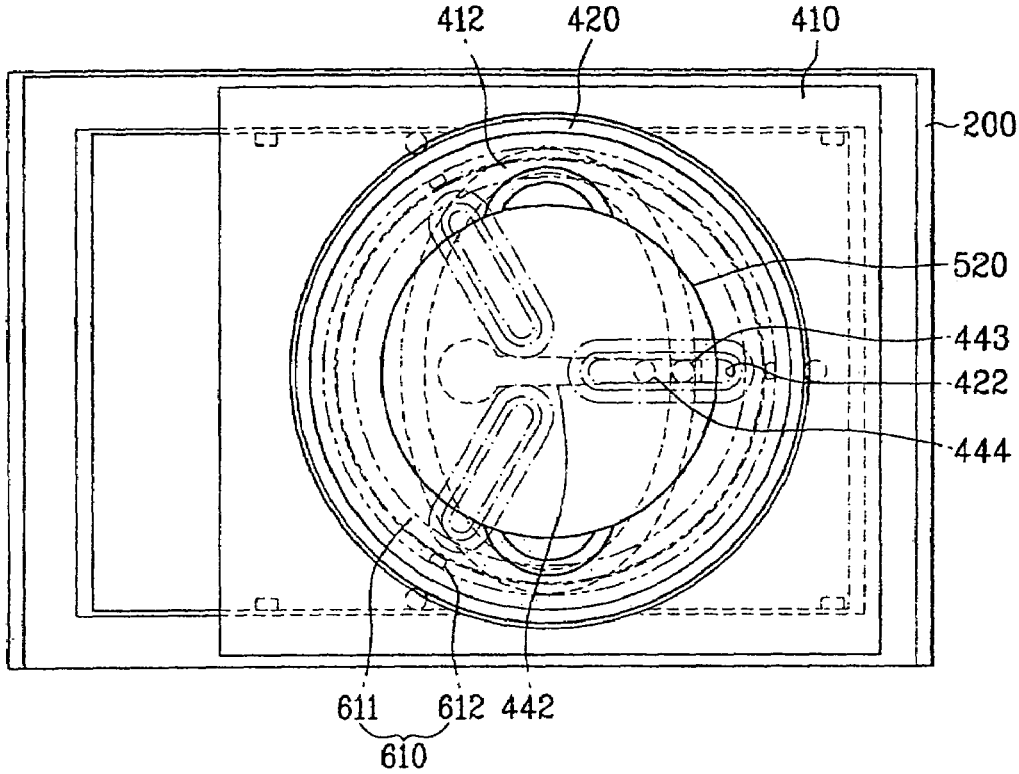
Figure 22C:
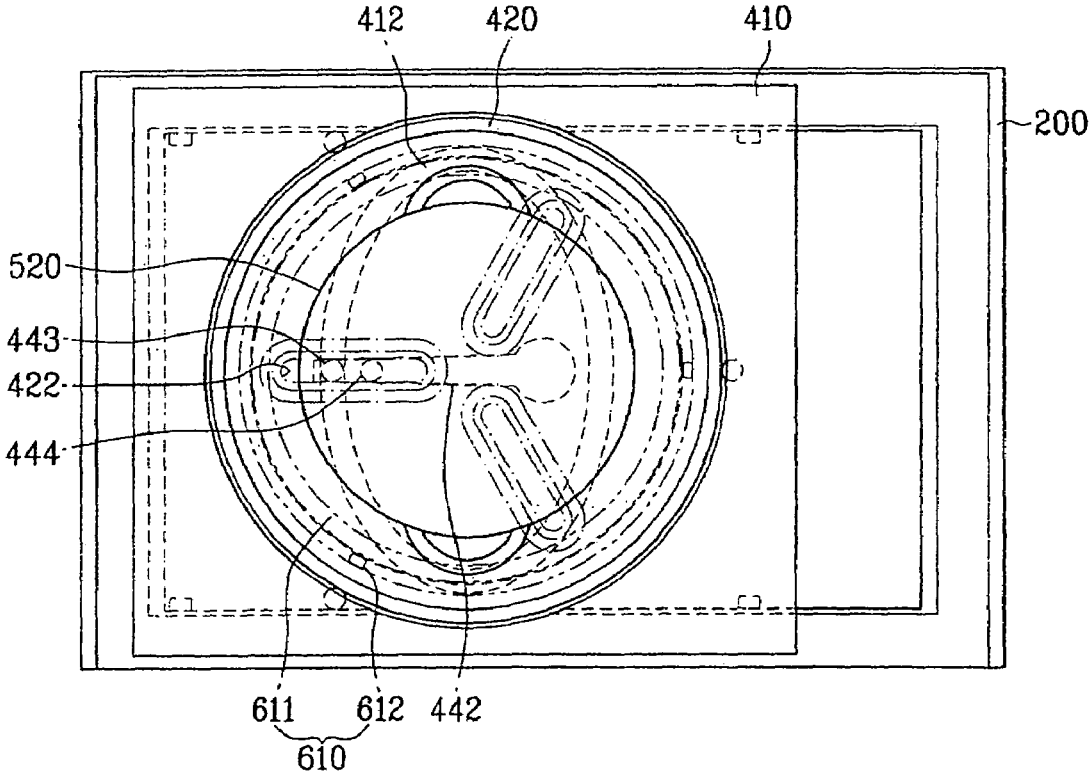
Figure 23A:
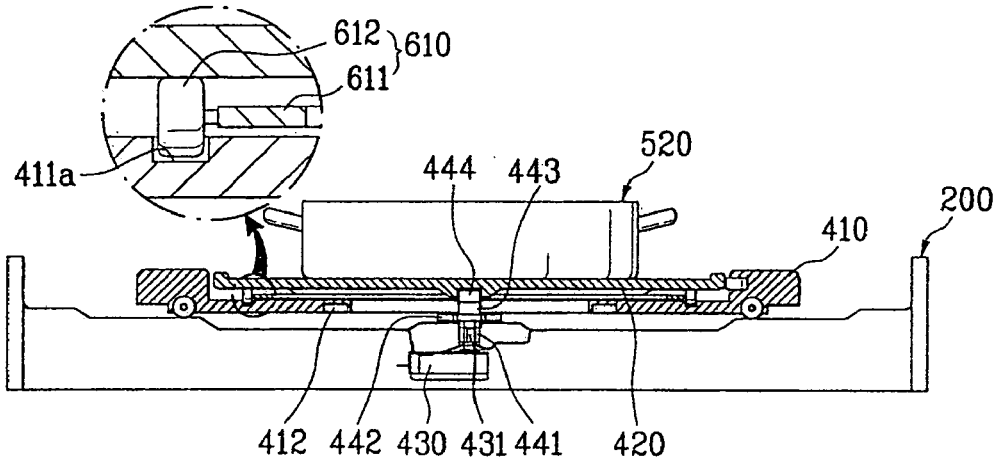
Figure 23B:
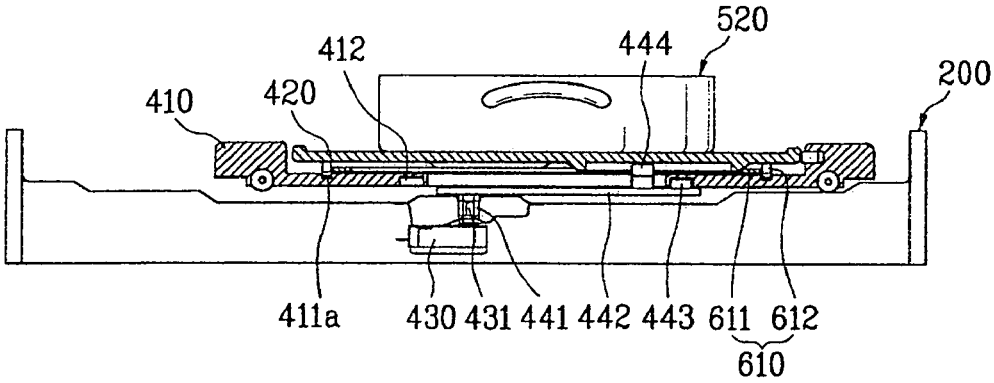
Figure 23C:
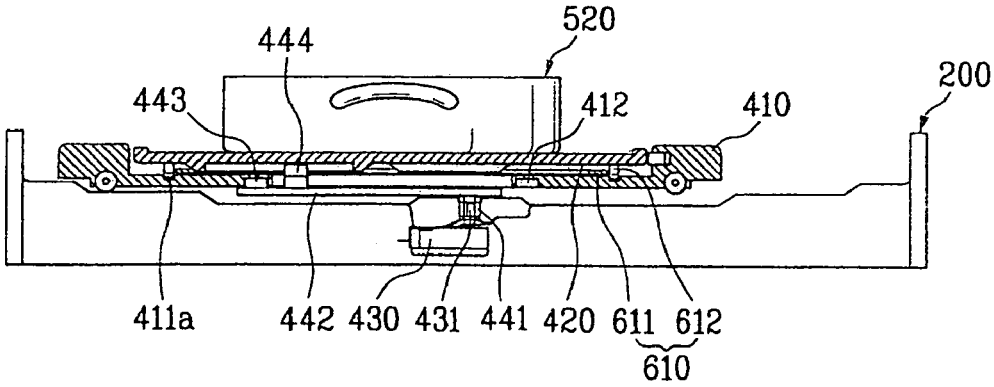
Figure 24:
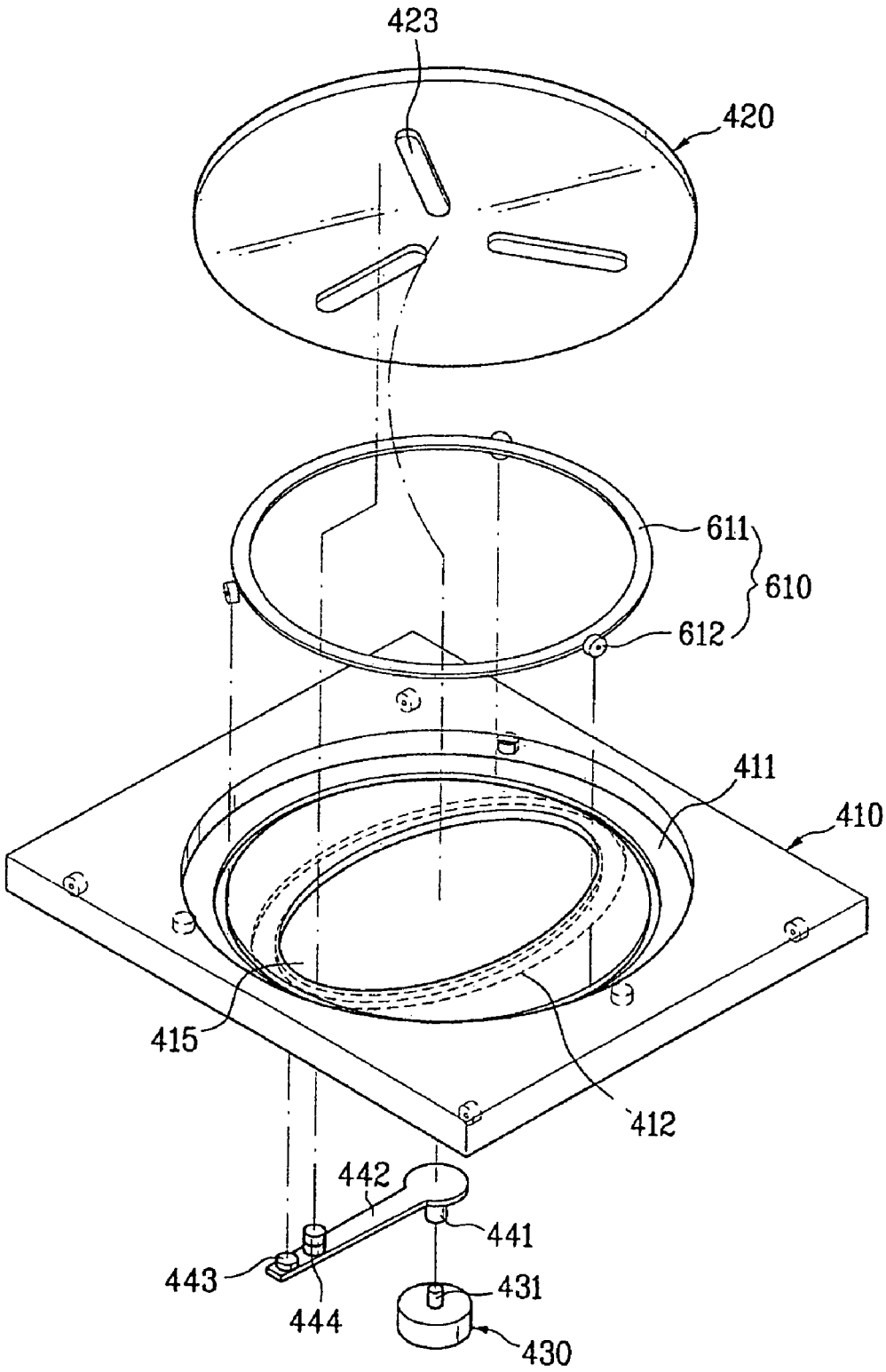
Figure 29:
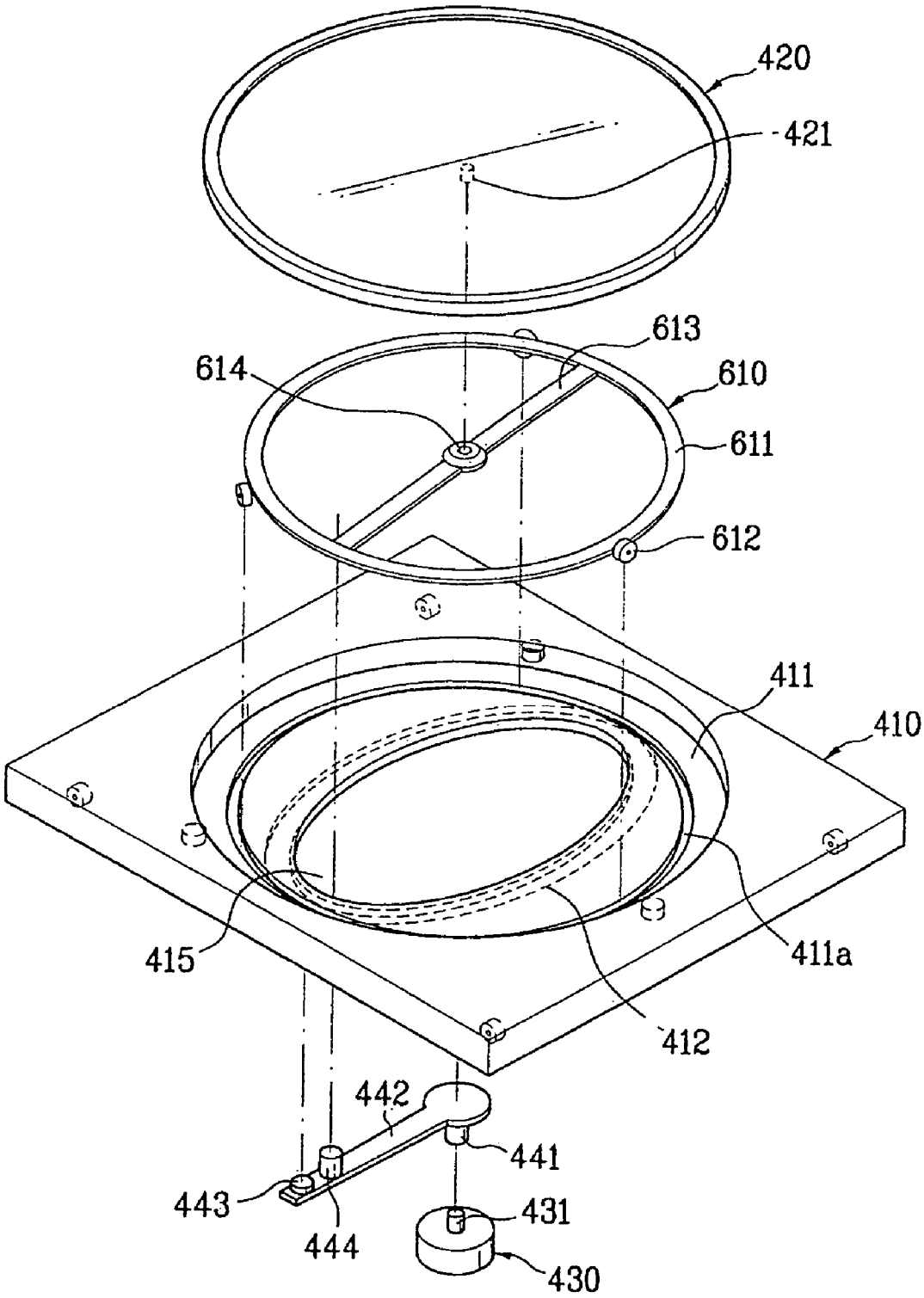
Figure 34:
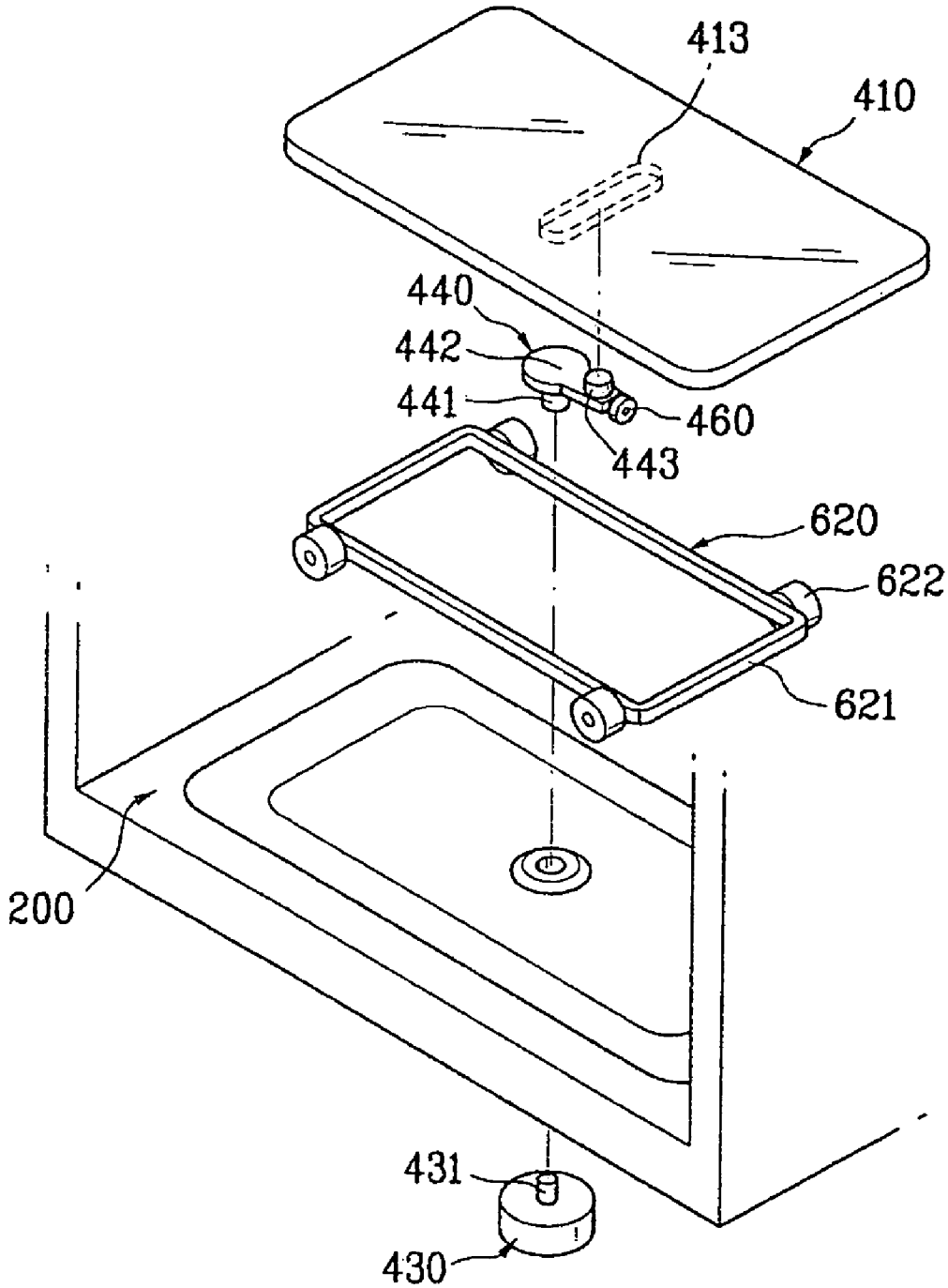
Figure 35A:
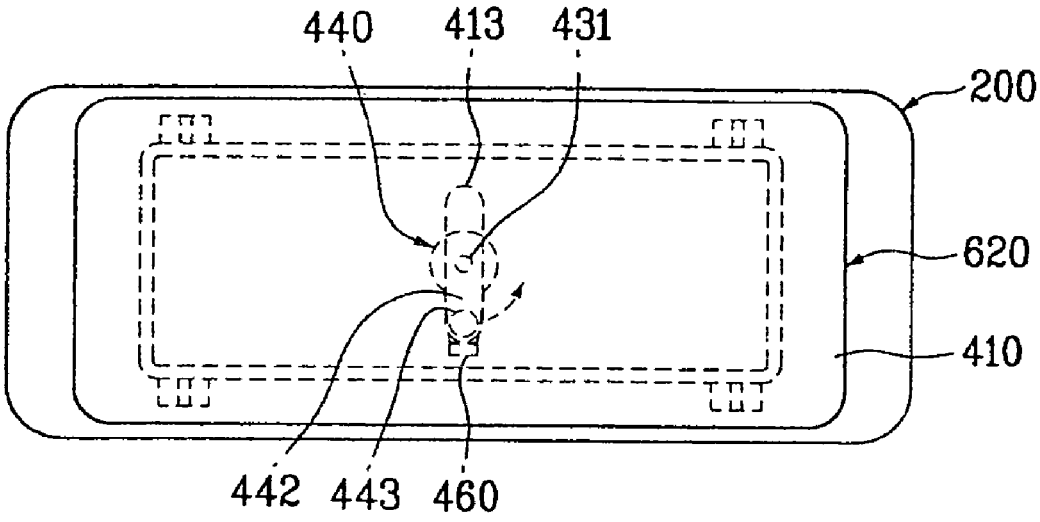
Figure 35B:
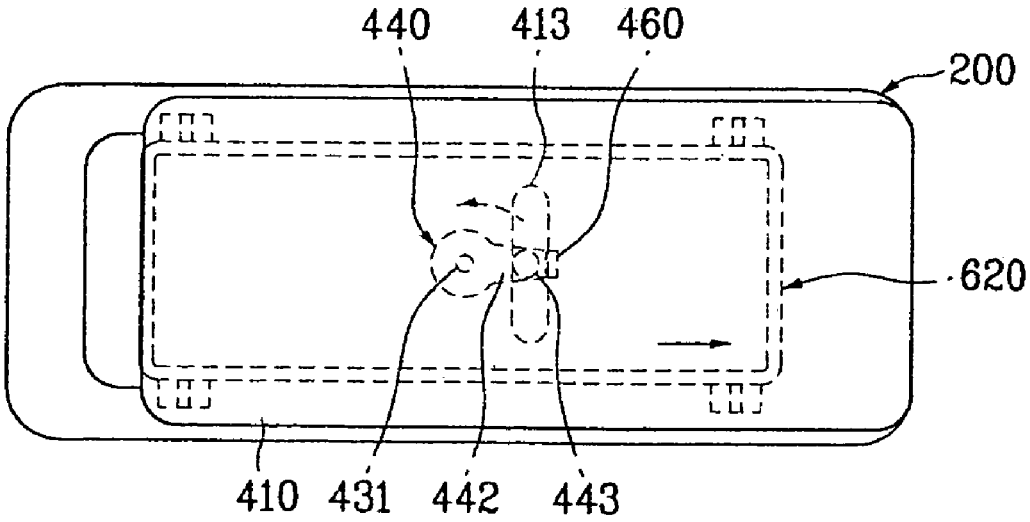
Figure 35C:
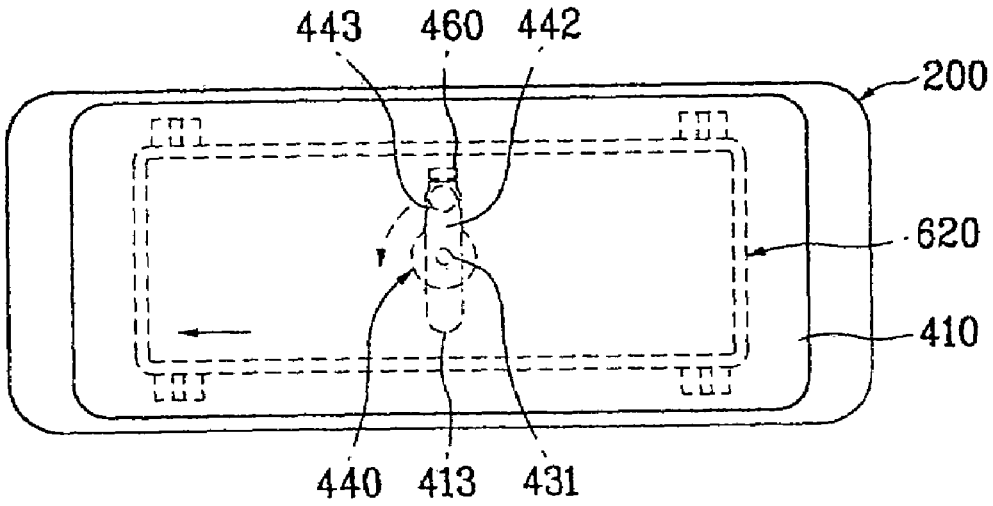
Figure 36A:
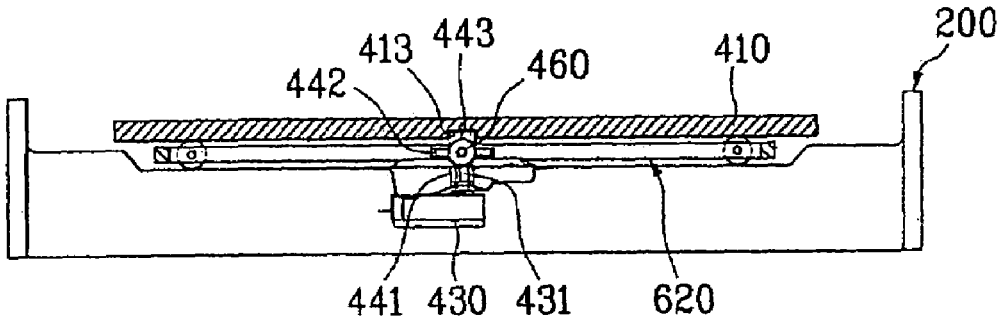
Figure 36B:
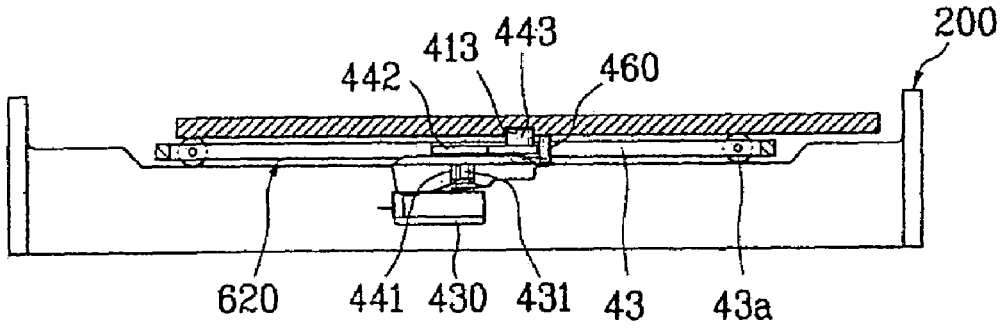
Figure 36C:
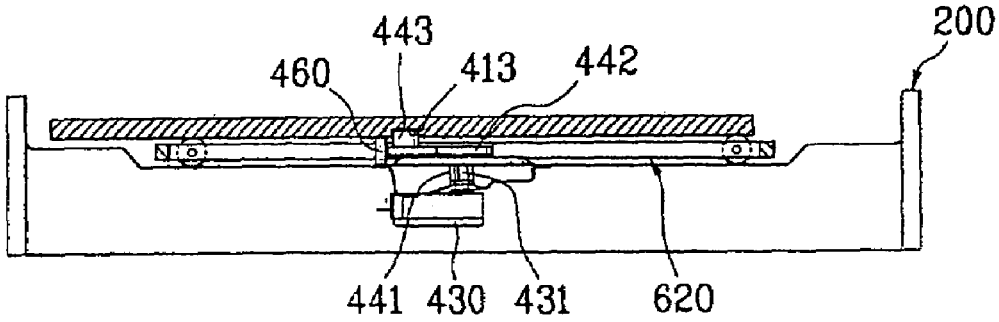

FIGS. 3A~6C illustrate diagrams showing an operation process of the tray assembly in FIG. 2 respectively, wherein, FIGS. 3A~3C, and 4A~4C illustrate plans and sections showing an operation process of the tray assembly in FIG. 2 in a sequence when a long container is placed on the tray assembly respectively, and FIGS. 5A~5C, and 6A~6C illustrate plans and sections showing an operation process of the tray assembly in FIG. 2 in a sequence when a circular container is placed on the tray assembly respectively;

FIG. 7 illustrates a graph showing moving distances and speed changes versus time of a first, and a second trays when the tray assembly in FIG. 2 is in operation;

FIG. 8 illustrates a plan view of a variation of the tray assembly in accordance with a first preferred embodiment of the present invention;

FIG. 9 illustrates a graph showing moving distances and speed changes versus time of a first, and a second trays when the tray assembly in FIG. 8 is in operation;

FIG. 10 illustrates a plan view of other variation of the tray assembly in accordance with a first preferred embodiment of the present invention;

FIG. 11 illustrates a graph showing moving distances and speed changes versus time of a first, and a second trays when the tray assembly in FIG. 10 is in operation;

FIG. 12 illustrates a plan view of another variation of the tray assembly in accordance with a first preferred embodiment of the present invention;

FIG. 13 illustrates a graph showing moving distances and speed changes versus time of a first, and a second trays when the tray assembly in FIG. 12 is in operation;

FIG. 14 illustrates a disassembled perspective view of a tray assembly in accordance with a second preferred embodiment of the present invention;

FIGS. 15A~18C illustrate diagrams showing an operation process of the tray assembly in FIG. 14 respectively, wherein, FIGS. 15A~15C, and 16A~16C illustrate plans and sections showing an operation process of the tray assembly in FIG. 14 in a sequence when a long container is placed on the tray assembly respectively, and FIGS. 17A~17C, and 18A~18C illustrate plans and sections showing an operation process of the tray assembly in FIG. 14 in a sequence when a circular container is placed on the tray assembly respectively;

FIG. 19 illustrates a disassembled perspective view of a tray assembly in accordance with a third preferred embodiment of the present invention;

FIGS. 20A~23C illustrate diagrams showing an operation process of the tray assembly in FIG. 19 respectively, wherein, FIGS. 20A~20C, and 21A~21C illustrate plans and sections showing an operation process of the tray assembly in FIG. 19 in a sequence when a long container is placed on the tray assembly respectively, and FIGS. 22A~22C, and 23A~23C illustrate plans and sections showing an operation process of the tray assembly in FIG. 19 in a sequence when a circular container is placed on the tray assembly respectively;

FIG. 24 illustrates a disassembled perspective view of a tray assembly in accordance with a fourth preferred embodiment of the present invention;

FIGS. 25A~28C illustrate diagrams showing an operation process of the tray assembly in FIG. 24 respectively, wherein, FIGS. 25A~25C, and 26A~26C illustrate plans and sections showing an operation process of the tray assembly in FIG. 24 in a sequence when a long container is placed on the tray assembly respectively, and FIGS. 27A~27C, and 28A~28C illustrate plans and sections showing an operation process of the tray assembly in FIG. 24 in a sequence when a circular container is placed on the tray assembly respectively;

FIG. 29 illustrates a disassembled perspective view of a tray assembly in accordance with a fifth preferred embodiment of the present invention;

FIGS. 30A~33C illustrate diagrams showing an operation process of the tray assembly in FIG. 29 respectively, wherein, FIGS. 30A~30C, and 31A~31C illustrate plans and sections showing an operation process of the tray assembly in FIG. 29 in a sequence when a long container is placed on the tray assembly respectively, and FIGS. 32A~32C, and 33A~33C illustrate plans and sections showing an operation process of the tray assembly in FIG. 29 in a sequence when a circular container is placed on the tray assembly respectively;

FIG. 34 illustrates a disassembled perspective view of a tray assembly in accordance with a sixth preferred embodiment of the present invention;

FIGS. 35A~35C illustrate plans showing an operation process of the tray assembly in FIG. 34 in a sequence, and FIGS. 36A~36C illustrate sections showing an operation process of the tray assembly in FIG. 29.

DETAILED DESCRIPTION OF THE PREFERRED EMBODIMENT

Reference will now be made in detail to the preferred embodiments of the present invention, examples of which are illustrated in the accompanying drawings. In describing the embodiments, identical parts will be given the same names and reference symbols, and repetitive description of which will be omitted.

The microwave oven of the present invention includes a case having a door thereon, a cooking chamber in the case, and a tray assembly in the cooking chamber. The cooking chamber is long in laterally, and opened/closed with the door. A microwave from a magnetron in an outfit chamber in the case is directed to the cooking chamber.

In the meantime, for enabling uniform heating of food in the cooking chamber with the microwave, the tray assembly linearly reciprocates, or rotates the food. The microwave oven of the present invention can be realized in a variety of embodiments and variations of the embodiments according to configuration of the tray assembly. Therefore, the tray assembly of the present invention will be described with reference to the attached drawings. FIG. 2 illustrates a disassembled perspective view of a tray assembly in accordance with a first preferred embodiment of the present invention.

Referring to FIG. 2, the tray assembly includes a first tray 410 in the cooking chamber 200, a second tray 420 rotatably mounted on the first tray 410, and a link 440 coupled to the first tray 410, the second tray 420, and a motor 430.

The motor 430, provided to a floor of the cooking chamber 200, is coupled to the link 440. The link 440, coupled to the motor 430 and the first tray 410, makes the first tray 410 to reciprocate within the cooking chamber 200, linearly. Moreover, the link 440, coupled to the motor 430 and the second tray 420, rotates the second tray 420 with respect to the first tray 410.

Referring to FIG. 2, the link 440 includes, for an example, a boss 441, a first bushing 443, and a second bushing 444. The boss 441 is fixed to a shaft 431 of the motor 430. The first bushing 443 and the second bushing 444 are provided at positions eccentric from an axis of the boss 441. For this, an arm 442 is extended from the boss 441 in a horizontal direction, and the first bushing 443 and the second bushing 444 are fitted at positions on the arm 442 eccentric from the axis of the boss 441.

In the link 440, the first bushing 443 is engaged with the first tray 410, and the second bushing 444 is engaged with the first tray 420. Accordingly, as shown in FIG. 2, it is preferable that the second bushing 444 is arranged between the axis of the boss 441, and the first bushing 443. It is more preferable that the second bushing 444 is arranged to pass through the first tray 410. Then, even if the link 440 has very simple structure, the link 440 can make the first bushing 443, and the second bushing 440 to engage with the first tray 410 and the second tray 420.

Portions of the link 440, more specifically the first bushing 443, and the second bushing 444 are slidably engaged with the first tray 410 and the second tray 420, respectively. For this, at least one, preferably both of the first bushing 443 and the second bushing 444 are rotatable with respect to the arm 442. However, the first bushing 443 and the second bushing 444 may be formed as one unit with the arm 442.

In the meantime, the first tray 410 is placed on a floor of the cooking chamber 200, and substantially rectangular with a long side in a lateral direction. The first tray 410 is engaged with a portion of the link 440, more specifically, the first bushing 443, and for linear reciprocation in a lateral direction within the cooking chamber 200 when the motor 430 is in operation.

The second tray 420 is mounted on the first tray 410. Therefore, it is preferable that a receiving portion 411 is provided in an upper surface of the first tray 410 for receiving the second tray 420 therein. For example, the receiving portion 411 may be a recess in a central portion of the upper portion of the first tray 410.

It is preferable that the receiving portion 411 has a depth greater than a thickness of the second tray 420. Then, when the second tray 420 is placed in the receiving portion 411, an upper surface of the first tray 410 is lower than an upper surface of the second tray 420. Accordingly, when a container longer than a diameter of the second tray 420 is placed on the first tray 410, the container makes no interference with the first tray 410 when the second tray 420 rotates.

It is preferable that the first tray 410 has an opening 415 for pass of a portion of the link 440 engaged with the second tray 420, i.e., the second bushing 444. As shown in FIG. 2, it is preferable that the opening 415 is formed to pass a portion of a floor of the receiving portion.

In the meantime, thus, the first tray 410 is slidably engaged with the first bushing 443 on the link 440. For this, the first tray 410 has a first receiving member provided to an underside surface of the first tray 410. In the first embodiment illustrated in FIG. 2, the first receiving member is a guide groove 412 in the underside surface of the first tray 410. The guide groove 412 has a depth, and is elliptical when seen from a surface the guide groove 412 is engaged with the first bushing 443 on the link 440.

However, in the first embodiment, the first receiving member is not limited to the guide groove 412. For example, the first receiving member may be a first ridge projected from the underside of the first tray 410. In this case, an inside wall of the first ridge engaged with the first bushing 443 has a shape the same with the guide groove 412.

The first receiving member, for an example, the guide groove 412, is provided along a circumference of the opening 415 in the underside surface of the first tray 410. In a case, the first tray 410 is a long rectangular plate, it is preferable that a major axis of the elliptical guide groove 412 is arranged in a width direction of the first tray 410, and a minor axis of the elliptical guide groove 412 is arranged in a lateral direction of the first tray 410.

An inside wall of the guide groove 412 in the first tray 410 is engaged with the first bushing 443. It is preferable that a distance from the rotation axis of the link 440 to a portion of the link 440 engaged with the first receiving member is equal to, or longer than a distance from the rotation axis of the link 440 to the surface of the first receiving member a portion of the link 440 is engaged therewith. In other words, it is preferable that a distance from the axis of the boss 441 to the bushing 443 is equal to or longer than a distance from the axis of the boss 441 to the inside wall of the guide groove 412.

If the link 440 and the first receiving member has above relation, when the link 440 rotates in a state the first bushing 443 is engaged with the inside wall of the guide groove 412, the first busing 443 slides along the inside wall of the guide groove 412, and, at the same time with this, pushes the inside wall of the guide groove 412 outward. According to this, the first tray 410 moves a distance as much as the first bushing 443 pushes the guide groove 412 outward.

In the meantime, the inside wall of the guide groove is elliptical. Therefore, during the link 440 rotates, at a time the first bushing 443 is positioned in a direction of the minor axis of the ellipse, the first tray 410 rotates more. Opposite to this, at a time the first bushing 443 is positioned in a direction of the major axis of the ellipse, the first tray 410 is stationary.

In order for the first tray 410 to make linear reciprocating movement within the cooking chamber, it is preferable that a distance from the axis of the boss 441 to the first busing 443 is equal to, or shorter than a distance from the inside wall of the guide groove 412 in a direction of the major axis of the ellipse to the axis of the boss 441.

Then, the first bushing 443 is positioned in the direction of the major axis of the ellipse during the link 440 rotates, the first bushing 443 does not push the inside wall of the guide groove 412 outwardly, According to this, the first tray 410 makes linear reciprocating movement along the minor axis of the ellipse.

In the meantime, if the cooling chamber is long in a lateral direction, it is preferable that the first tray 410 makes linear reciprocating movement along a lateral direction of the cooking chamber. Therefore, in this case, it is preferable that the major axis of the elliptical guide groove 412 is arranged along a front/rear direction of the cooking chamber 200, and the minor axis of the elliptical guide groove 412 is arranged along the lateral direction of the cooking chamber 200.

In the meantime, the second tray 420 is circular, and rotatably mounted on the first tray 410. In this instance, it is preferable that the second tray 420 is inserted in the receiving portion 411, and rotates with respect to the first tray 410 within the receiving portion 411.

As described before, the second tray 420 is engaged with the second bushing 444 on the link 440. For this, the second tray 420 has at least one second receiving member on the underside surface of the second tray 420.

In the present invention, the second receiving member may be a slot 422 or a second ridge 423 provided from a rotation axis of the second tray 420 along a radial direction thereof. As shown in FIG. 2, if the second receiving member is the slot 422, the second bushing 444 is inserted in the slot 442, and slidably engaged with the inside wall of the slot 422. On the other hand, as shown in FIG. 24, if the second receiving member is the second ridge 423, the second bushing 444 is slidably engaged with one side surface of the second ridge 423.

It is preferable that the second receiving member has a length the same with, or longer than a half of a linear reciprocating distance of the first tray 410. This structure enables to prevent the second bushing 444 from breaking away from the second member when the second bushing 444 slides along the second receiving member.

In the meantime, when the microwave oven is put into operation, the first tray 410 reciprocates with respect to the cooking chamber 200, and the second tray 420 rotates with respect to the first tray 410. Therefore, it is preferable that a structure is provided, which enables smooth movement of the first, and second trays 410 and 420, which will be described.

Referring to FIG. 2, the first tray 410 is provided with first rollers 451. A plurality of the first rollers 451 are fitted along a periphery of the underside surface of the first tray 410, so that the first rollers 451, when the first tray 410 moves, make contact to, and roll on the floor of the cooking chamber 200, and guide the linear reciprocating movement of the first tray 410, smoothly.

The first tray 410 is also provided with second rollers 452. At least two second rollers 452 are fitted to the upper surface of the first tray 410. More preferably, three second rollers 452 are fitted to the floor surface of the receiving portion 411 at regular intervals. When the second tray 420 rotates with respect to the first tray 410, the second rollers 452 are in contact with, and roll on the underside of the second tray 420, and guide the rotation of the second tray 420, smoothly.

In the meantime, the second rollers 452 may be fitted, not to the upper surface of the first tray 410, but to the underside surface of the second tray 420. In this case, the second rollers 452 are in contact with, and roll on the floor of the receiving portion 411, and guide the second tray 420, smoothly.

Moreover, in a case the receiving portion 411 is provided to the upper surface of the first tray 410, third rollers 453 may further be provided to the first tray 410. At least two, preferably three third rollers 453 are arranged in the inside wall of the receiving portion 411 at regular intervals. The third rollers 453 provided thus are in contact with, and roll on the circumference of the second tray 420, and guide the second tray 420, smoothly.

The operation of the microwave oven in accordance with a first preferred embodiment of the present invention will be described, with reference to FIGS. 3A~7.

A case when a first long container 510 is placed in the microwave oven will be described. The first long container 510 has a length greater than the second tray 420, and is placed in a length direction of the first tray 410, i.e. the lateral direction of the cooking chamber 200.

Upon putting the microwave oven into operation, the microwave is directed from the magnetron to the cooking chamber 200, and the motor 430 comes into operation, to rotate the link 440. Then, the first bushing 443, engaged with the guide groove 412, slides on, and pushes the inside wall of the guide groove 412, to make the first tray 410 to reciprocate linearly, which will be described in more detail.

Figure 3A:
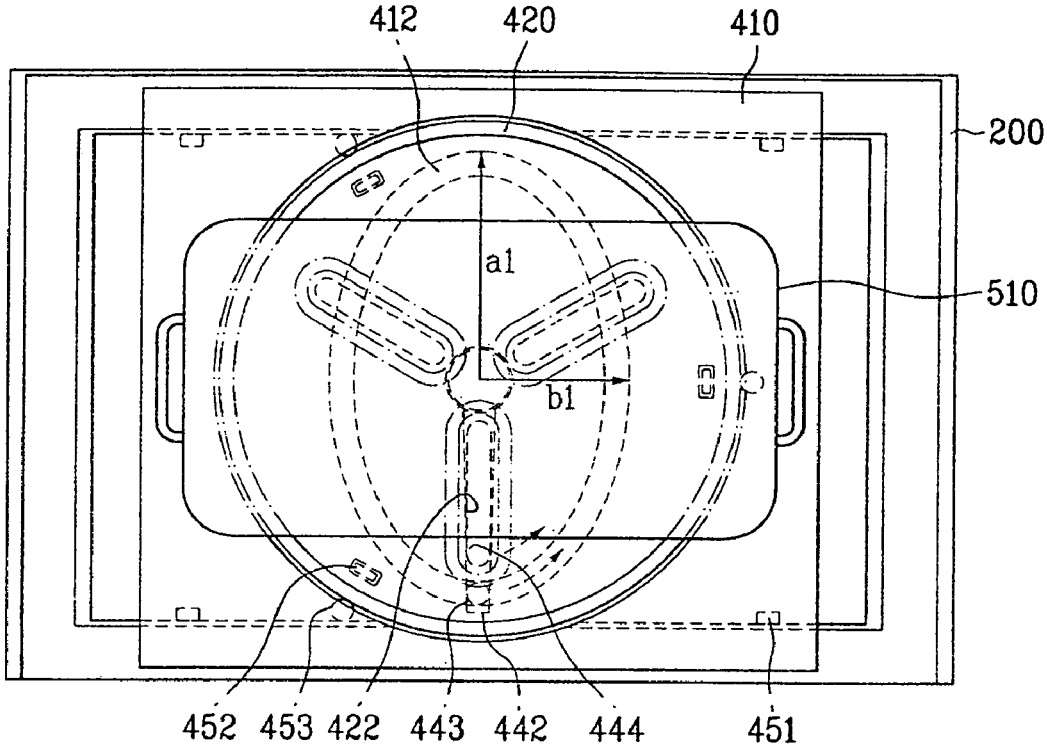
Figure 3B:
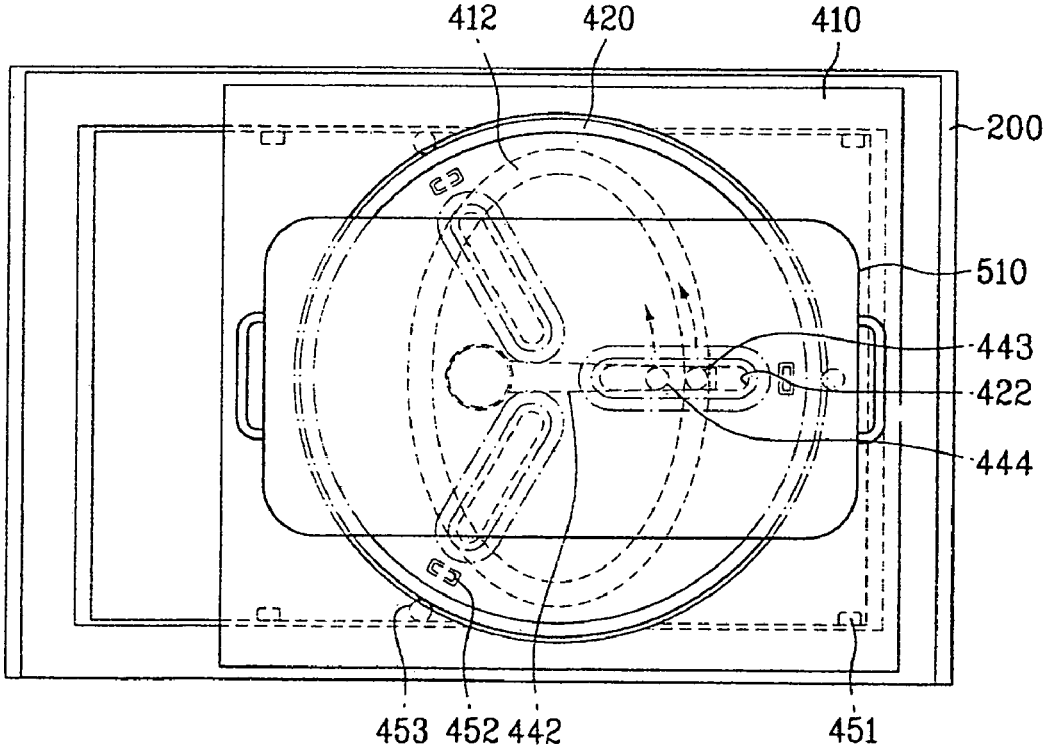
Figure 4A:
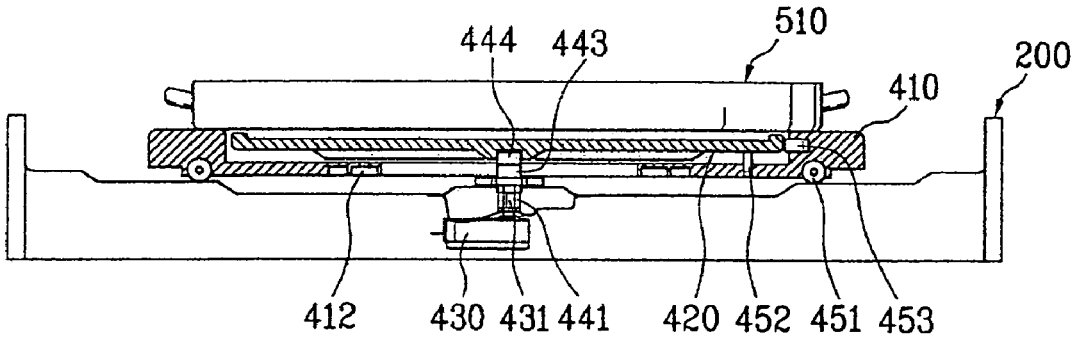

For an example, referring to FIGS. 3A and 4A, when the first bushing 443 rotates in an anti-clockwise direction from an initial state the first bushing 443 is positioned in a major axis direction of the guide groove 412, the first bushing 443 pushes the inside wall of the guide groove 412, to move the first tray 410 to the right side. According to this, as shown in FIGS. 3B and 4B, when the first bushing 443 is positioned in a minor axis direction of the guide groove 412, the first tray 410 moves to a right side as much as one half of a length obtained by subtracting a length $2b_1$ of the minor axis of the guide groove 412 from a length $2a_1$ of the major axis of the guide groove 412, i.e., $a_1-b_1$.

Figure 3C:
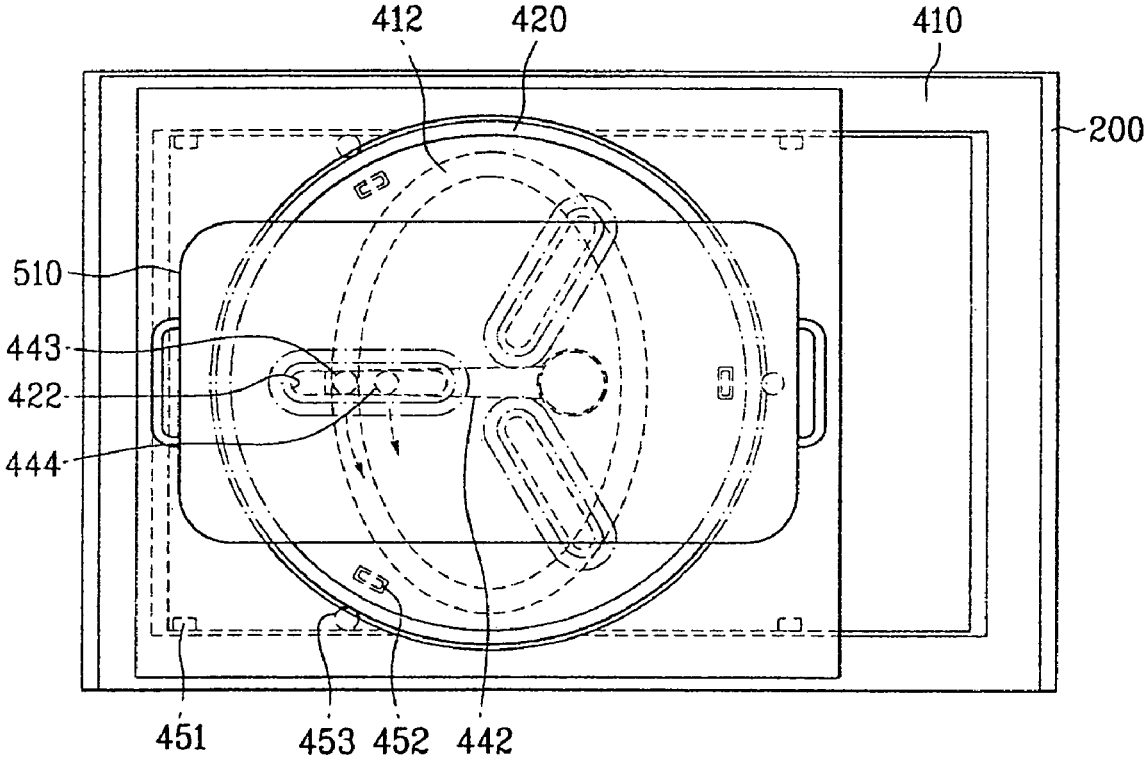
Figure 4B:
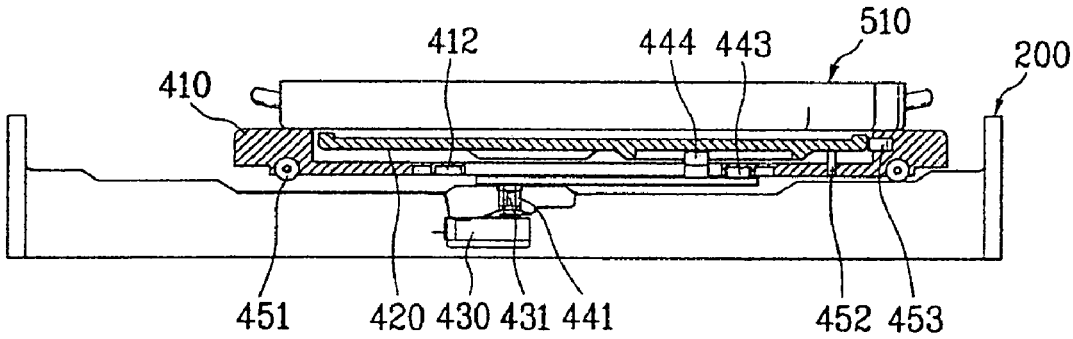
Figure 4C:
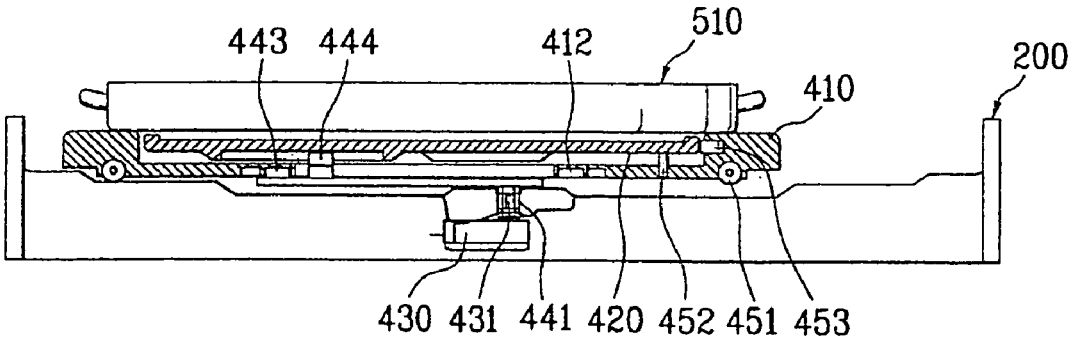

If the link 440 rotates further from a position shown in FIG. 3B or 4B such that the first bushing 443 comes to a position shown in FIG. 3C or 4C, the first tray 410 moves to a left side as much as a length obtained by subtracting a length $2b_1$ of the minor axis of the guide groove from a length $2a_1$ of the major axis of the guide groove 412, i.e., $2(a_1-b_1)$.

Thus, if the link 440 rotates as above, the first tray 410 reciprocates laterally as much as $2(a_1-b_1)$, substantially.

In the meantime, as described before, the depth of the receiving portion 411 is greater than a thickness of the second tray 420. Therefore, even if the first container 510 is placed on the first tray 410, the second tray 420 does not come into contact with the first container 510.

According to this, the first container 510 on the first tray 410 reciprocates together with the first tray, regardless of the movement of the second tray 420, to heat the food in the first container 510, uniformly.

Next, a case when a general circular container 520 is placed on the cooking chamber 200 will be described. The second container 520, placed on the second tray 420, has a diameter of a bottom thereof the same with, or smaller than the diameter of the second tray 420. Therefore, the second container 520 does not come into contact with the first tray 410.

If the microwave oven is put into operation in a state the second container 520 is placed inside of the cooling chamber 200, the microwave is directed to the cooking chamber 200, and the motor 430 rotates the link 440. Then, as described with reference to FIGS. 3A to 4C, the first tray 410 reciprocates in the cooking chamber 200, linearly. At the same time with this, the second bushing 444 rotates the second tray 420 with respect to the first tray 410, which will be described in more detail.

Figure 5A:
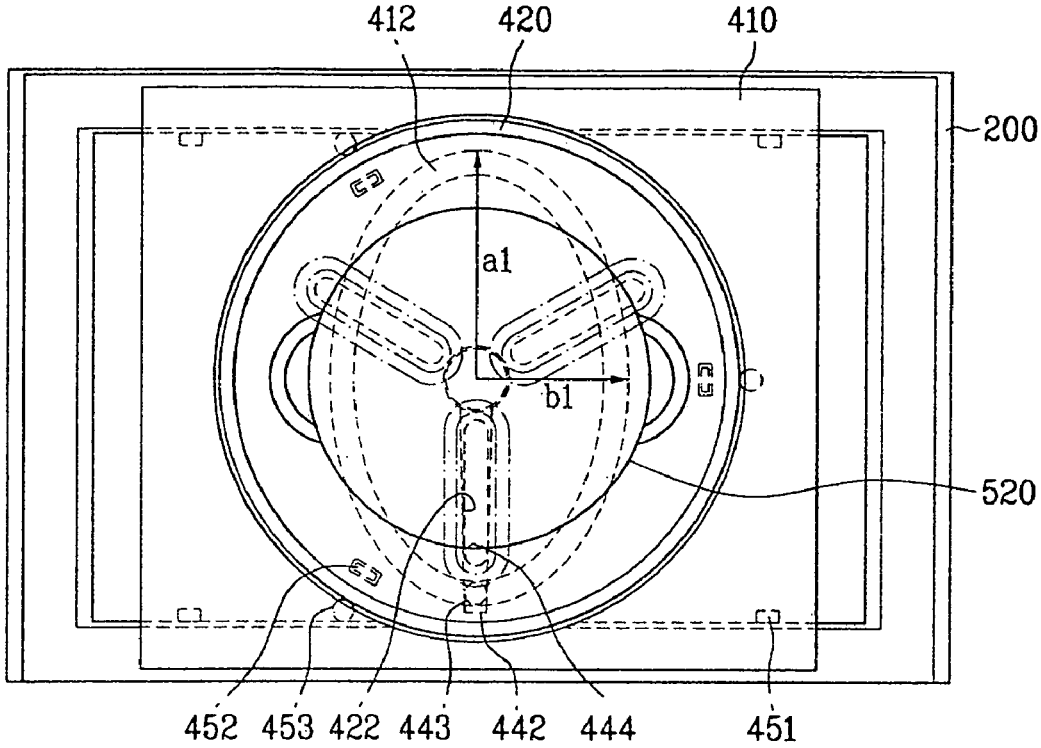
Figure 5B:
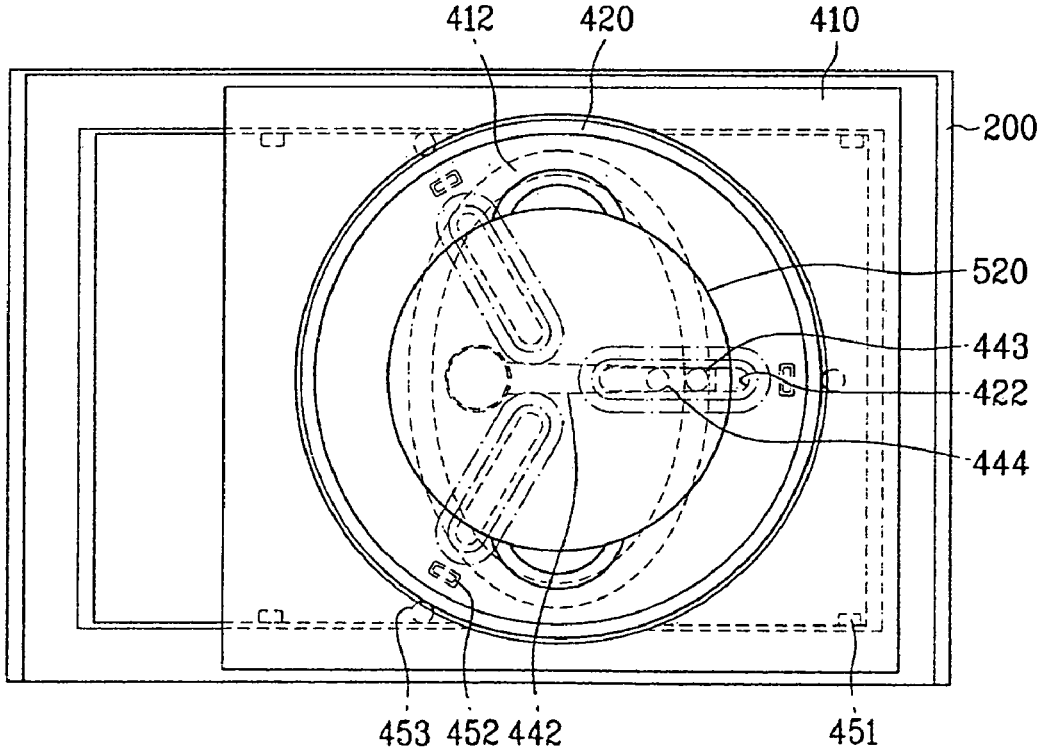
Figure 6A:
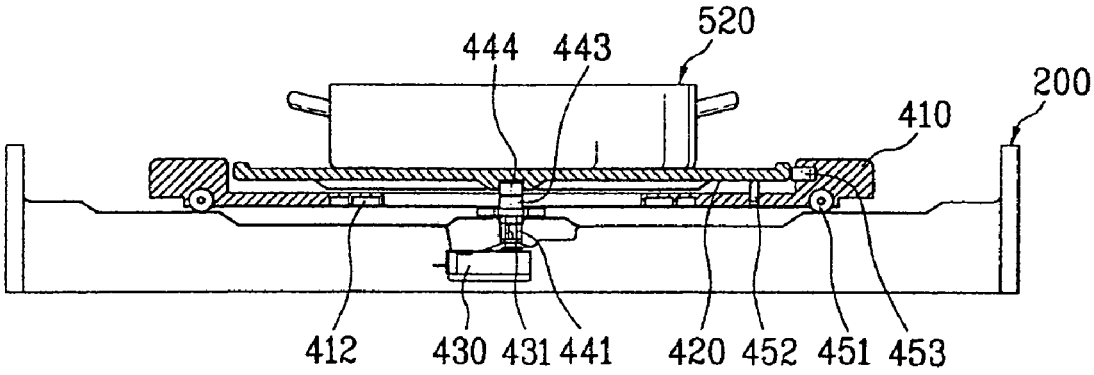
Figure 6B:
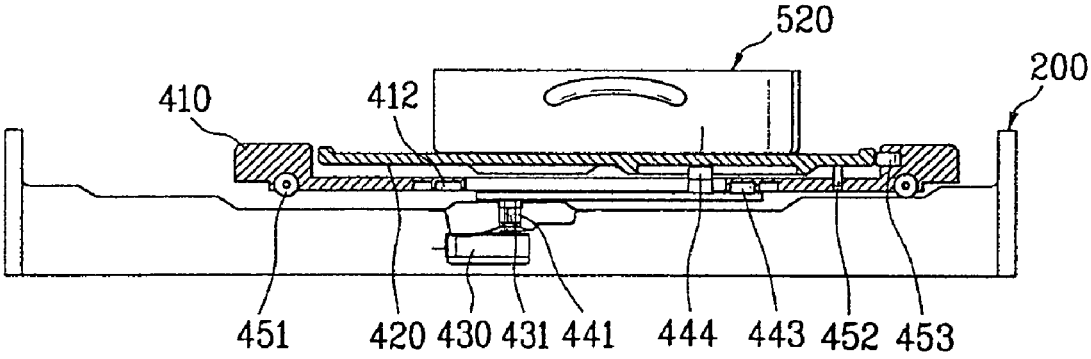

If the second bushing 444 rotates in an anti-clockwise direction from an initial state shown in FIG. 5A or 6A, the second bushing 444 pushes the second receiving portion, i.e., the slot 422 in a width direction. According to this, the link 440 rotates, to bring the second bushing 444 to a position shown in FIG. 5B or 6B, when the second tray 420 rotates approx. 90° with respect to the first tray 410.

In this instance, the first tray 410 moves to the right as much as $a_1-b_1$. Therefore, when the second tray 420 rotates with respect to the first tray 410, the second bushing 444 slides along a length direction of the second receiving portion, i.e., the slot 422, to move toward a center of the second tray 420.

Figure 5C:
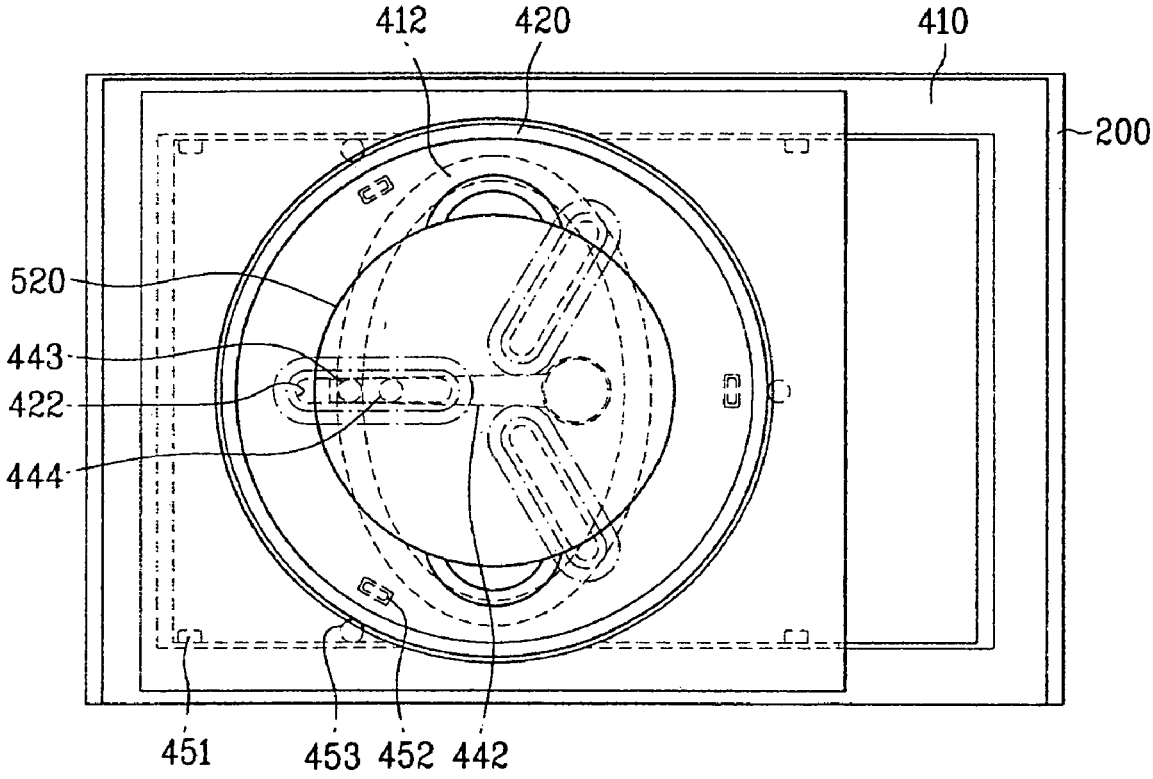
Figure 6C:
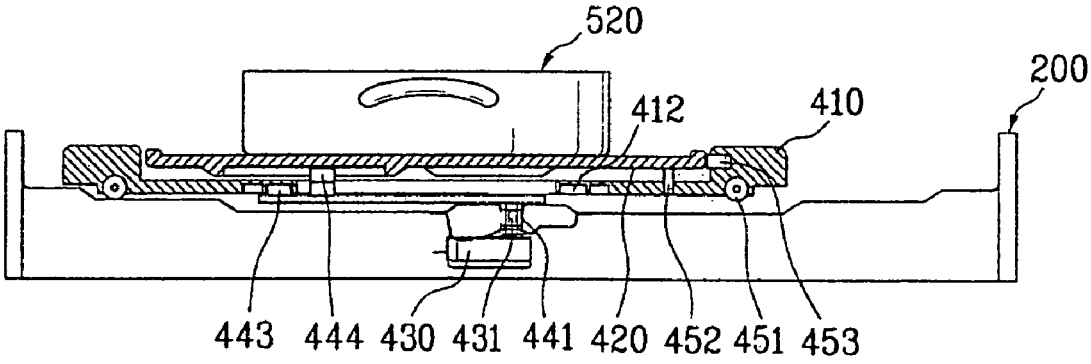

If the link 440 rotates further, to bring the second bushing 444 to a position shown in FIG. 5C or 6C, the second tray rotates approx. 270° from the initial position. During the second bushing 444 moves from the position shown in FIG. 5B or 6B to the position shown in FIG. 5C or 6C, the second bushing 444 moves to an outer side of the second tray 420 along a length direction of the slot 422, and then to a center side of the second tray 420, again.

Thus, once the microwave oven is put into operation, the first tray 410 reciprocates linearly within the cooking chamber 200, and the second tray 420 rotates with respect to the first tray 410. Accordingly, the food in the second container 520 is heated uniformly more than food on the related art tray that rotates simply. For reference, FIG. 7 illustrates a graph showing moving distances and speed changes of the first, and second trays 410 and 420 during the food in the second container 520 is heated.

In the meantime, the tray assembly in accordance with a first preferred embodiment of the present invention is not limited to above. That is, there can be many variations depending on a structure of the first receiving portion in the first tray 410, which will be described. FIG. 7 illustrates a graph showing moving distances and speed changes versus time of first, and second trays when the tray assembly in FIG. 2 is in operation.

Referring to FIG. 8, a surface of the first receiving portion, for an example, an inside wall of the guide groove 412, having the link 440 engaged therewith, includes to linear portions 412*a* parallel to each other, and two curved portions 412*b* each connected between ends of the two linear portions 412*a*.

Referring to FIG. 8, it is preferable that a distance between the curved portions 412*b* is greater than a distance between the linear portions 412*a*. It is also preferable that the linear portions 412*a* are arranged along one of a width direction of the first tray 410 or a front/rear direction of the cooking chamber 200.

This structure enables the first tray 410 to move in a lateral direction of the cooking chamber 200 when the first bushing 443 is in contact with, and slides on the linear portions 412*a*.

In the meantime, it is preferable that the curved portion 412*b* has a form of an arc or semicircle. If the curved portions 412*b* are semicircular, the first tray 410 does not move when the first bushing 443 is in contact with, and slides on the curved portions 412*b*.

Therefore, while the first tray 410 reciprocates in the lateral direction as much as a distance $2(a_2-b_2)$ substantially, the first tray 410 does not move during the first bushing 443 moves along the curved portions 412*b*. In this instance, the first tray 410 stops at a central portion of the cooking chamber 200. However, even during a time period the first tray stops 410, the second tray keeps rotating. In the first variation of the tray assembly in accordance with a first preferred embodiment of the present invention, moving distances and speeds of the first tray 410 and the second tray 420 are illustrated well in FIG. 9.

FIG. 10 illustrates a plan view of a second variation of the tray assembly in accordance with the first preferred embodiment of the present invention. As shown in FIG. 10, a surface of the first receiving portion, i.e., an inside wall of the guide groove 412 the link 440 is engaged therewith includes opposite curved portions 412*c*, and second curved portions 412*d* each connected between the ends of the first curved portions 412*c*. It is preferable that a curvature of the second curved portion 412*d* is different from a curvature of the first curved portion 412*c*.

In the second variation, a distance between the second curved portions 412*d* is greater than a distance between the first curved portions 412*c*. In this case, the first curved portions are arranged along one of a width direction of the first tray 410 or a front/rear direction of the cooking chamber 200.

In the meantime, at least any one of the first curved portion 412*c* and the second curved portion 412*d* may be an elliptical arc. If the second curved portions 412*d* are circular arc, the first tray 410 does not move during the first bushing 443 moves along the second curved portion 412*d*.

Above structure enables the first tray 410 to reciprocate substantially a distance of $2(a_3-b_3)$ within the cooking chamber 200 when the link 440 rotates. When the first tray 410 comes to substantially a central portion of the cooking chamber 200, the first tray 410 is stationary for a preset time period. Of course, in this time too, the second tray 420 keeps rotating with respect to the first tray 410. Moving distances, and speeds of the first tray 410, and the second tray are illustrated well in FIG. 11.

FIG. 12 illustrates a plan view of a third variation of the tray assembly in accordance with the first preferred embodiment of the present invention. As shown in FIG. 12, a surface of the first receiving portion, i.e., an inside wall of the guide groove 412 the link 440 is engaged therewith includes a diamond shape. It is preferable that each of corners of the diamond shape is rounded.

It is preferable that, of two diagonal lines of the diamond shape, a long diagonal line is arranged along one of directions of a width direction of the first tray 410 or a front/rear direction of the cooking chamber 200.

Above structure enables the first tray 410 to reciprocate substantially a distance of $2(a_4-b_4)$ within the cooking chamber 200 in a lateral direction. Moving distances, and speeds of the first tray 410, and the second tray 420 are illustrated well in FIG. 13.

The microwave oven having the tray assembly in accordance with a first preferred embodiment of the present invention enables to cook even a long food, or food in a long container easily, to use an inside space of the cooking chamber long in the lateral direction effectively, and uniform heating of the food, to improve a cooking efficiency.

In the meantime, there are a plurality of second rollers 452 and the third rollers 453 fitted to the floor surface and the inside wall of the receiving portion 411 respectively for smooth guide of the rotation of the second tray 420. However, since too many rollers are required to be fitted to different points of the first tray 410, not only fabrication is difficult, but also production cost rises due to the many number of components.

According to this, the present invention suggests a second embodiment that has an improved structure for solving the foregoing problem. The tray assembly in accordance with a second preferred embodiment of the present invention is illustrated in FIG. 14, which will be described in more detail.

Referring to FIG. 14, the tray assembly in accordance with a second preferred embodiment of the present invention includes a first tray 410, a second tray 420, and a roller parts 450 for supporting an underside and circumference to the second tray 420, and enabling the second tray 420 to rotate with respect to the first tray 410 smoothly. Since structures of the first tray 410, the second tray 420, and the link 440 are similar to ones described with reference to FIG. 2, only a structure of the roller part 450 will be described.

Referring to FIG. 14, the roller parts 450 are provided to an inside wall of the receiving portion 411 of the first tray 410. It is preferable that two, or preferably, three roller parts 450 are arranged at regular intervals along the inside wall of the receiving portion 411, for preventing sloping of the second tray 420.

The roller part 450 supports a circumferential surface and an underside surface of the second tray 420. Referring to FIG. 14, the roller part 450 includes an upper roller 456, and a lower roller 457. It preferable that the upper roller 456 and the lower roller 457 are individually rollable. The lower roller 457 is arranged below the upper roller 456, and has a diameter greater than the upper roller 456.

Above structure of the roller part 450 enables the upper roller 456 to come into contact with a circumference surface of the second tray 420, and an upper surface of the lower roller 457 to support an edge of the underside surface of the second tray 420, when the second tray 420 is mounted in the receiving portion 411 of the first tray 410. Since the roller parts 450 are arranged at regular intervals along an inside wall of the receiving portion 411, the second tray 420 does not slope.

In the meantime, FIGS. 15A to 18C illustrate an operation process of the tray assembly when a long first container 510 or a circular second container 520 is placed inside of the cooking chamber 200, which is similar to ones shown in FIGS. 3A~6C, and therefore, description of which will be omitted.

Thus, the roller parts 450, not only support the second tray 420 securely, but also guide rotation of the second tray, smoothly. The second preferred embodiment of the present invention having the roller part 450 also has a simpler structure and a less number of components compared to the first embodiment, enabling fast production at a lower cost.

In the meantime, FIG. 19 illustrates a tray assembly in accordance with a third preferred embodiment of the present invention. Referring to FIG. 19, the tray assembly includes a first tray 410, a second tray 420, a link 440, and a rotating supporter 610 for guiding rotation of the second tray 420. Structures of the first tray 410, a second tray 420, and the link 440 are similar to one of the first embodiment or the second embodiment, of which description will be omitted.

Referring to FIG. 19, the first tray 410 has no second roller 452 (see FIG. 2) for guiding rotation of the second tray 420. Instead, the rotating supporter 610 guides rotation of the second tray securely, which will be described in more detail.

Referring to FIG. 19, the rotating supporter 610 is provided between the first tray 410 and the second tray 420, in more detail, the floor surface of the receiving portion 411 and the underside surface of the second tray 420. The rotating supporter 610 rotates together with the second tray 420 when the motor is in operation, to guide smooth rotation of the second tray 420 with respect to the first tray 410.

The rotating supporter 610 includes a ring form of frame 611, and a plurality of rollers 612 rotatably fitted to the frame 611. The frame has the ring form for preventing interference with the link 440 engaged with the second tray 420.

Two or preferably three rollers 612 are arranged at regular intervals on a circumferential surface of the frame 611, and have a diameter preferably greater than a height of the frame 611. The rollers 612 are in contact both with, and roll on the floor surface of the receiving portion 411 and the underside surface of the second tray 420, to support and guide rotation of the second tray, smoothly.

A structure in which the rotating supporter 610, rotating freely when the motor 430 is in operation, supports the second tray 420 can reduce a friction compared to a structure in which the second rollers 452 fitted to the first tray 410 support the second tray 420. Therefore, once the rotating supporter 610 is provided, the second tray 420 can be rotated, more smoothly.

In the meantime, since the rotating supporter 610 is a separate body from the second tray 420 and the receiving portion 411, the rotating supporter 610, rotating freely, and may lean to any one side of the receiving portion 411, when the rotating supporter 610 is unable to guide the rotation smoothly, but interfere rotation of the second tray 420.

Accordingly, the tray assembly in accordance with a third preferred embodiment of the present invention further includes a track 411*a* for guiding a rolling path of the roller 612 so that the rotating supporter 610 can be rotated securely. As shown in FIG. 19, the track 411*a* is provided in the first tray 410, more specifically, in the floor surface of the receiving portion 411. However, though not shown, the track 411*a* may be provided in the underside surface of the second tray 420.

The rollers 612 of the rotating supporter 610 are inserted to the track 411*a* provided to at least one of the first tray 410 and the second tray 420, thus. Therefore, the rollers 612 roll along the track 411*a*, according to which the rotating supporter 610 rotates securely by the track 411*a*.

In the meantime, FIG. 19 illustrates the track 411*a* is an annular groove. However, the form of the track 411*a* is not limited to this. For an example, the track 411*a* may be an annular ridge. In this case, the rollers 612 roll guided by the inside wall of the ridge.

The operation of the tray assembly in accordance with a third preferred embodiment of the present invention is well illustrated in FIGS. 20A~23C, which is similar to the description made with reference to FIGS. 3A~6C, and detailed description of which will be omitted. However, during the tray assembly is in operation, the rotation of the second tray 420 is guided smoothly by the rotating supporter 610, and the rotation of the rotating supporter 610 is guided by the track 411*a*.

Thus, in the tray assembly in accordance with a third preferred embodiment of the present invention, the second tray 420 does not slope when the second tray 420 is placed in the receiving portion 411 because the rotating supporter 610 supports the second tray, securely. Moreover, since the rotating supporter 610 rotatably supports the second tray 420, the second tray 420 can rotate smoothly with respect to the first tray 410. If the track 411*a* is provided, the rotating supporter 610 can rotate, securely.

In the meantime, in the first to third embodiments, the slot 422 is as the second receiving member for engaged with the link 440. Thus, if the slot 422 is provided to the second tray 420, there is an inconvenience of inserting the second bushing 444 into the slot 422 exactly in inserting the second tray 420 into the receiving portion 411. According to this, the present invention further provides a fourth embodiment of an improved structure for solving such an inconvenience completely.

FIG. 24 illustrates a tray assembly in accordance with a fourth preferred embodiment of the present invention. As shown in FIG. 24, the fourth embodiment tray assembly is similar to the third embodiment tray assembly. However, in the third embodiment, though the second receiving member to the second tray 420 is the slot 422, in the fourth embodiment, the second receiving member is the second ridge 423. Therefore, the second receiving member of the second ridge 423 will be described.

Figure 25A:
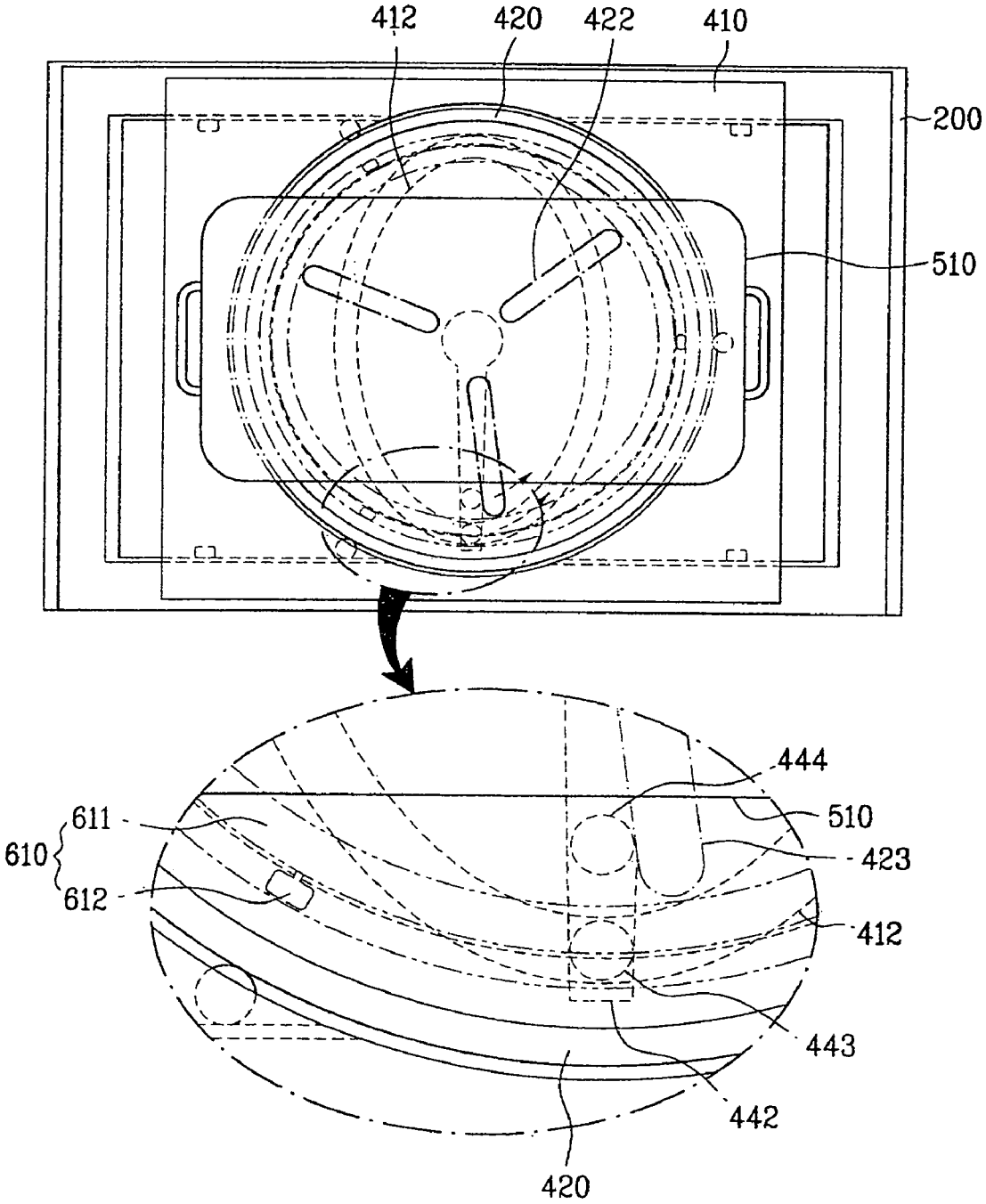
Figure 25B:
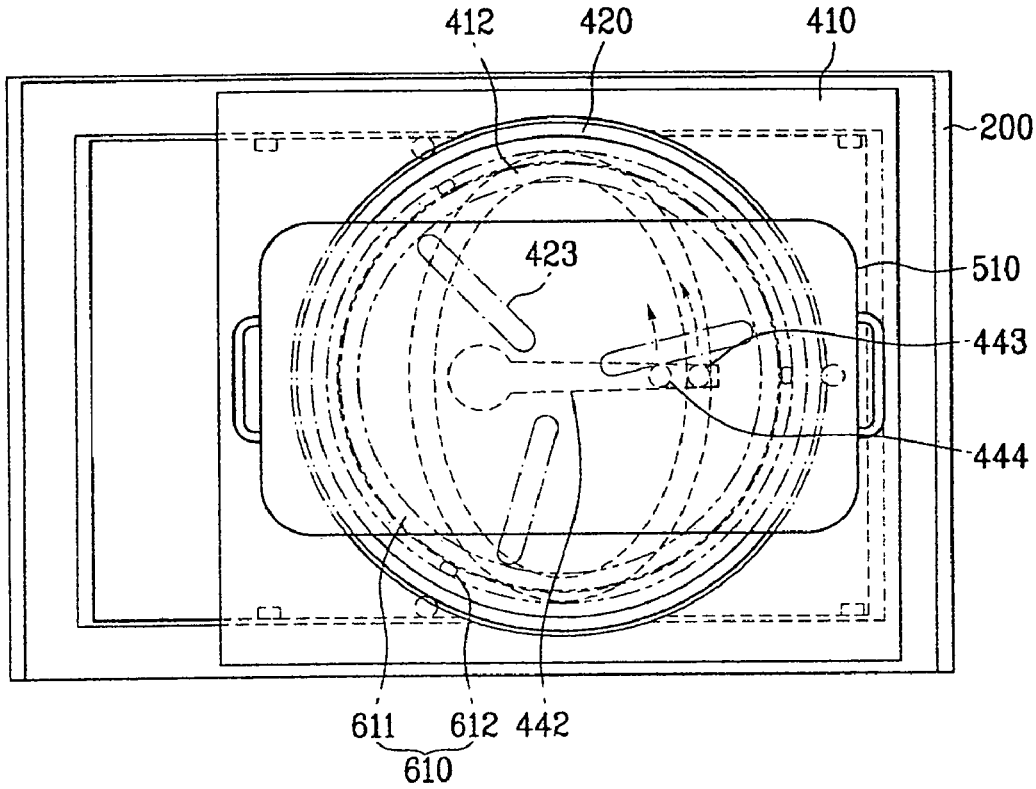
Figure 25C:
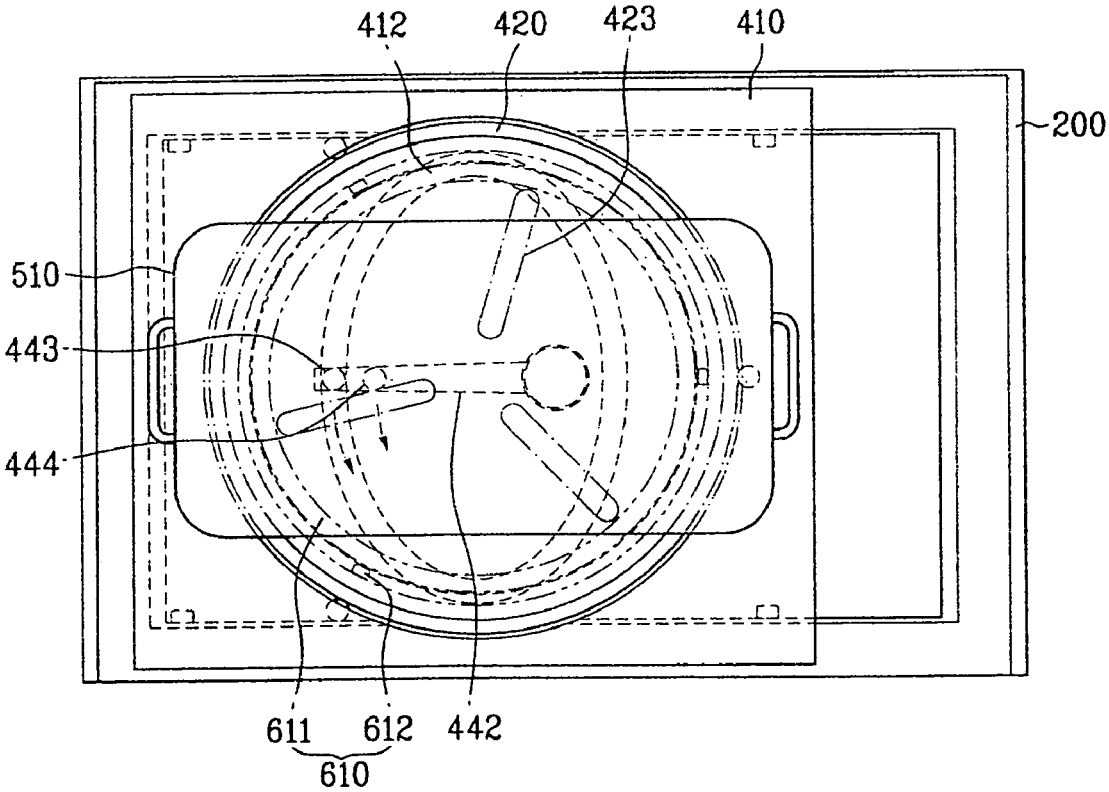
Figure 26A:
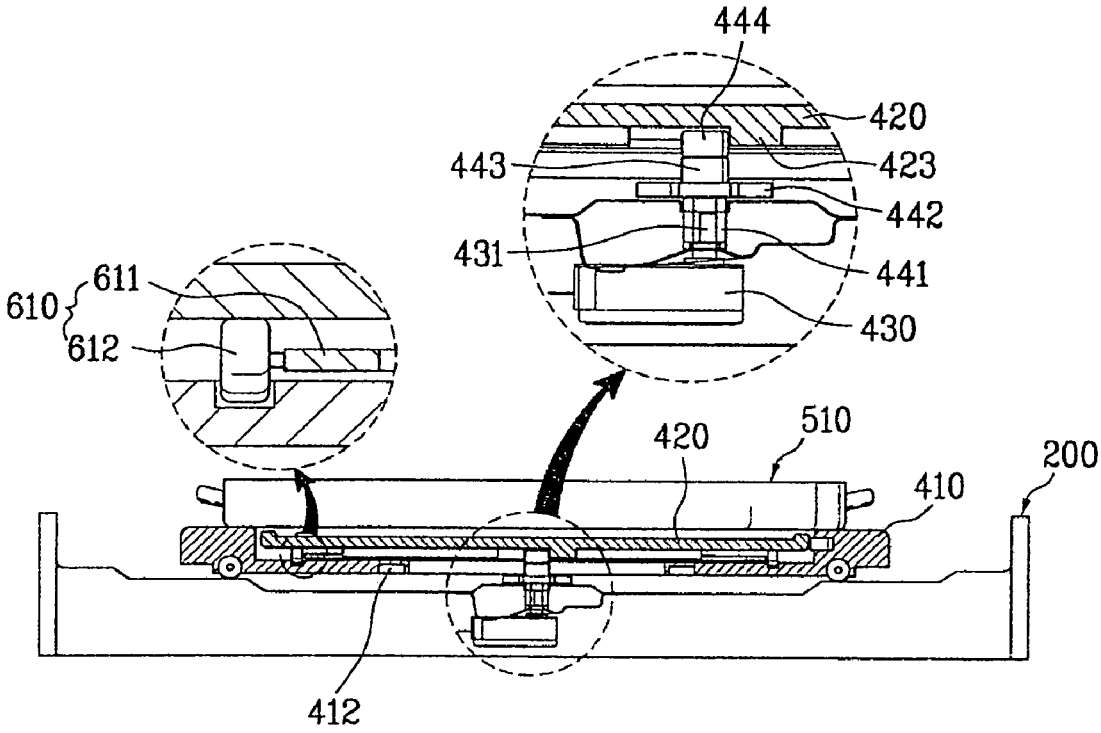
Figure 26B:
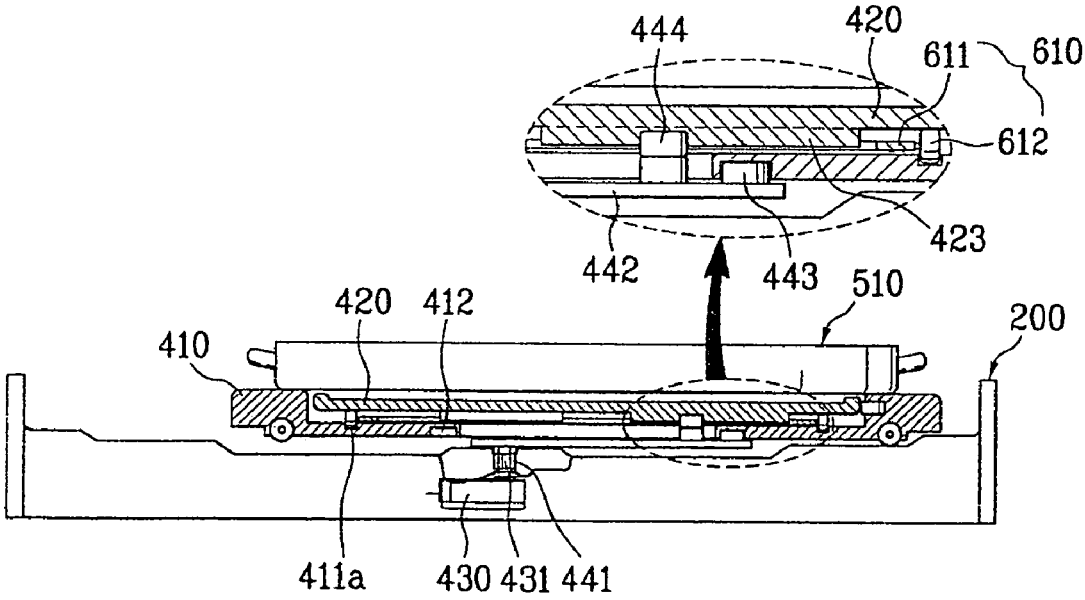
Figure 26C:
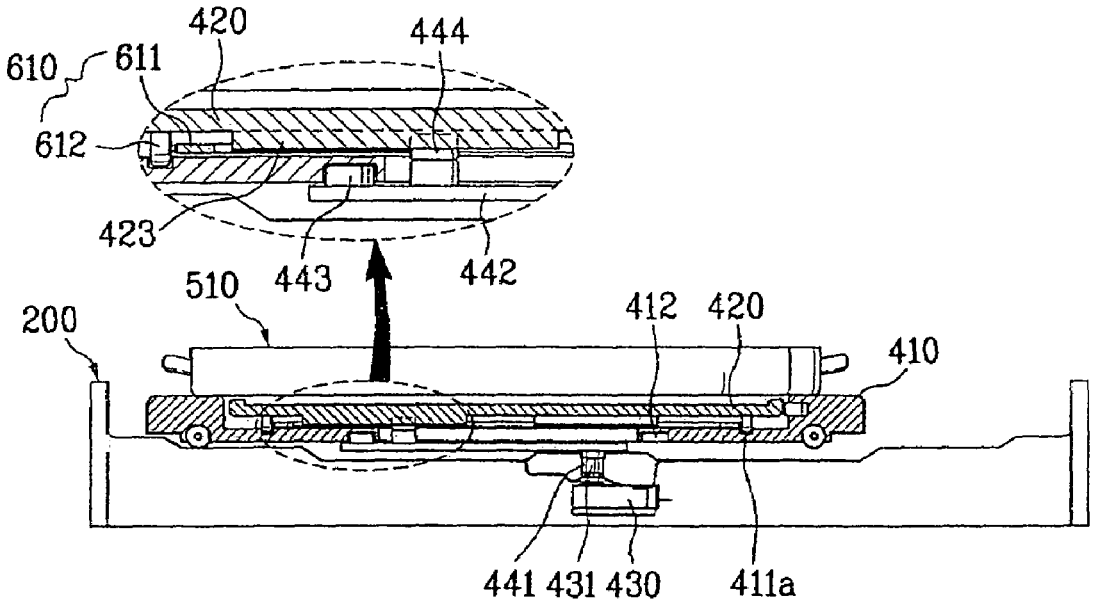
Figure 27A:
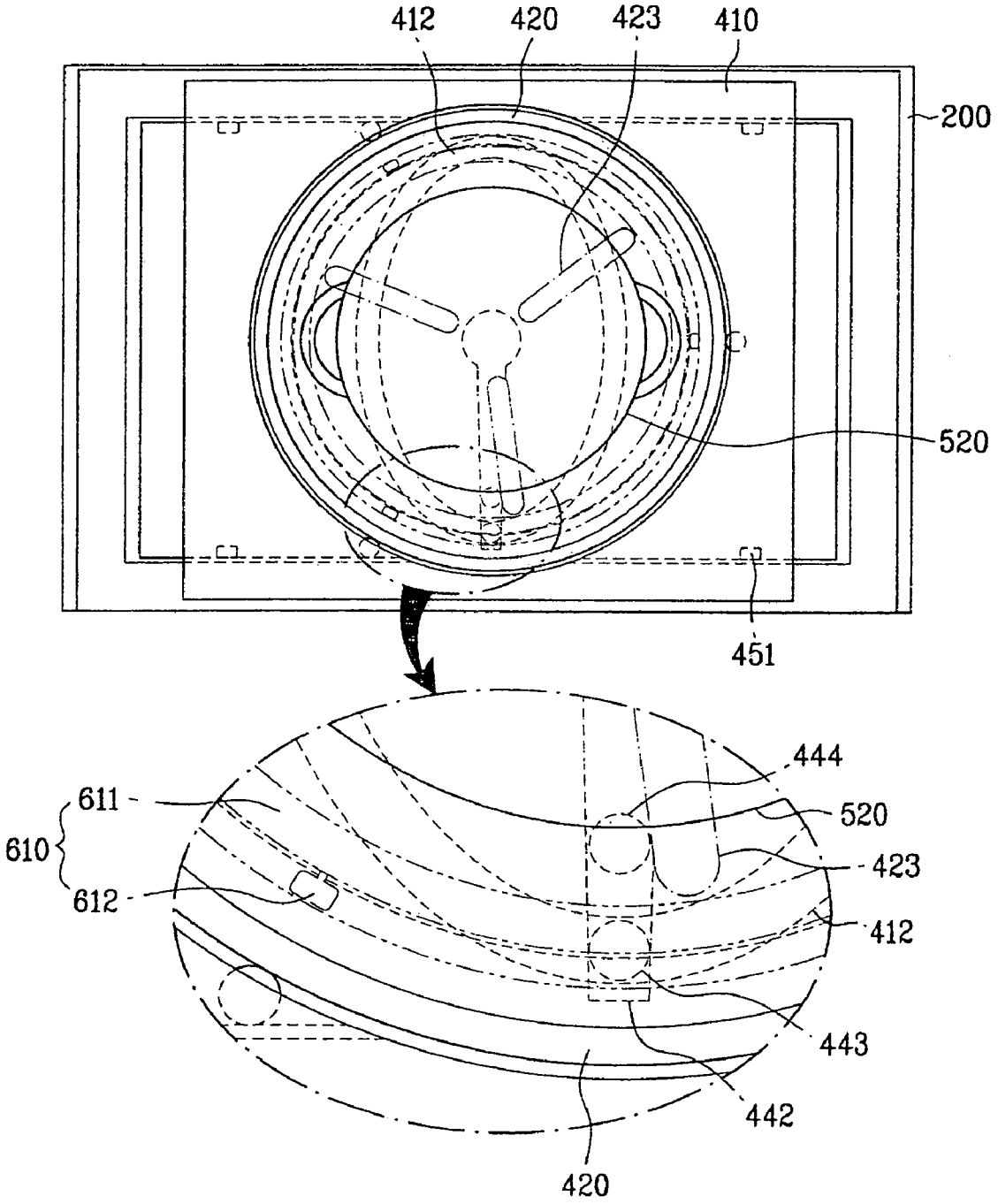
Figure 27B:
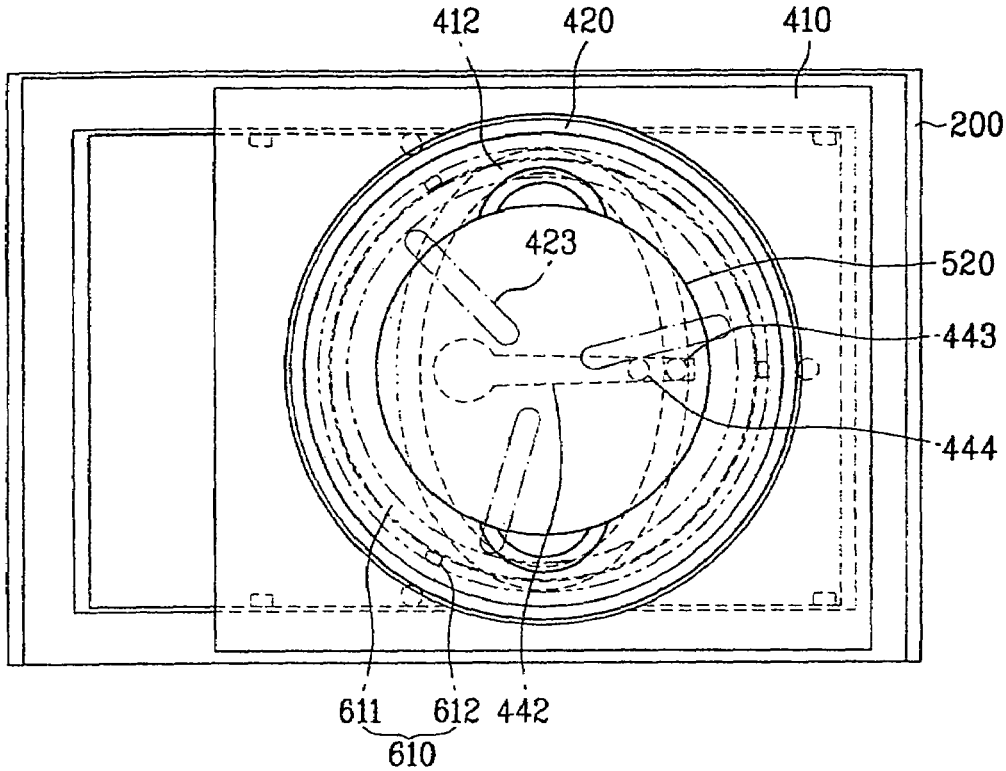
Figure 27C:
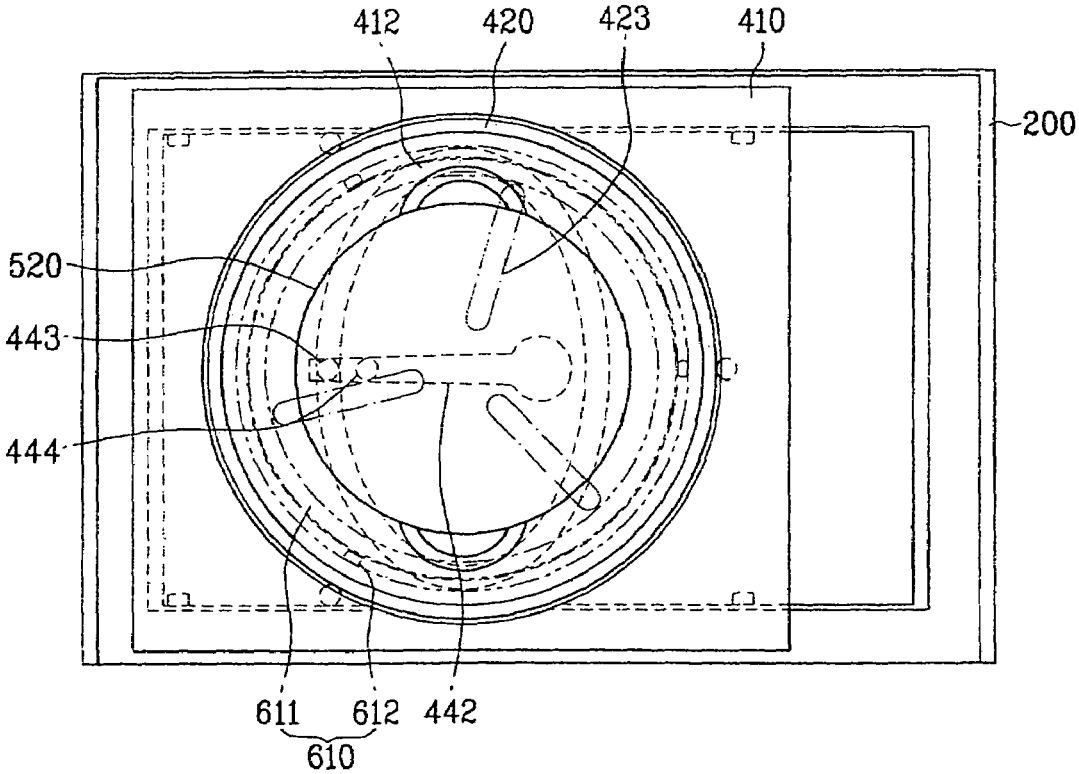
Figure 28A:
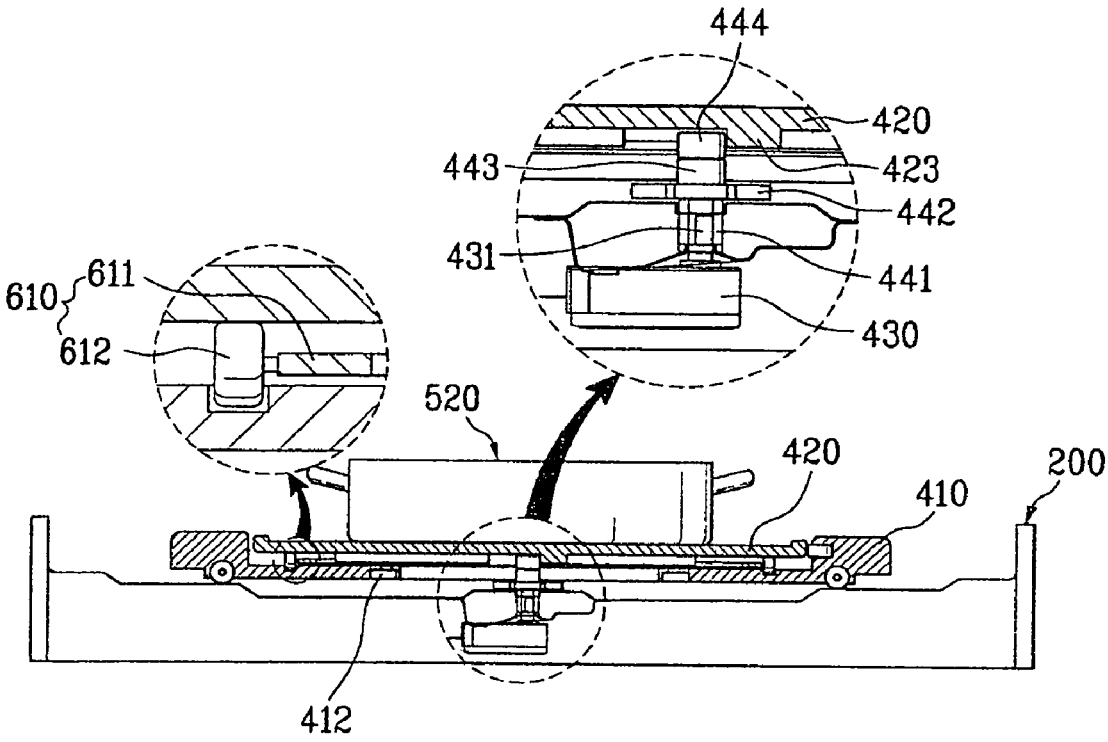
Figure 28B:
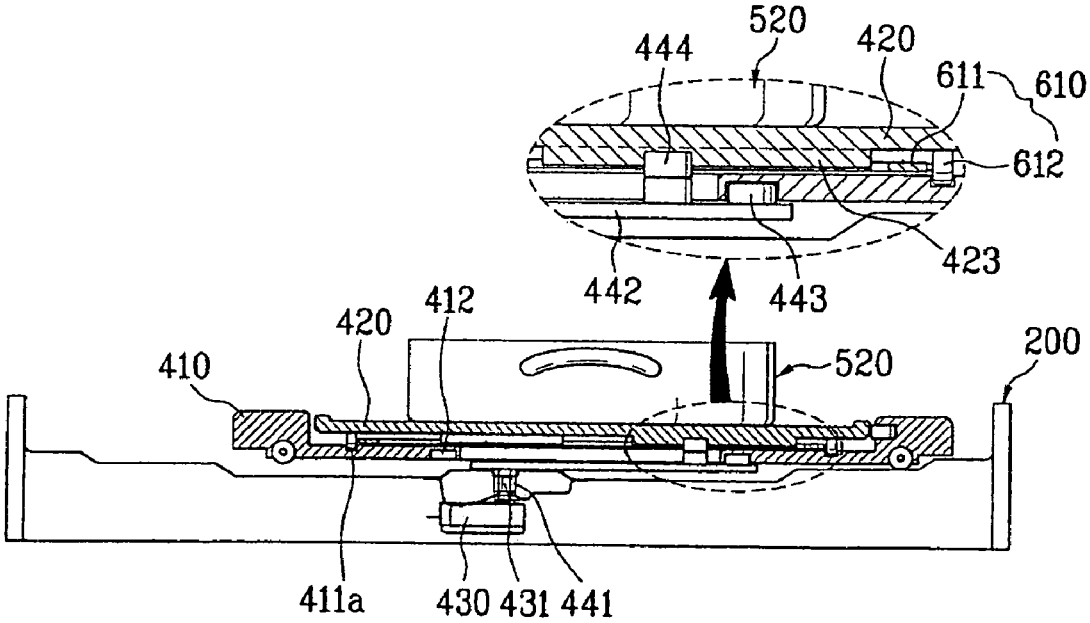
Figure 28C:
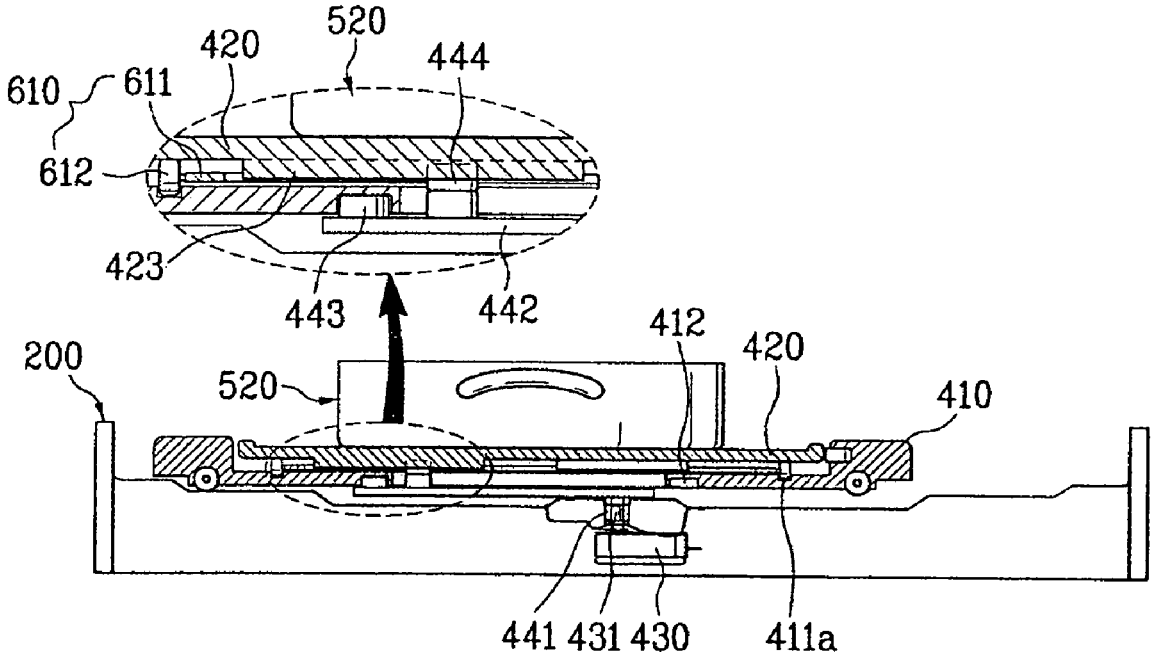

In the fourth embodiment, there are one or more than one second ridge 423, on the underside surface of the second tray 420 along a radial direction of the second tray 420 at regular intervals. While the second bushing 444 of the link 440 is inserted in the slot 422 (see FIG. 2) provided as the second receiving member in the first to third embodiments, as shown in FIGS. 25A to 25C, the second bushing 444 is engaged with the second ridge 423 in a state the second bushing 444 is simply in contact with a surface of the second ridge 423 in the fourth embodiment.

Above structure requires no inserting of the second bushing 444 into the slot when the second tray 420 is placed in the receiving portion 411. That is, what is required for placing the second tray 420 in the receiving portion 411 is just placing the second tray 420 in the receiving portion 411, simply.

Then, the second bushing 444 moves and engages with the one surface of the second ridge 423 when the link 440 rotates, and, when the link 440 keeps rotating, the second bushing 444 pushes the second ridge 423 in a width direction of the second ridge 423, the second tray 420 rotates.

During the second tray 420 rotates, the second bushing 444 slides along a length direction of the second ridge 423. In this instance, since the second ridge 423 is elongated along the radial direction of the second tray 420 adequately, the second bushing 444 can always maintain a state in which the second bushing 444 is slidably engaged with the second ridge 423, adequately.

In the meantime, the operation of the tray assembly in accordance with a fourth preferred embodiment of the present invention is illustrated well in FIGS. 25A to 28C, which is similar to above, of which description will be omitted.

In the first to fourth embodiment tray assemblies, the second bushing 444 on the link 440 is directly engaged, and rotates with the second tray 420. However, the present invention provides not only such a structure, but also a fifth embodiment in which the second bushing 444 of the link 440 rotates the second tray 420, indirectly. FIG. 29 illustrates a disassembled perspective view of a tray assembly in accordance with a fifth preferred embodiment of the present invention, referring to which, the fifth preferred embodiment of the present invention will be described in more detail.

Referring to FIG. 29, the tray assembly in accordance with a fifth preferred embodiment of the present invention includes a first tray 410, a second tray 420, a rotating supporter 610, and a link 440. The first tray 410 has similar to the third or fourth embodiment, and the link 440 is similar to first to fourth embodiments. However, in the fifth embodiment, the link 440 does not engage with the second tray directly, but with the rotating supporter 610. Therefore, only technical characteristics of the fifth embodiment will be described.

The tray 410 has a receiving portion 411 provided to an upper surface, and a rotating supporter 610 is provided on a floor of the receiving portion 411. The rotating supporter 610 has a structure similar to the third or fourth embodiment, except that the rotating supporter 610 of the tray assembly in accordance with the fifth embodiment is further provided with a cross bar 613.

The cross bar 613 crosses an inside of the annular frame 611, with both ends fixed to the frame 611. It is preferable that cross bar 613 is formed as one unit with the frame 611.

Figure 30A:
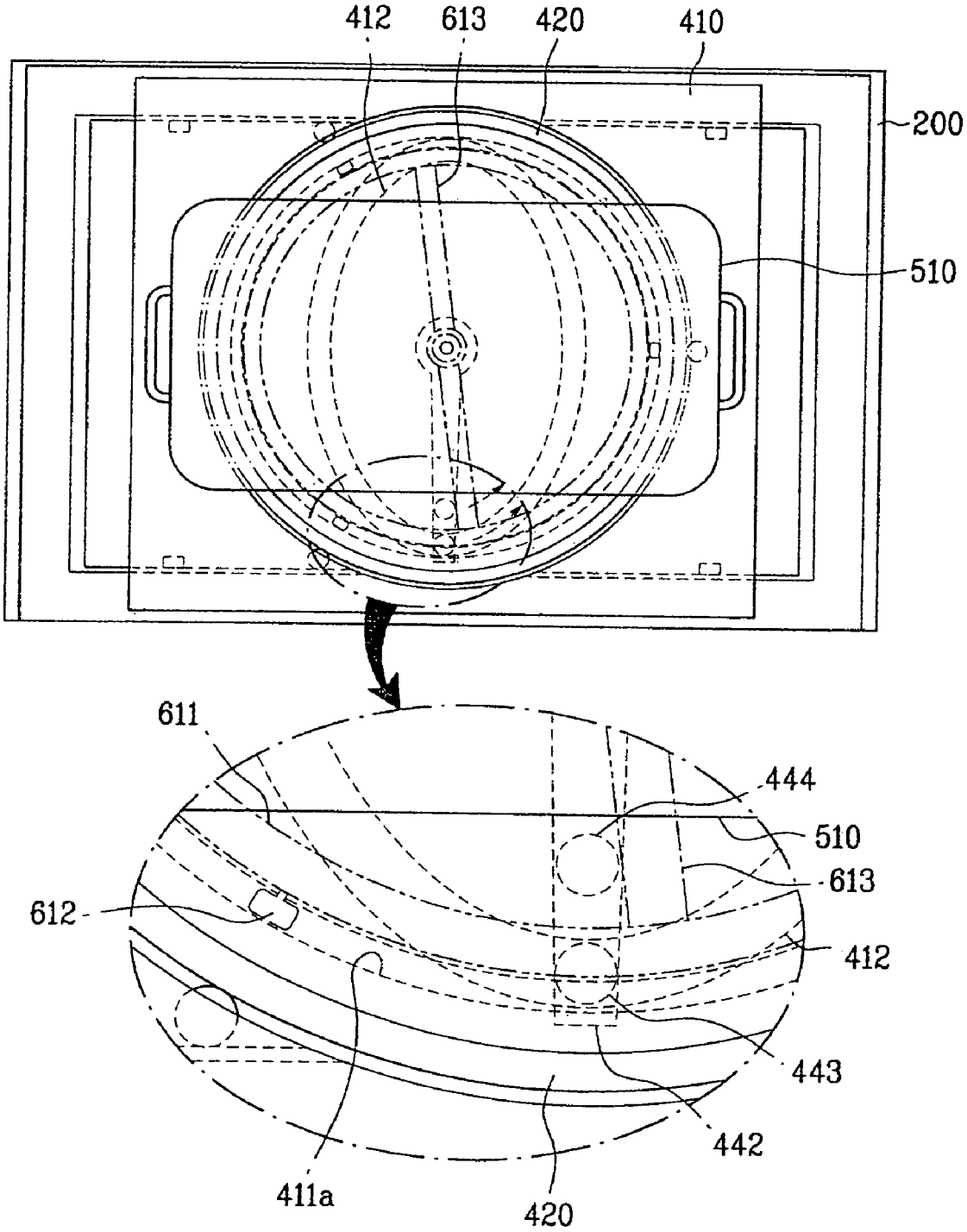
Figure 30B:
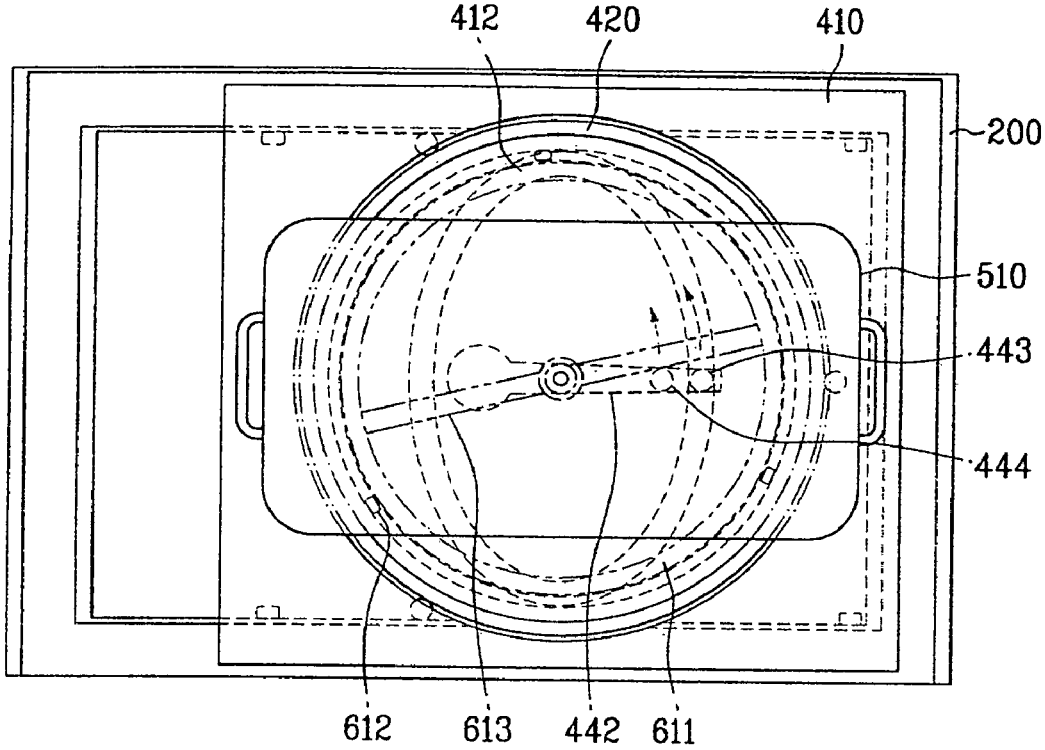
Figure 30C:
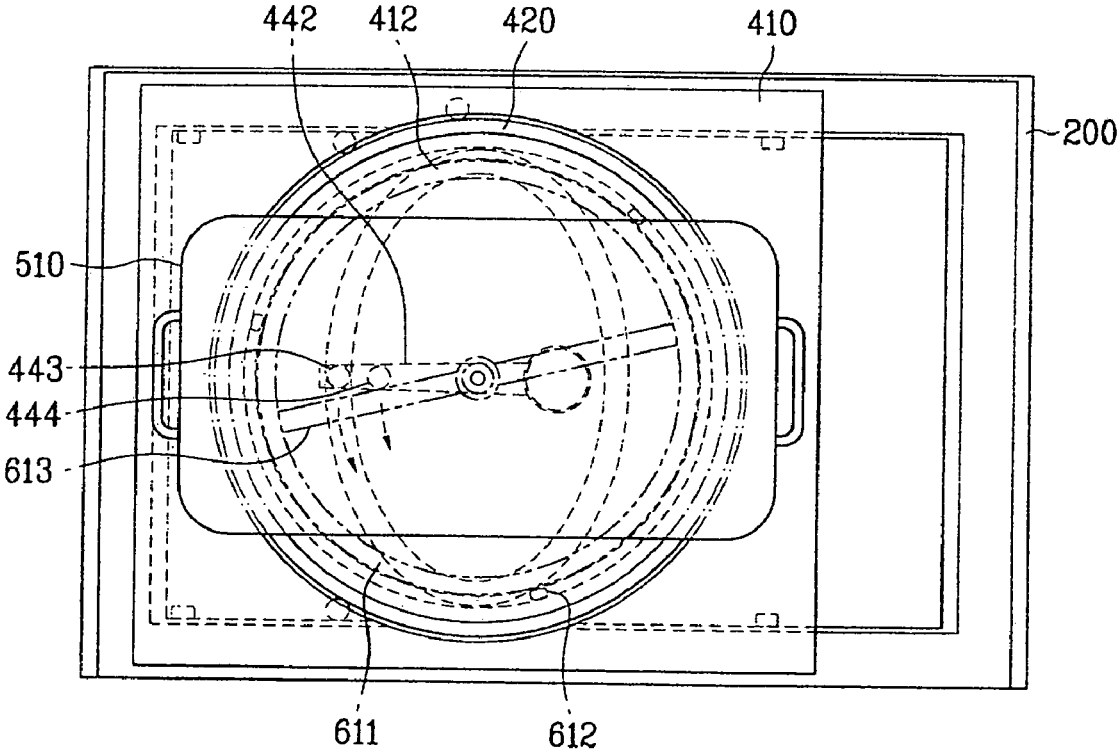
Figure 31A:
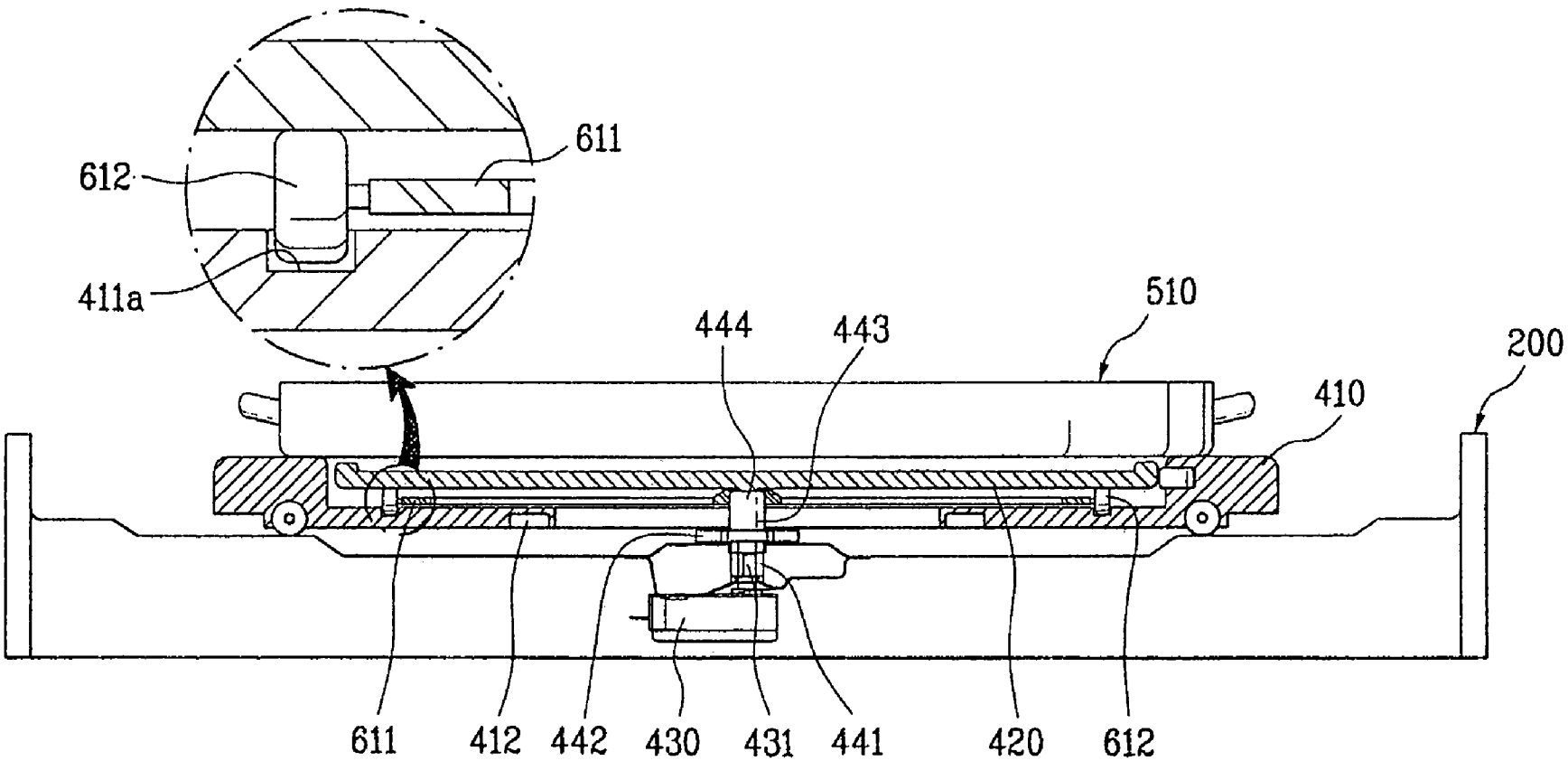
Figure 31B:
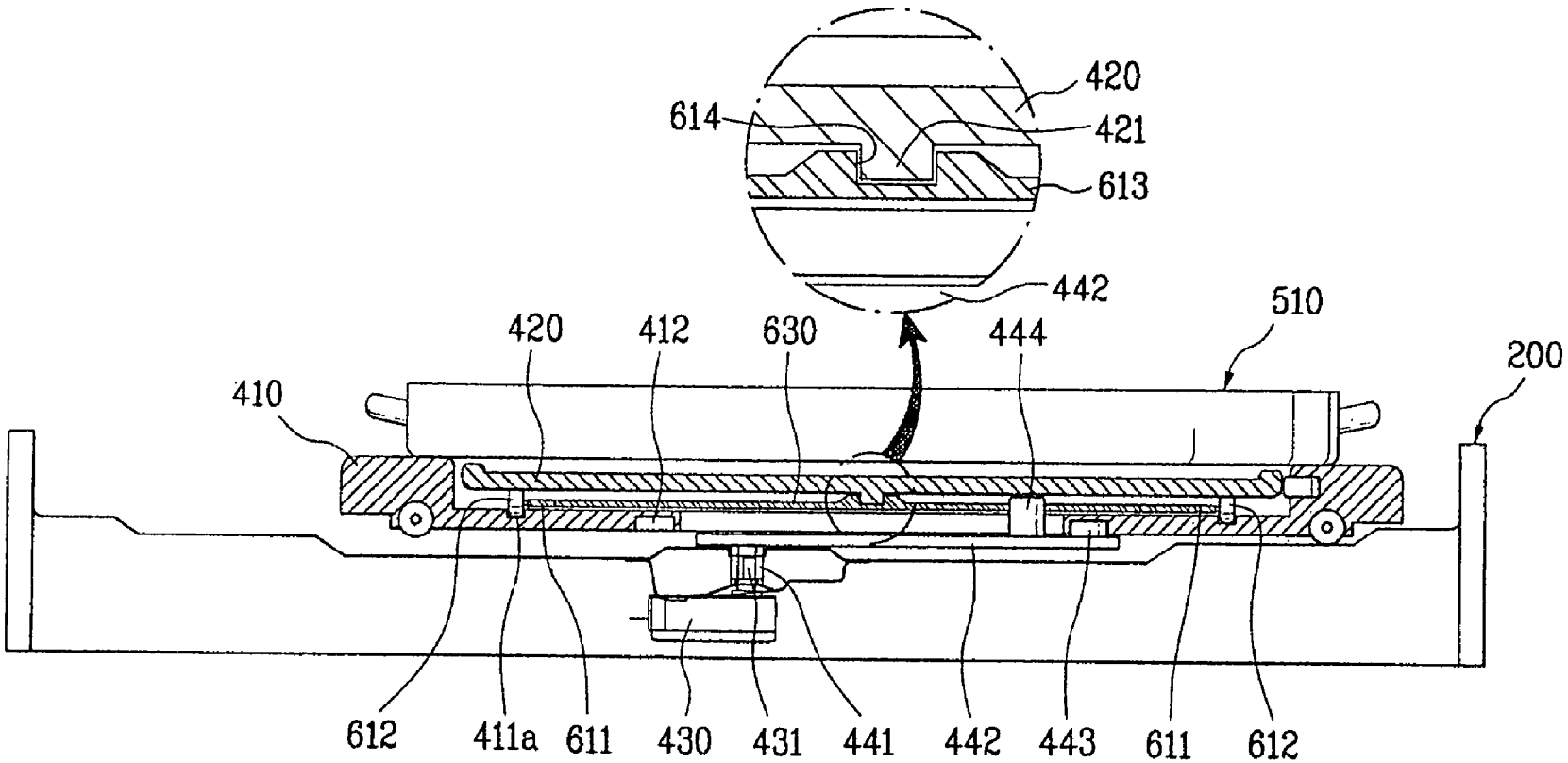
Figure 31C:
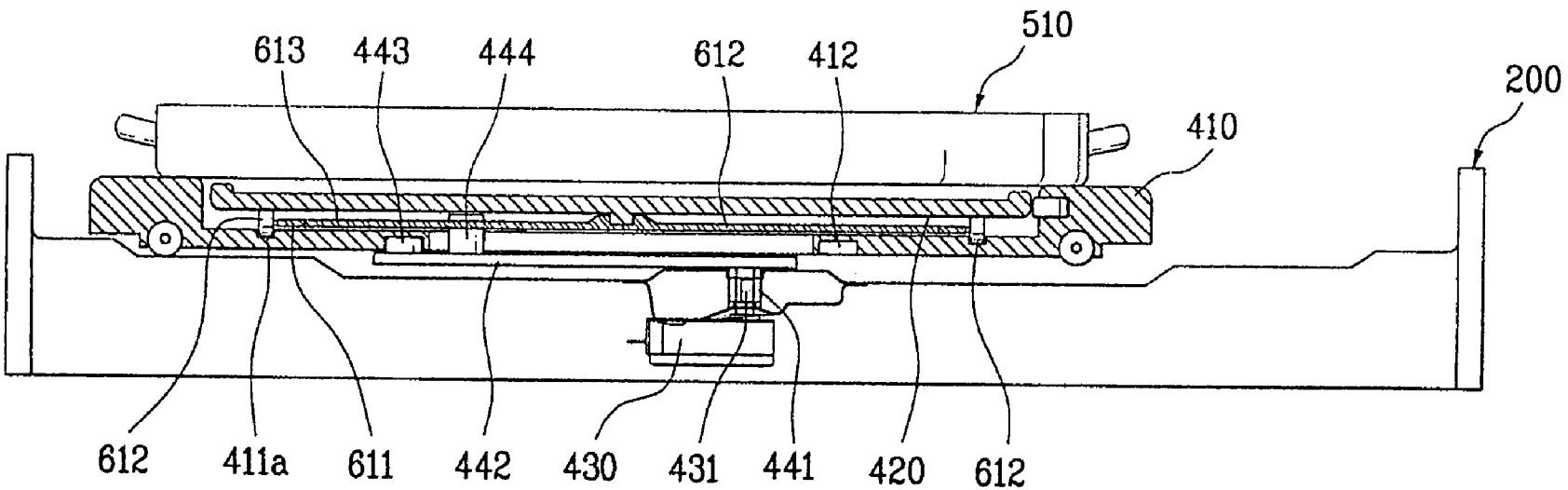
Figure 32A:
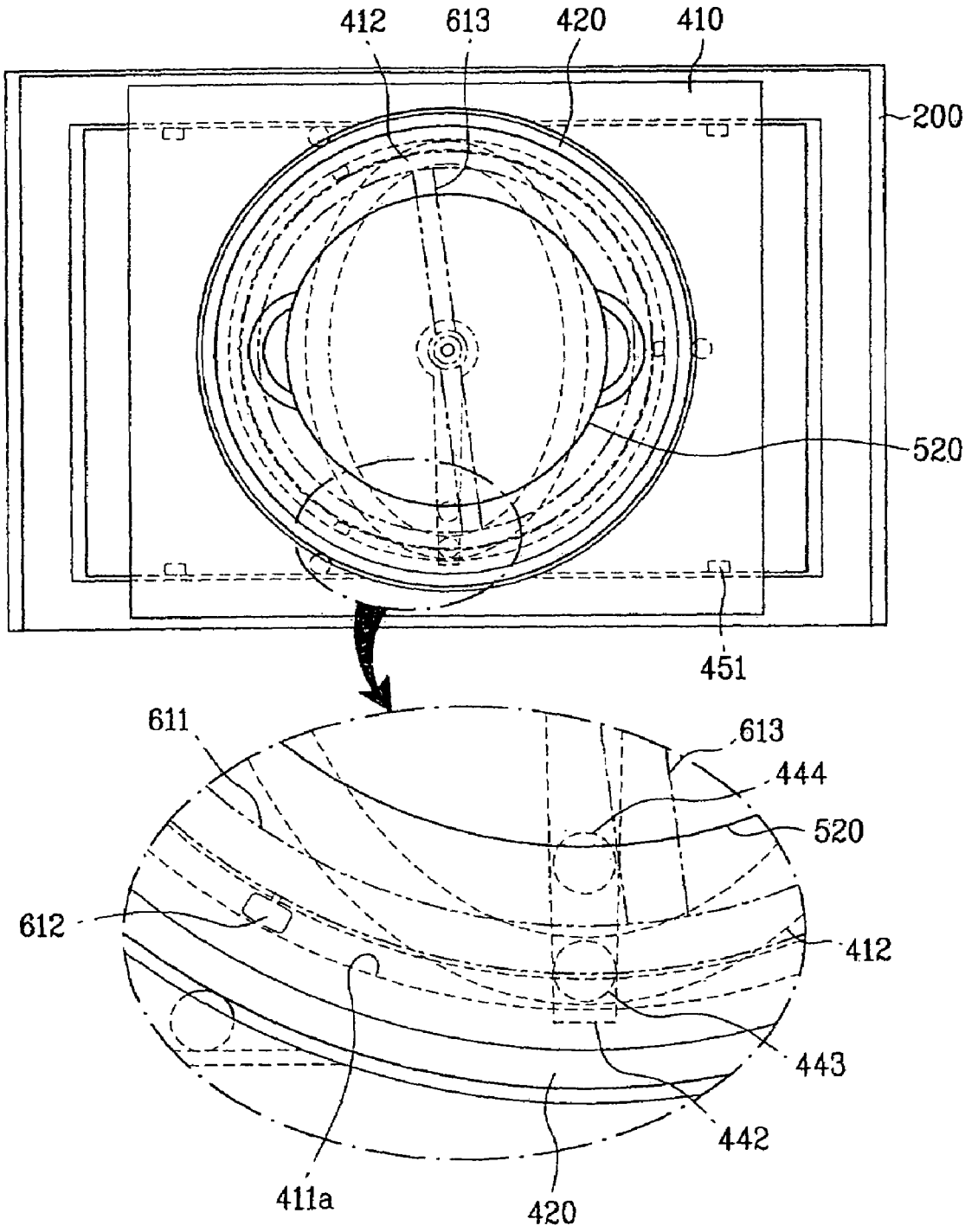
Figure 32B:
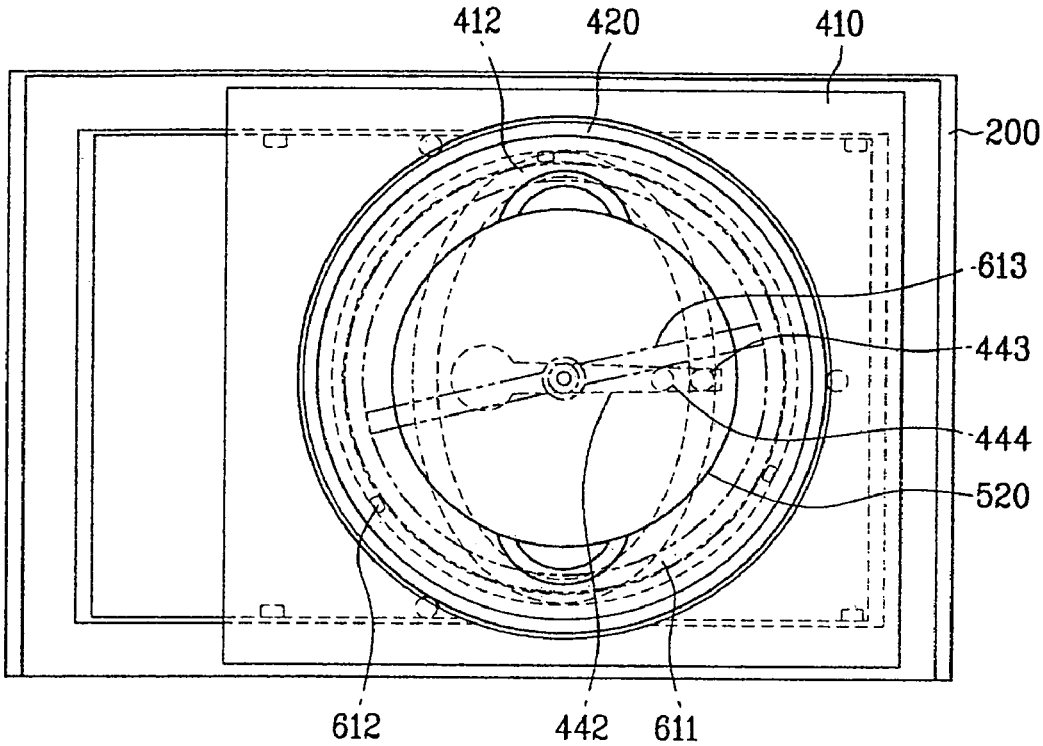
Figure 32C:
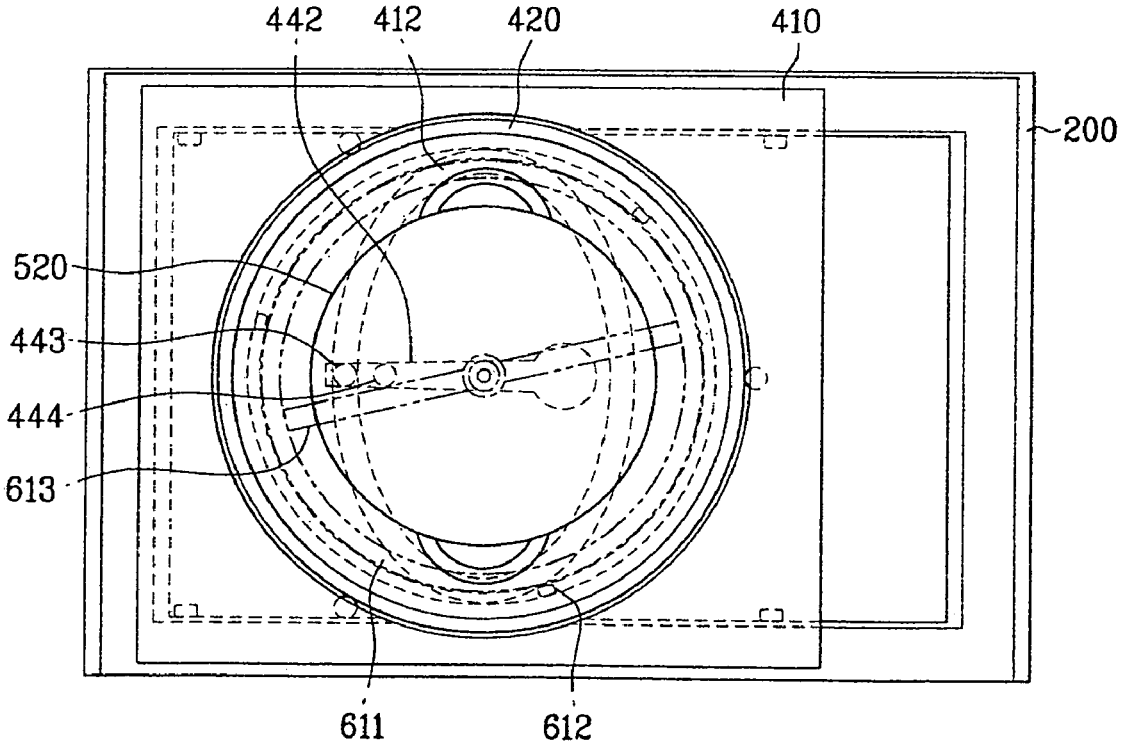
Figure 33A:
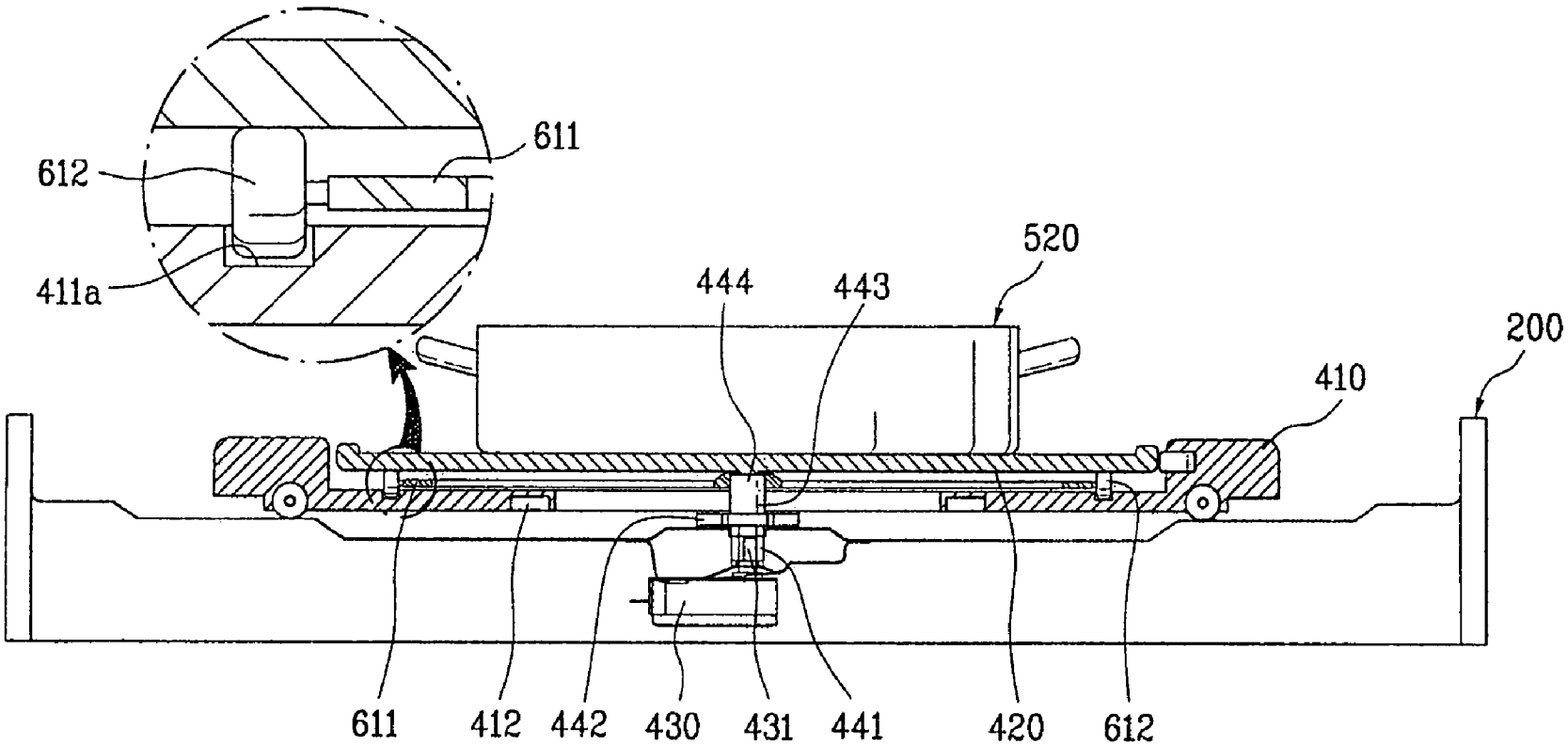
Figure 33B:
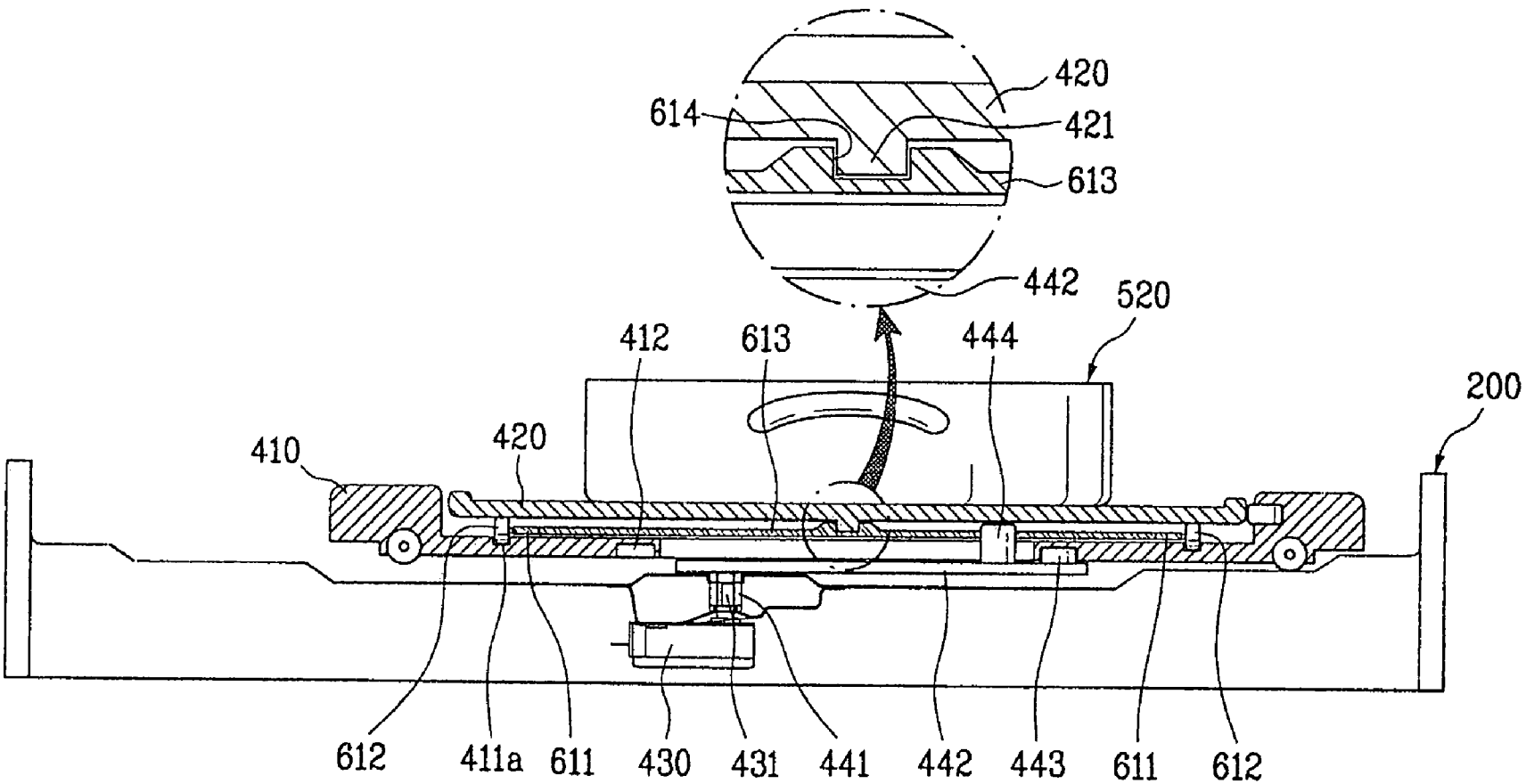
Figure 33C:
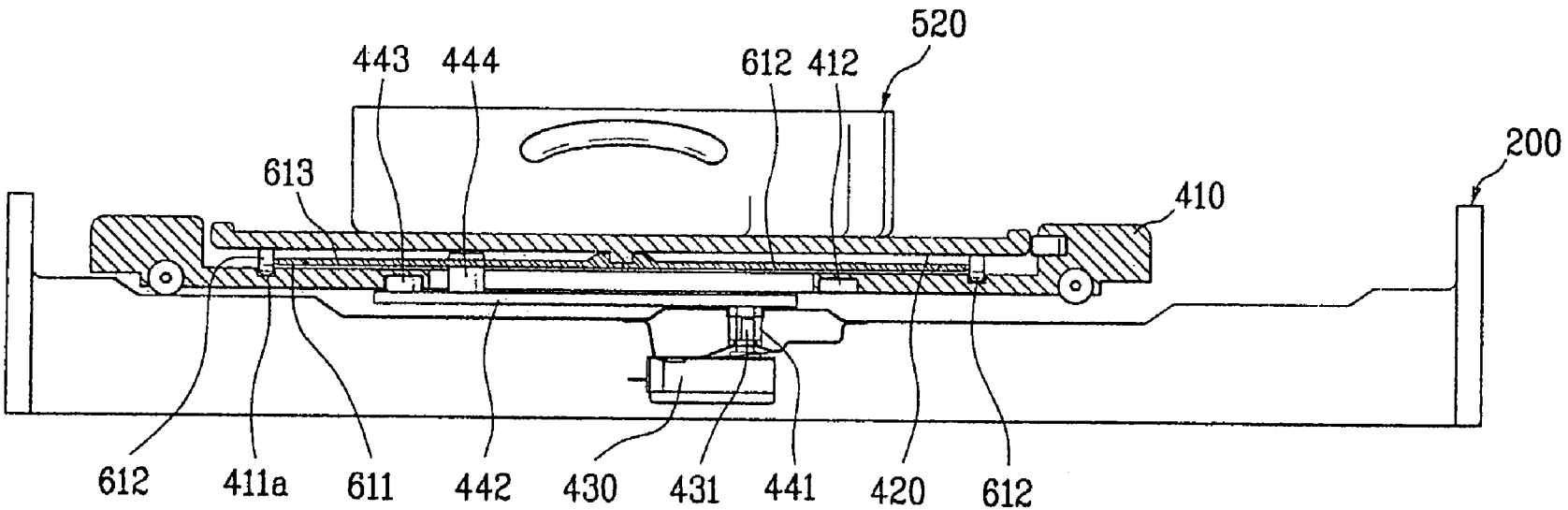

As shown in FIG. 30A, the cross bar 613 is slidably engaged with a part of the link 440, in more detail, the second bushing 444.

In the meantime, a second tray 420 is provided on the rotating supporter 610. The second tray 420 is circular, and, different from the first to fourth embodiment, has no second receiving portion.

As described before, in the tray assembly of the fifth embodiment, the first bushing 443 of the link 440 is engaged with the first tray 410, and the second bushing 444 of the link 440 is engaged with the crossbar 613 of the rotating supporter 610. Therefore, as shown in FIGS. 30A~33C, when the microwave oven is in operation, the first bushing 443 reciprocates the first tray 410 within the cooking chamber 200, and the second bushing 444 rotates the rotating supporter 610.

In this instance, the rollers 612 of the rotating supporter 610 are in contact with, and roll on the floor of the receiving portion 411, and underside surface of the second tray 420. Of course, the rollers 612 roll following a track 411*a* in the receiving portion 411. Therefore, as the rotating supporter 610 rotates, the second tray 420 also rotates together with the rotating supporter 610. If a friction member, such as a rubber pad, is attached to the underside surface of the second tray 420 the rollers 612 are in contact thereto, the second tray 420 can be rotated more smoothly when the rotating supporter 610 rotates.

In the meantime, the second tray 420 rotates freely with respect to the rotating supporter 610. Therefore, when the rotating supporter 610 rotates, the second tray 420 can lean to any one side.

For preventing this from happening, it is preferable that a hole 614 is provided in one of the second tray 420 and the rotating supporter 610, and a projection 421 is provided to the other one for inserting in the hole 614. For reference, FIG. 29 illustrates an example in which the projection 421 is provided to the second tray 420, and the hole 614 is provided to the crossbar 613 of the rotating supporter 610.

It is preferable that the projection 421 has a size which fits in the hole 614, not tightly, but loosely, so that the second tray 420 rotates with respect to the rotating supporter 610, freely. However, the size of the projection 421 is not limited to this, but the size may fit in the hole 614 tightly.

The second tray 420 in accordance with a fifth preferred embodiment of the present invention has very simple structure, and can be assembled very easily because, in assembly of the tray, the assembly is done if the rotating supporter 610 and the second tray 420 are placed in the receiving portion 411 of the first tray 410 in succession.

Moreover, since the second tray 420 rotates with the rotating supporter 610, and the rollers 612 pushes the second tray 420 in a rotation direction, a rotation speed of the second tray 420 becomes faster. According to this, food can be heated more uniformly.

The tray assembly in accordance with one of the first to fifth embodiments of the present invention has a structure in which food is, not only reciprocated linearly, but also rotated, thereby enabling uniform heating of the food. However, the present invention further provides a sixth embodiment which has a structure that can reciprocate and heat the food, which will be described with reference to the attached drawings.

FIG. 34 illustrates a disassembled perspective view of a tray assembly in accordance with a sixth preferred embodiment of the present invention. As shown in FIG. 34, the tray assembly includes a first tray 410 in a cooking chamber 200, and a link 440 connected between the first tray 410 and the motor 430, for reciprocating the first tray 410 within the cooking chamber 200.

The first tray 410 has a structure similar to the first tray 410 described in one of the first to fifth embodiments. However, since no second tray is provided in the sixth embodiment, neither receiving portion having a depth is provided in the upper surface of the first tray 410, nor the rollers for guiding rotation of the second tray are provided, separately.

The first tray 410 has a slot 413 in an underside for serving a function the same with the guide groove 412 provided as the first receiving member in the first embodiment. However, the slot 413 may have, not only a structure the same with the guide groove 412, but also, as shown in FIG. 34, a simple and narrow structure elongated in a width direction of the first tray 410, or a front/rear direction of the cooking chamber 200.

The link 440 includes a boss 441 fixed to a shaft 431 of a motor 430, an arm 442 extended in a horizontal direction from the boss 441, and a first bushing 443 provided to one point of the arm 442. The first bushing 443 is eccentric to an axis of the boss 441, and slidably engaged with the slot 413. Of course, it is preferable that the first bushing 443 is rotatable with respect to the arm 442.

In the meantime, there can be a supporter 620 between a floor of the cooking chamber 200, and the first tray 410. The supporter 620 includes a frame 621, and a plurality of rollers 622 fitted along a circumference of the frame 621, for smooth guidance of the linear reciprocating movement of the first tray 410.

However, the supporter 620 may not be provided to the tray assembly of the sixth embodiment, but a plurality of roller may be provided to the underside surface or a circumferential surface of the first tray 410, that are in contact with, and roll on the floor of the cooking chamber 200.

Figure 35D:
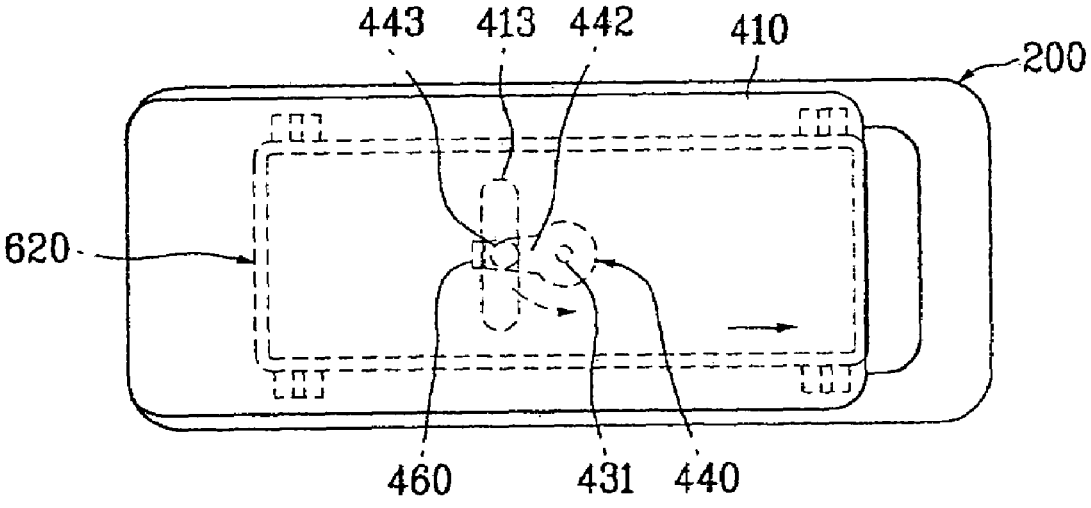

In the tray assembly, when the motor 430 is operated, the link 440 rotates. Then, as shown in FIGS. 35A and 35D, the first tray 410 reciprocates in a lateral direction by the first bushing 443 engaged with the slot 413.

Accordingly, the tray assembly of the sixth embodiment enables, not only cooking of a long food, or food in a long container, but also effective use of an inside space of the cooking chamber 200.

However, the sixth embodiment only having above structure causes the following problem. That is, a portion of weight of the reciprocating first tray 410 transmitted to the link 440 makes a part of the arm 442 where the first bushing 443 droops lower than a boss 443 side. If the drooping of the first bushing 443 is great, the first bushing 443 is liable to break away from the slot 413. Moreover, a load is transmitted to the boss 441, the boss 441 is liable to be broken, or to be broken away from the shaft 431 of the motor 430.

Accordingly, the tray assembly in accordance with the sixth preferred embodiment of the present invention is further provided with a structure for solving above problem. That is, the link 440 is further provided with a member for preventing the arm 442 from drooping.

The member is provided to an end side or an underside of the arm 442 so that the member is in contact with the floor of the cooking chamber 200. The member may be a projection formed as one unit with the arm 442, however, it is preferable that the member is a roller 460 separate from the arm 442.

If the member is the roller 460, as shown in FIGS. 36A to 36C, the roller 460 is in contact with, and rolls on the floor when the link 440 rotates. Therefore, the roller 460, not only prevents the arm 442 from drooping, but also helps the link 440 rotating.

Once the member prevents the arm 442 from drooping, the breaking away of the link 440 from the slot 413, or the breaking away of the boss 441 from the shaft 431 of the motor 430 can be prevented.

In the meantime, the member for preventing the arm 442 from drooping is not limited to the sixth embodiment, but applicable to all of the first to fifth embodiments. In one of the first to fifth embodiments, a member like the roller 460 is fitted to one side of the arm 442 of the link 440, an effect the same with the description in the sixth embodiment can be obtained.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

As has been described, the microwave oven of the present invention has the following advantages.

First, the microwave oven in accordance with one of the first to fifth embodiments of the present invention permits, not only reciprocates, but also rotates, thereby heating the food uniformly.

Second, the microwave oven of the present invention permits to reciprocate long food or food in a long container within the cooking chamber linearly in cooking. Therefore, all kinds of food can be cooked, conveniently and frequently.

Third, the microwave oven of the present invention can use an inside space of the cooking chamber, effectively.

Fourth, in a case roller parts or a rotating supporter is provided to the tray assembly, the second tray can rotate in a state securely supported without sloped to one side.

Fifth, in a case a member for preventing the arm from drooping is provided to the link of the tray assembly, breaking away of the link from the tray and the motor shaft can be prevented.

What is claimed is:

1. A microwave oven comprising:

a case with a door;

a cooking chamber in the case openable/closable with the door, and having a microwave applicable thereto;

a first tray mounted in the cooking chamber to reciprocate therein;

a second tray rotatably mounted on the first tray; and a link engaged with the motor and the first tray such that the first tray reciprocates within the cooking chamber, and further engaged with the motor and the second tray such that the second tray rotates with respect to the first tray.

2. The microwave oven as claimed in claim 1, wherein the link includes;

a boss fixed to a shaft of the motor, a first bushing eccentric to an axis of the boss, and engaged with the first tray, and a second bushing eccentric to the axis of the boss, and engaged with the second tray.

3. The microwave oven as claimed in claim 2, wherein the at least one of the first bushing and second bushing is rotatable.

4. The microwave oven as claimed in claim 1, wherein the link is slidably engaged with the first, and second trays.

5. The microwave oven as claimed in claim 1, wherein the first tray includes a first receiving member on an underside surface of the first tray such that a part of the link is slidably engaged with the first receiving member.

6. The microwave oven as claimed in claim 5, wherein the first receiving member is a guide groove, or a first ridge, having a surface to be engaged with the link in a form of an ellipse when seen from above.

7. The microwave oven as claimed in claim 6, wherein the ellipse has a major axis arranged along a width direction of the first tray, or a front/rear direction of the cooking chamber, and a minor axis arranged along a length direction of the first tray, and a lateral direction of the cooking chamber.

8. The microwave oven as claimed in claim 5, wherein the surface of the first receiving member having the link engaged therewith includes;

two liner portions parallel to each other, and curved portions each connected between ends of the two linear portions.

9. The microwave oven as claimed in claim 8, wherein the curved portion has an arc form or a semicircular form.

10. The microwave oven as claimed in claim 8, wherein the curved portions are distanced farther than the linear portions.

11. The microwave oven as claimed in claim 8, wherein the linear portions are arranged along a width direction of the first tray, or a front/rear direction of the cooking chamber.

12. The microwave oven as claimed in claim 5, wherein the surface of the first receiving member having the link engaged therewith includes;

one pair of first two curved portions opposite to each other, and second curved portions each having a curvature different from the first curved portion connected between ends of the first curved portions.

13. The microwave oven as claimed in claim 12, wherein at least one of the first curved portion and the second curved portion is an elliptical arc.

14. The microwave oven as claimed in claim 12, wherein the second curved portions are distanced farther than the first curved portions.

15. The microwave oven as claimed in claim 12, wherein the first curved portions are arranged along a width direction of the first tray, and a front/rear direction of the cooking chamber.

16. The microwave oven as claimed in claim 15, wherein the second curved portion is a circular arc.

17. The microwave oven as claimed in claim 5, wherein the surface of the first receiving portion having the link engaged therewith has a diamond form when seen from above.

18. The microwave oven as claimed in claim 17, wherein the diamond form has rounded corners.

19. The microwave oven as claimed in claim 17, wherein the diamond form has a longer diagonal line arranged in a width direction of the first tray or a front/rear direction of the cooking chamber.

20. The microwave oven as claimed in claim 5, wherein a distance from a rotation axis of the link to a part of the link is the same with, or greater than a distance from the rotation axis of the link to the surface of the first receiving portion having a part of the link engaged therewith.

21. The microwave oven as claimed in claim 2, wherein the first tray includes;

a first receiving member in an underside surface of the first tray slidably engageable with the first bushing.

22. The microwave oven as claimed in claim 1, wherein the first tray has an opening in a central part for passing a part of the link having the second tray engaged therewith.

23. The microwave oven as claimed in claim 1, wherein the first tray includes first rollers for smooth guide of reciprocating movement of the first tray.

24. The microwave oven as claimed in claim 23, wherein a plurality of the first rollers are fitted along a periphery of an underside surface of the first tray.

25. The microwave oven as claimed in claim 1, wherein the link includes;

a boss fixed to a shaft of the motor, an arm extended from the boss in a horizontal direction, a first bushing at one point of the arm eccentric to an axis of the boss, and engaged with the first tray, and a second bushing at another point of the arm eccentric to the axis of the boss, and engaged with the second tray.

26. The microwave oven as claimed in claim 25, wherein the link further includes a member provided to the arm for preventing the arm from drooping.

27. The microwave oven as claimed in claim 26, wherein the member is a roller provided to the arm so as to be in contact with the floor of the cooking chamber.

28. The microwave oven as claimed in claim 26, wherein the member is provided to an end side of the arm or an underside of the arm.

29. A microwave oven comprising:

a case with a door;

a cooking chamber in the case openable/closable with the door, and having a microwave applicable thereto;

a first tray mounted in the cooking chamber to reciprocate therein;

a rotating supporter on the first tray;

a link engaged with the motor and the first tray such that the first tray reciprocates within the cooking chamber, and further engaged with the motor and the rotating supporter such that the rotating supporter rotates with respect to the first tray; and a second tray on the rotating supporter for rotating with the rotating supporter.

30. The microwave oven as claimed in claim 29, wherein the link includes;

a boss fixed to a shaft of the motor, a first bushing eccentric to an axis of the boss, and engaged with the first tray, and a second bushing eccentric to the axis of the boss, and engaged with the rotating supporter.

31. The microwave oven as claimed in claim 30, wherein the at least one of the first bushing and second bushing is rotatable.

32. The microwave oven as claimed in claim 29, wherein the first tray includes a first receiving member on an underside surface of the first tray such that a part of the link is slidably engaged with the first receiving member.

33. The microwave oven as claimed in claim 32, wherein the first receiving member is a guide groove, or a first ridge, having a surface to be engaged with the link in a form of an ellipse when seen from above.

34. The microwave oven as claimed in claim 33, wherein the ellipse has a major axis arranged along a width direction of the first tray, or a front/rear direction of the cooking chamber, and a minor axis arranged along a length direction of the first tray, and a lateral direction of the cooking chamber.

35. The microwave oven as claimed in claim 33, wherein the surface of the first receiving member having the link engaged therewith includes;

two liner portions parallel to each other, and curved portions each connected between ends of the two linear portions.

36. The microwave oven as claimed in claim 35, wherein the curved portion has an arc form or a semicircular form.

37. The microwave oven as claimed in claim 35, wherein the curved portions are distanced farther than the linear portions.

38. The microwave oven as claimed in claim 35, wherein the linear portions are arranged along a width direction of the first tray, or a front/rear direction of the cooking chamber.

39. The microwave oven as claimed in claim 32, wherein the surface of the first receiving member having the link engaged therewith includes;

one pair of first two curved portions opposite to each other, and second curved portions each having a curvature different from the first curved portion connected between ends of the first curved portions.

40. The microwave oven as claimed in claim 39, wherein at least one of the first curved portion and the second curved portion is an elliptical arc.

41. The microwave oven as claimed in claim 39, wherein the second curved portions are distanced farther than the first curved portions.

42. The microwave oven as claimed in claim 41, wherein the first curved portions are arranged along a width direction of the first tray, and a front/rear direction of the cooking chamber.

43. The microwave oven as claimed in claim 42, wherein the second curved portion is a circular arc.

44. The microwave oven as claimed in claim 32, wherein the surface of the first receiving portion having the link engaged therewith has a diamond form when seen from above.

45. The microwave oven as claimed in claim 44, wherein the diamond form has rounded corners.

46. The microwave oven as claimed in claim 44, wherein the diamond form has a longer diagonal line arranged in a width direction of the first tray or a front/rear direction of the cooking chamber.

47. The microwave oven as claimed in claim 32, wherein a distance from a rotation axis of the link to a part of the link is the same with, or greater than a distance from the rotation axis of the link to the surface of the first receiving portion having a part of the link engaged therewith.

48. The microwave oven as claimed in claim 29, wherein the first tray includes first rollers for smooth guide of reciprocating movement of the first tray.

49. The microwave oven as claimed in claim 29, wherein the link further includes;

a boss fixed to a shaft of the motor, an arm extended from the boss in a horizontal direction, a first bushing at one point of the arm eccentric to an axis of the boss, and engaged with the first tray, a second bushing at another point of the arm eccentric to the axis of the boss, and engaged with the second tray, and a member provided to the arm for preventing the arm from drooping.

50. The microwave oven as claimed in claim 49, wherein the member is a roller provided to the arm so as to be in contact with the floor of the cooking chamber.

51. The microwave oven as claimed in claim 49, wherein the member is provided to an end side of the arm or an underside surface of the arm.

* * * * *